US011639822B1

(12) United States Patent
Elam et al.

(10) Patent No.: US 11,639,822 B1
(45) Date of Patent: May 2, 2023

(54) BEVERAGE DISPENSER

(71) Applicant: Grupo Gallegos, Huntington Beach, CA (US)

(72) Inventors: John Michael Elam, Woodland Hills, CA (US); Camille van den Brande, Haarlem (NL); Wayman Lee, Los Altos, CA (US); Michael Makay, Stafford, VA (US); Jacobus M. Berkhout, San Rafael, CA (US); Galen Eliason-Carey, San Francisco, CA (US)

(73) Assignee: Grupo Gallegos, Huntington Beach, CA (US)

( * ) Notice: Subject to any disclaimer, the term of this patent is extended or adjusted under 35 U.S.C. 154(b) by 0 days.

(21) Appl. No.: 17/957,623

(22) Filed: Sep. 30, 2022

(51) Int. Cl.
*F25D 3/08* (2006.01)
*F25D 31/00* (2006.01)

(52) U.S. Cl.
CPC ..... *F25D 3/08* (2013.01); *F25D 31/007* (2013.01); *F25D 2303/081* (2013.01); *F25D 2331/805* (2013.01)

(58) Field of Classification Search
CPC ..... F25D 31/007; F25D 2303/081; F25D 2331/805; F25D 2331/806; A47F 1/08; A47F 1/082; A47F 1/085; A47F 7/281; A47B 73/00
See application file for complete search history.

(56) References Cited

U.S. PATENT DOCUMENTS

| | | | | |
|---|---|---|---|---|
| 1,789,300 | A | 1/1931 | Bihl et al. | |
| 1,846,941 | A | 2/1932 | Bihl et al. | |
| 2,576,874 | A | 11/1951 | Acton | |
| 4,042,142 | A | 8/1977 | Ruano | |
| 4,794,764 | A * | 1/1989 | Dyment | G07F 11/54 62/250 |
| 4,924,682 | A * | 5/1990 | Penner | F25D 3/08 206/315.3 |
| 5,009,329 | A | 4/1991 | Farrentine | |
| 5,301,519 | A * | 4/1994 | Howorka | A63B 55/00 62/530 |
| 6,058,733 | A * | 5/2000 | Morgan | F25D 31/007 62/457.4 |
| 6,065,303 | A * | 5/2000 | Harris | F25D 31/007 62/457.4 |
| 6,112,943 | A | 9/2000 | Lauer | |
| 6,173,582 | B1 | 1/2001 | Hixson | |
| 6,862,896 | B1 | 3/2005 | Seidl | |

(Continued)

*Primary Examiner* — David J Teitelbaum
(74) *Attorney, Agent, or Firm* — Hunton Andrews Kurth LLP

(57) ABSTRACT

Exemplary embodiments include a device that may serve as a drink dispenser for beverage cans. The device may be shaped like a keg. The device may include a portion to contain, cool, and dispense the beverage cans and a portion to contain ice to provide cooling, as well as contain additional beverage containers. The device may include up to five tubes with each tube capable of containing up to four beverage containers in the form of cans. A dispensing mechanism may be located at the lower end of each tube to dispense the beverage cans form the device. The tube structure may provide for cooling of the beverage containers within each tube. The device may be portable and may have a cart that can be used for transportation of the device. The device may be detachable from the cart.

20 Claims, 57 Drawing Sheets

(56) References Cited

U.S. PATENT DOCUMENTS

| | | | | |
|---|---|---|---|---|
| 7,766,145 | B1 | 8/2010 | Chang | |
| 8,091,378 | B1 * | 1/2012 | Farias, III | F25D 3/06 62/239 |
| 8,561,422 | B2 | 10/2013 | Jackman | |
| 10,438,438 | B2 | 10/2019 | Lucker et al. | |
| 10,685,527 | B2 | 6/2020 | Lucker et al. | |
| 10,777,035 | B1 | 9/2020 | Lucker et al. | |
| 2006/0017245 | A1 * | 1/2006 | Bruns | B62B 3/00 280/47.26 |
| 2006/0272351 | A1 * | 12/2006 | Murray | F25D 25/00 62/465 |
| 2007/0107459 | A1 | 5/2007 | Strickland et al. | |
| 2008/0217342 | A1 * | 9/2008 | Cinque | B62B 3/1464 220/592.2 |
| 2008/0229778 | A1 * | 9/2008 | Shelton | F25D 31/007 62/457.5 |
| 2011/0011099 | A1 | 1/2011 | Linder | |
| 2011/0101015 | A1 | 5/2011 | Bollmus et al. | |
| 2011/0181792 | A1 | 7/2011 | Hammonds | |
| 2016/0000235 | A1 * | 1/2016 | Hardy | A47F 3/02 211/59.3 |
| 2022/0170683 | A1 | 6/2022 | Jacob | |

* cited by examiner

100

400

400

500

500

600

600

1100

BEVERAGE DISPENSER

FIELD OF THE INVENTION

Exemplary embodiments relate to a device for dispensing beverages such as, for example, a portable cooler having a dispenser for beverage containers, such as cans.

BACKGROUND

Conventional dispensers such as vending machines typically require electrical power for refrigeration, and coolers require users to open, find and retrieve a beverage from storage, such as from ice (typically requiring a user to search around in the ice for the desired beverage and cooling capacity is lost each time a user accesses the cooler. Thus, there is a need for an easy-to-use and easy-to-set-up dispenser that can both keep beverages chilled while individually dispensing a canned beverage to a user.

SUMMARY OF EXEMPLARY EMBODIMENTS

Exemplary embodiments include apparatus that serves as a cooler and dispenser for beverage cans, such as, but not limited to beer, soda, sparkling water, and craft cocktails cans, that includes. The dispensing structure allows for removal of beverage cans that are inserted at an upper portion of the cooler into one or more internal tubes. The cooler portion has a space internally for cooling media to be added and used to cool the beverage cans within the internal tubes.

Exemplary embodiments include a beverage dispenser, having a cylindrical outer shell; an insert, mounted inside of the cylindrical outer shell, the insert having a plurality of cylindrical tubes, each of the plurality of cylindrical tubes being sized to fit a plurality of beverage cans and extending from an upper portion of the cylindrical outer shell to proximate a lower portion of the cylindrical outer shell, wherein access to the insert is through a lid mounted on an upper portion of the cylindrical outer shell; and a beverage dispensing area, located at a lower portion of the cylindrical outer shell where the plurality of cylindrical tubes terminate, having: a movable covering that provides access through the cylindrical outer shell to an inner volume; and the inner volume being located below the lower portion of the insert and having a termination point for the plurality of cylindrical tubes, the inner volume being further configured to allow for removal of each of the plurality of beverage cans from each of the plurality of cylindrical tubes.

Another exemplary embodiment includes a beverage dispensing structure having a plurality of cylindrical tubes, each of the plurality of cylindrical tubes being sized to fit a plurality of beverage cans; a mechanism located at a lower portion of each of the plurality of cylindrical tubes and below a termination of a cylindrical portion of each of the plurality of cylindrical tubes, the mechanism having a puck portion and a rail portion; the rail portion being mounted to a tongue portion of each of the plurality of cylindrical tubes that extends below the termination of the cylindrical portion and the puck portion being mounted thereto and being configured to move vertically along the rail portion; the puck portion having an unloaded position and a loaded position, wherein the unloaded position is above the loaded position and is configured such that the unloaded position of the puck portion creates a seal of the termination of each of the plurality of cylindrical tubes to create an air cushion within each of the cylindrical tubes to slow a descent of a beverage can inserted thereto; and the puck portion being further configured to slide horizontally.

BRIEF DESCRIPTION OF THE DRAWINGS

In order to facilitate a fuller understanding of the various embodiments, reference is made to the attached drawings. The drawings should not be construed as limiting the various embodiments but are intended only to illustrate different aspects and embodiments.

DETAILED DESCRIPTION

Figure 1A:
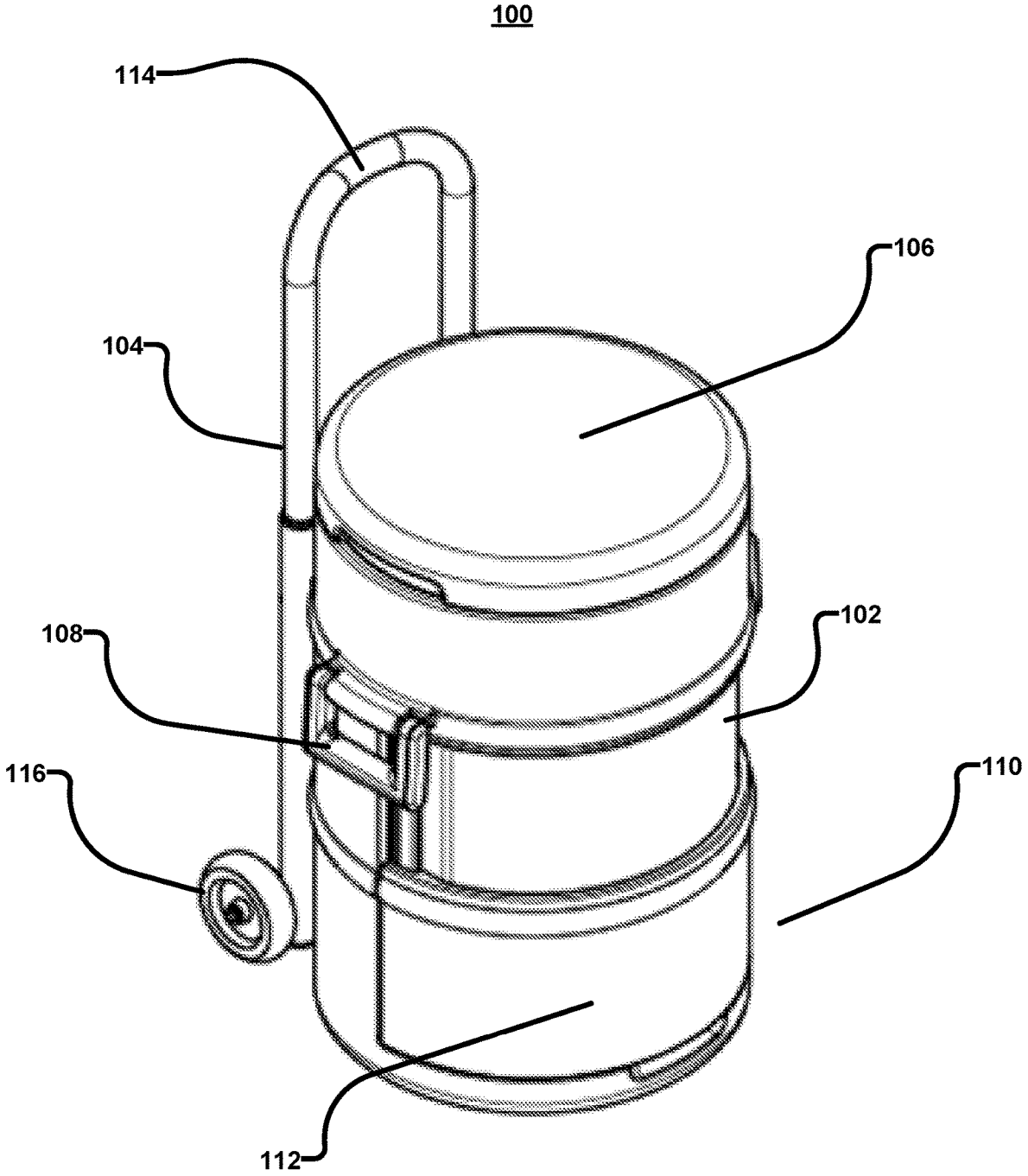
FIG. 1A is a top perspective view of a beverage dispenser according to exemplary embodiments.

The following description is intended to convey an understanding of exemplary embodiments by providing specific embodiments and details. It is understood, however, that various embodiments are not limited to these specific embodiments and details, which are exemplary only. It is further understood that one possessing ordinary skill in the art, in light of known systems and methods, would appreciate the use of various embodiments for its intended purposes and benefits in any number of alternative embodiments, depending upon specific design and other needs.

The following descriptions provide different configurations and features according to exemplary embodiments. While certain nomenclature and types of applications/hardware are described, other names and application/hardware usage is possible, and the nomenclature provided is done so by way of non-limiting examples only. Further, while particular embodiments are described, it should be appreciated that the features and functions of each embodiment may be combined in any combination as is within the capability of one of ordinary skill in the art. The figures provide additional exemplary details regarding the various embodiments. It should also be appreciated that these exemplary embodiments are provided as non-limiting examples only.

Exemplary embodiments include a device that may serve as a drink dispenser for beverages. The device may be referred to as a "keg cooler" or "cooler." The beverages may be in cylindrical cans. The can size may be 12 ounce (or oz.). However, other can sizes may be accommodated such as 16 oz. or 8 oz. In various embodiments, combinations of differing can sizes may be accommodated. The device may be portable and may have a keg-like shape. The device may include a portion to contain and dispense the cans and a portion to contain ice to provide cooling, as well as contain additional beverage containers. The can dispenser portion and the ice container may be an integral structure that is placed into an outer shell. This insert structure, in exemplary embodiments, may have a series of tubes that may be made of a material with high thermal conductivity, such as, for example, a metal. In exemplary embodiments, aluminum or a similar material may be used. In other embodiments, other materials, such as other metals, plastic, or combinations thereof may be used. The outer shell may be shaped like a keg. The outer shell, in exemplary embodiments, may be plastic. In other embodiments, the outer shell may be made of other materials such as metal, or combinations of metal and plastic. The insert may be mounted to or secured to the outer shell. A plurality of mounting or securing points may be used.

In various embodiments, a cart, or caddy attachment, may be detachably coupled to the device to provide a way to transport the device between locations. The device with the cart may be referred to as an apparatus. In some embodiments, the device may have integrated wheels and a handle allowing for self-contained transportation.

According to exemplary embodiments, the device may have five internal tubes. The tubes may be cylindrical in shape. The tubes may be mounted in one or more bracket structures which provide support and stability for the tubes. Exemplary embodiments may include an upper and lower bracket structure. The bracket structures may be mounted to the outer shell of the beverage dispenser. In exemplary embodiments, each tube may accommodate up to four 12 oz. cans (e.g., a US 12 oz. soda, sparking water, or beer can). The capacity of each tube may change if different size cans as used or combinations of differing can sizes are used. For example, the tubes may accommodate 16 oz. or 8 oz. cans. The capacity of the tube may vary based on the can size. In various embodiments, other numbers of tubes may be used. For example, more or less than five tubes may be used and the tubes may be of different sizes to accommodate different numbers of cans or different sizes of cans. That is, more tubes may be used and/or the tubes may have a larger or smaller capacity and combinations of differing tube sizes may be used and the tubes may be of varying diameter to accommodate different can sizes. In various embodiments, the tubes may be individually removable to allow for changing tubes to accommodate different can sizes. For example, embodiments may have one or more tubes that are of a different size than the rest to allow for a mixture of different beverage containers to be used.

The tubes may extend from the upper portion of the dispenser to the lower portion. The lower portion, where the tubes terminate, may be enclosed within a slidable cover and the tubes may taper from a cylindrical structure to a tongue structure, thereby allowing the can to be exposed. The cover may slide upwards to reveal this lower section of the tubes, from which the beverage containers (i.e., cans) may be removed therefrom. The cover may be opaque or transparent.

The tubes may be made of metal (for example, but not limited to, aluminum). Exemplary embodiments may use a metal such as aluminum for its desirable thermal conductivity properties to allow for cooling of the beverage containers. In various embodiments, other materials or combinations of materials with similar thermal properties to aluminum may be used. In other embodiments, different material, such as stainless steel or other metals or alloys or combinations thereof may be used. The tubes may provide for enhanced cooling of the beverage containers (e.g., cans) contained therein by providing a 360 degree surface to allow for cooling. That is, the beverage containers, located in the tube are exposed around each container's circumference to the interior tube wall and the external tube wall may be exposed to a cooling substance (e.g., ice or the like). Given the tube material allows for thermal conductivity between the cooling substance and the beverage containers in the tubes. Because the beverage containers (e.g., cans) are typically constructed of aluminum, the beverage containers in the tube may be relatively quickly cooled and kept at a cool temperature through the design of the tubes. The tube assembly according to exemplary embodiments may have a variety of applications in areas where cooling is desired of beverage containers, such as, but not limited to vending machines and food/drink retail establishments such as convenience stores, markets, and the like.

Located at the lower portion of tube may be a structure for catching, stopping, and holding the can. It may be referred to as a can catcher. The can catcher may have two sliding parts for both vertical and horizontal movement. Vertically, the can catcher may be mounted on a rail. The can catcher may have neutral position that is a raised position. The can catcher may be in the this position in the unloaded state. This unloaded position may be such that the can catcher paddle assembly is located to seal or plug the lower portion of the tube, at least in part. This seal or plug assists in creating the air cushion to slow the descent of a beverage can inserted and dropped into a tube. Once a beverage container (e.g., a can) contacts the can catcher, the weight of the container may cause the assembly to lower to a second position that is lower than the neutral position. This first can may then provide the seal or plug in the tube to assist in creating the air cushion for the next beverage can, and so on as additional beverage cans may be added to a given tube. It is from this position, that the beverage container may be removed from the dispenser. To aid in removing the dispensing, the can catcher may have a puck or disc assembly on which the beverage can rest. The puck assembly may have a ridged and raised rear portion (raised with respect to a front portion of the puck assembly). This puck assembly may be movable in a horizontal direction. The puck assembly may be a two piece assembly with a lower, fixed structure and an upper movable structure. The upper structure may move horizontally with respect to the lower structure. The movement may allow for removal of the beverage container from the dispensing area. In exemplary embodiments, a user may push the movable portion to the rear of the dispensing area. Doing so may allow for the beverage container to drop down lower to be removed. This push may be needed if more than one beverage container is loaded in the tube corresponding to that can catcher assembly. The can catcher assembly may function even if a beverage container is inserted upside down An open volume may be located directly behind the tubes. This open volume may be filled with or contain ice, dry ice, synthetic ice packs, other cooling substances or mediums, or combinations thereof. In various embodiments, additional beverage containers may also be placed into this open volume. The additional beverage containers may be cans, bottles, other types of containers, or combinations thereof. The open volume may have a drain valve located at a lower portion thereof.

A openable lid structure may enclose the open volume and the tubes. The lid structure may be a part of the outer shell surrounding the inner structure described above. Insulation may be placed between the outer shell and the inner structure. The dispenser may have handles located on its sides (e.g., a handle on each side). The handles may be pivotably coupled to the exterior shell of the dispenser. The handles may pivot in an upwards direction.

FIGS. 1A, 1B, 1C, 1D, 1E, 1F, and 1G (collectively, FIG. 1) depict an apparatus according to exemplary embodiments. The apparatus (or device) 100 may have a cooler portion 102 and a cart 104. The cooler portion 102 may have a generally cylindrical shape and, according to exemplary embodiments, the shape may resemble that of a beer keg. For example, the cooler portion 102 may have a height of 26.2 inches, a width of 19.5", and a radius of 215 mm. These dimensions are exemplary and non-limiting. The cooler portion 102 may be made of plastic, metal, and/or combinations thereof. The cooler portion 102 may be available in different colors. In various embodiments, multiple colors and/or logos may be used on the cooler portion 102. The cooler portion 102 may have an inner volume and structure that may be accessed through a lid 106. The structure and inner volume are described below, such as in FIG. 4, for example. The cooler portion 102 may be insulated. For example, the cooler portion may have an inner and outer shell. There may be insulation between the inner and outer shell.

The lid 106 may be removed or pivotally opened to access an inner volume of the apparatus 100. The lid 106 may be separate structure that is not attached to the apparatus 100. In some embodiments, the lid 106 may be pivotally attached to the apparatus 100. In other embodiments, the lid 106 may be attached to the apparatus 100 by a strap. In various embodiments, the lid 106, on its upper surface, may include a non-slip or roughened material on to provide a surface to set a beverage container or containers on. In various embodiments, this material may be inset into the lid 106 as an insert. For example the material may be an EVA foam or silicone material or a similar material or combinations of materials that provide a slip resistant surface.

The cooler portion 102 may have movable handles 108 located thereon. There may be two handles 108 located on opposite sides. In FIG. 1A, for example, only one handle 108 is shown because of the view perspective. The handle 108 may pivot in an upward direction (that is, towards the lid 106) to allow for the handle 108 to be grasped. In this manner, the apparatus 100 may be carried or transported.

Figure 1B:
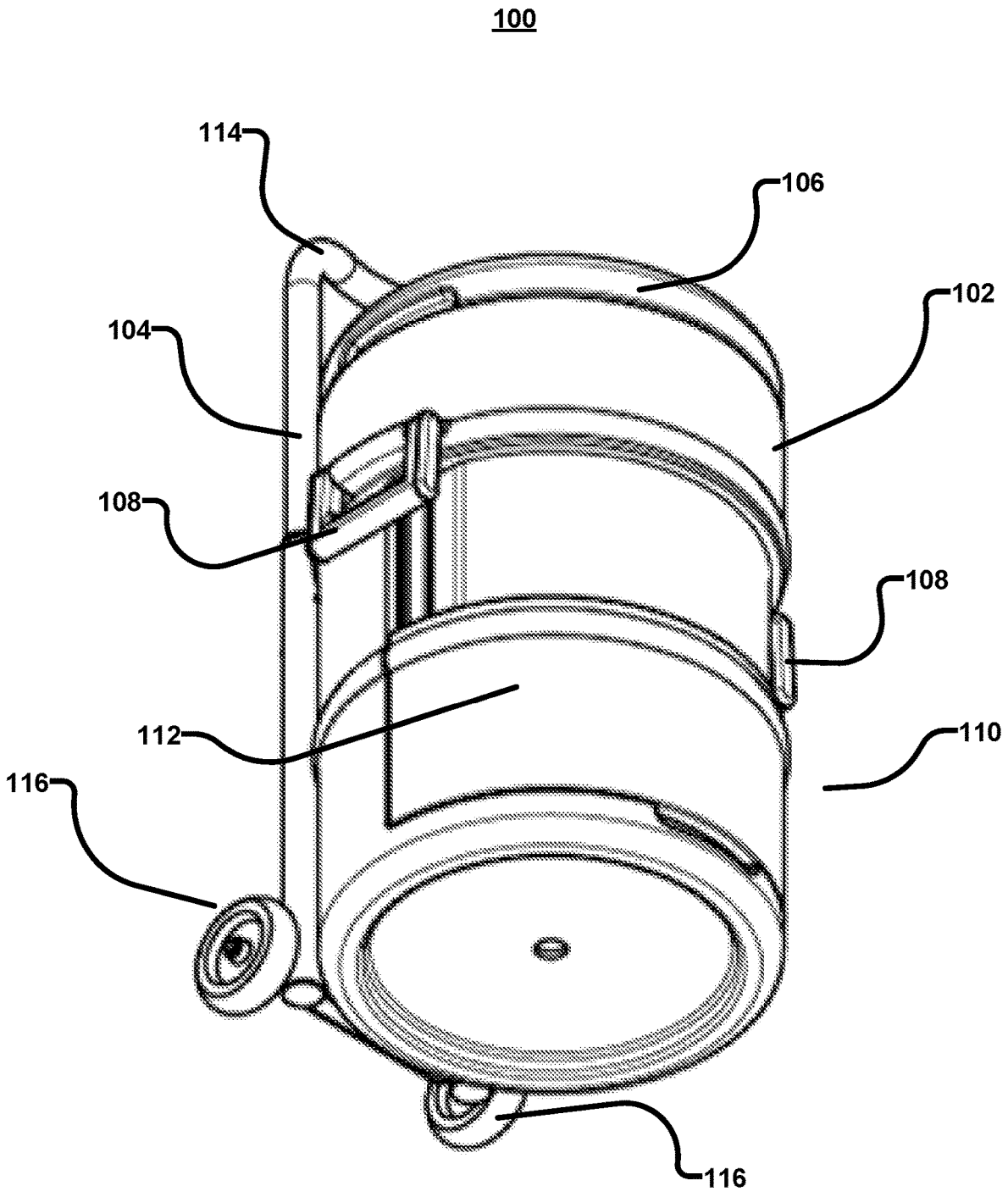
FIG. 1B is a bottom perspective view of the beverage dispenser according to exemplary embodiments.
Figure 1C:
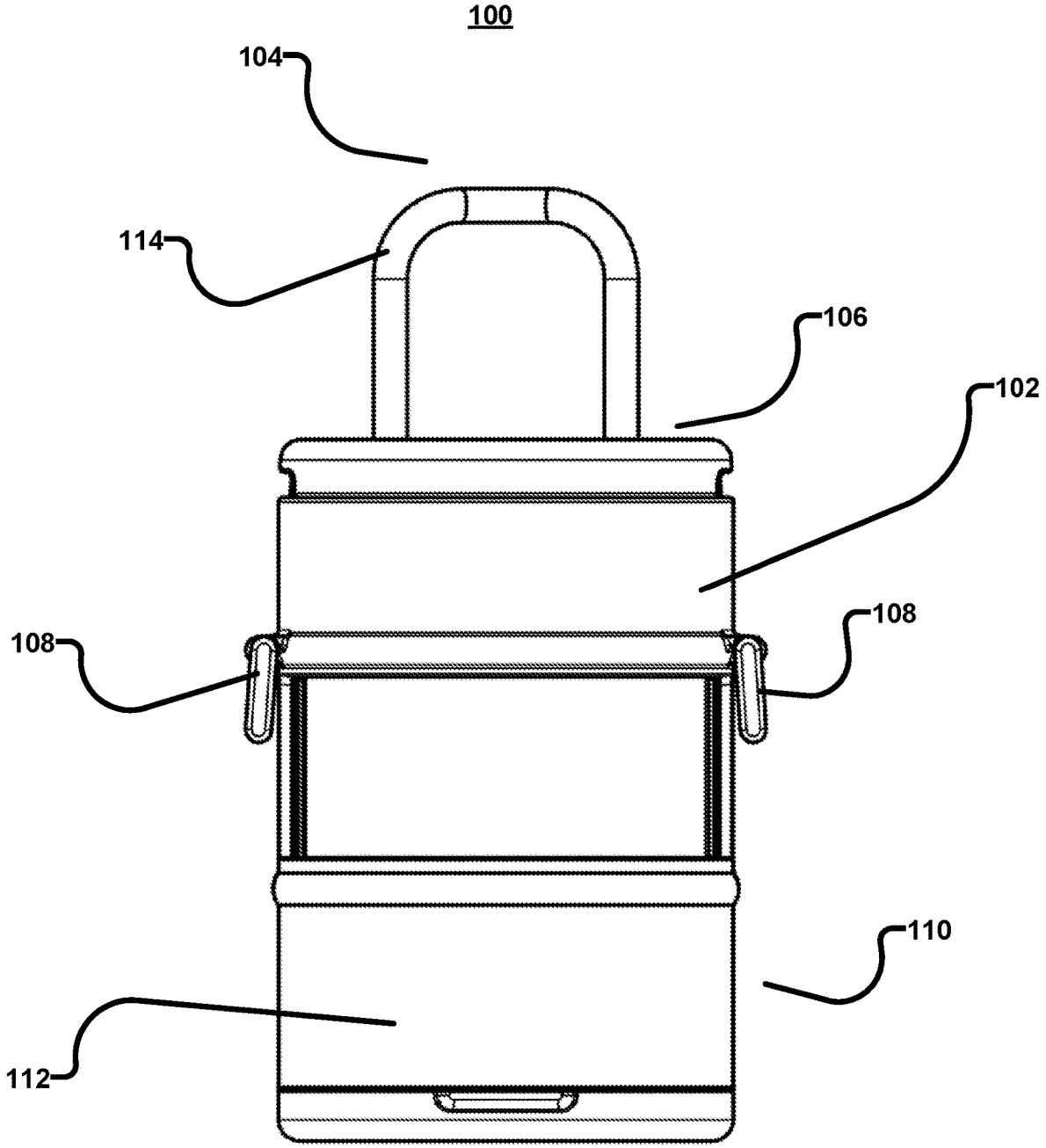
FIG. 1C is a front view of the beverage dispenser according to exemplary embodiments.
Figure 1D:
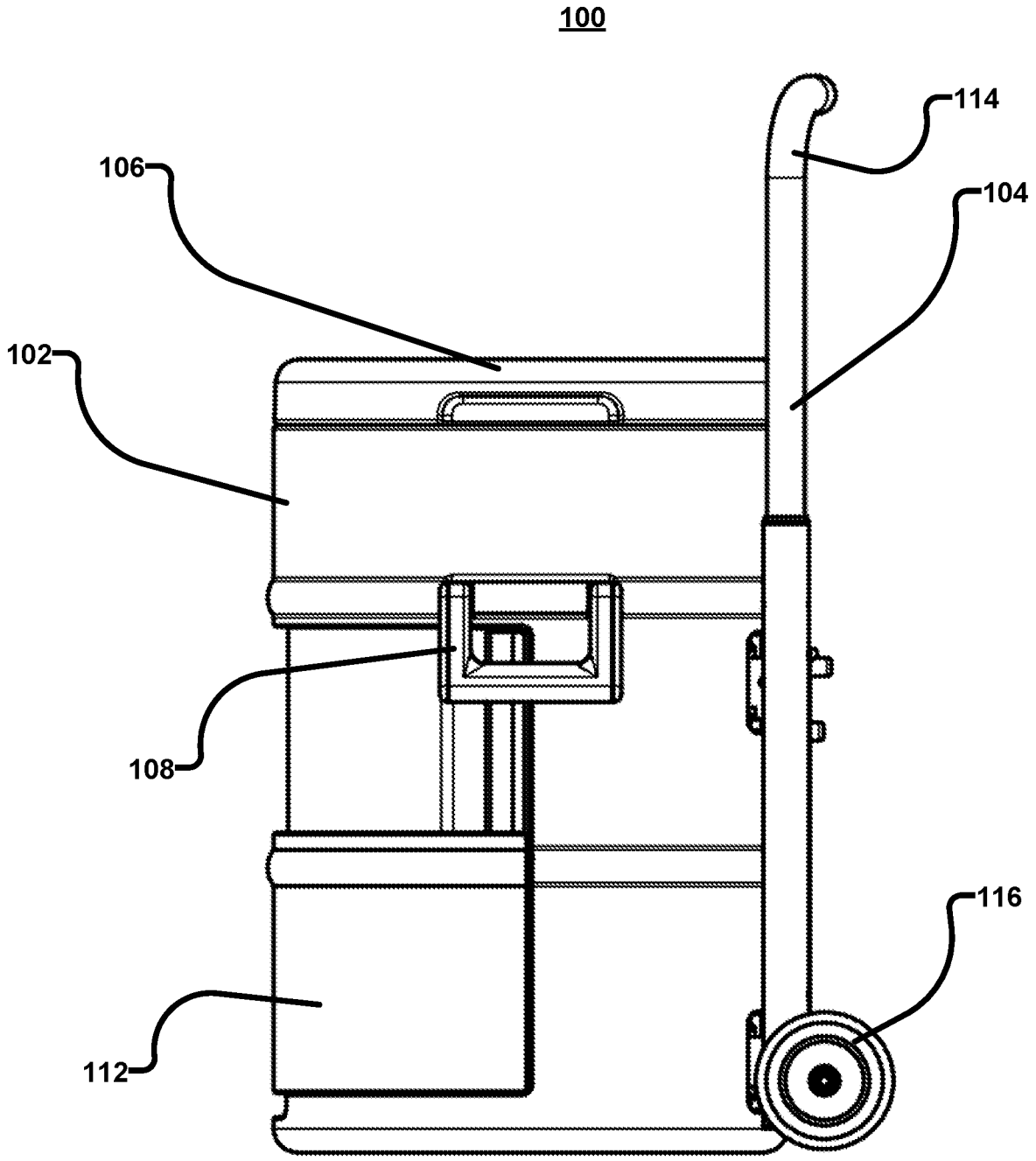
FIG. 1D is a right side view of the beverage dispenser according to exemplary embodiments.
Figure 1E:
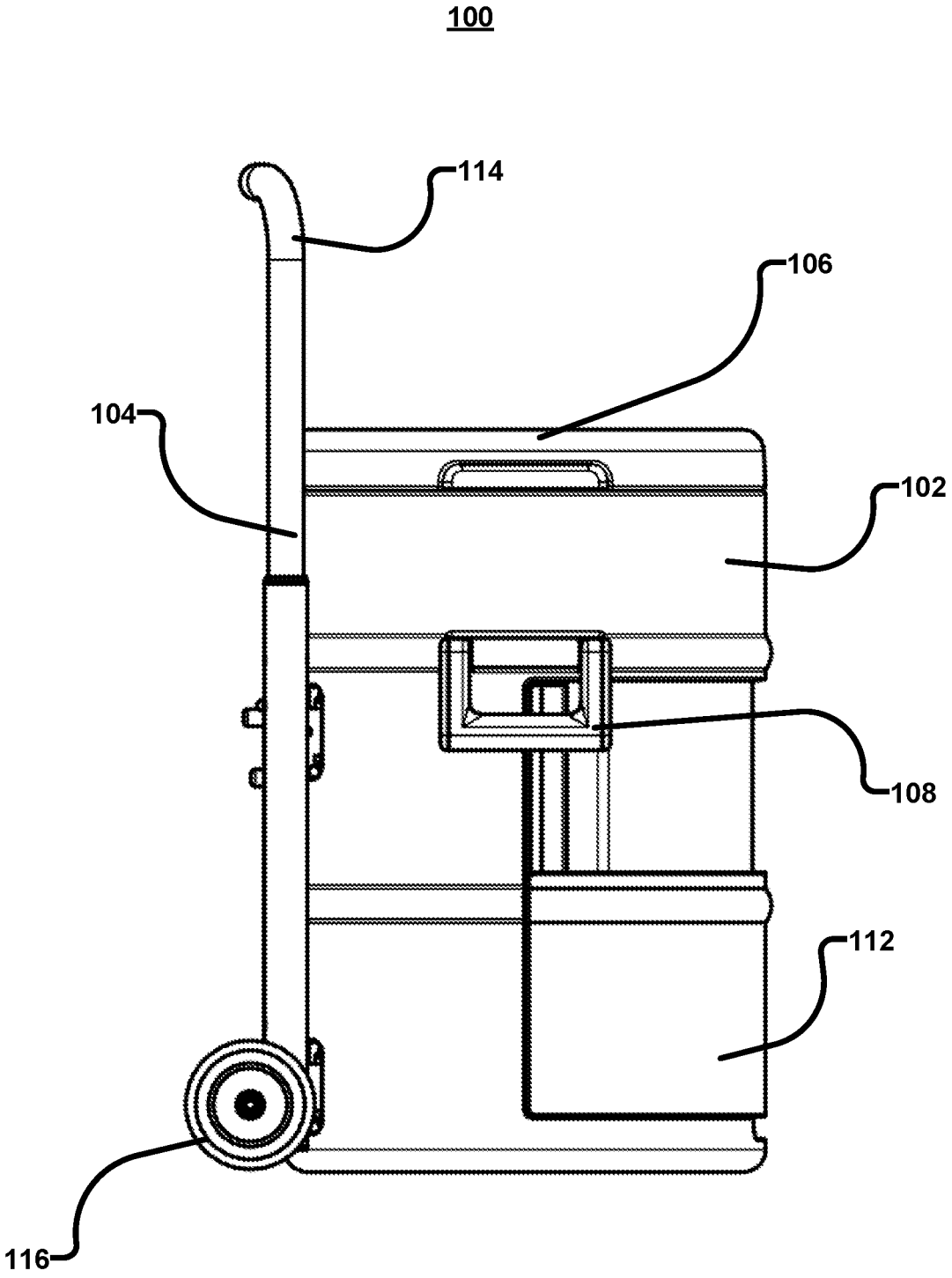
FIG. 1E is a left side view of the beverage dispenser according to exemplary embodiments.
Figure 1F:
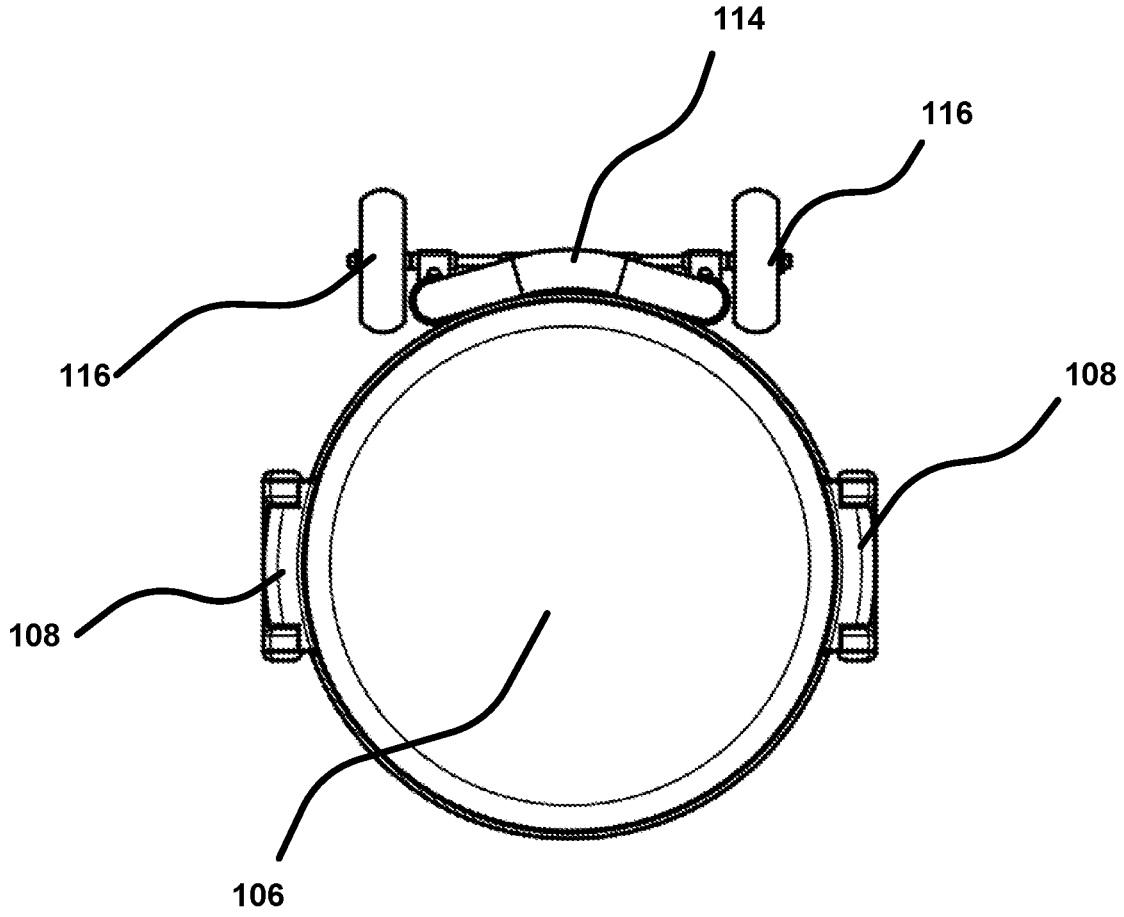
FIG. 1F is a top view of the beverage dispenser according to exemplary embodiments.
Figure 1G:
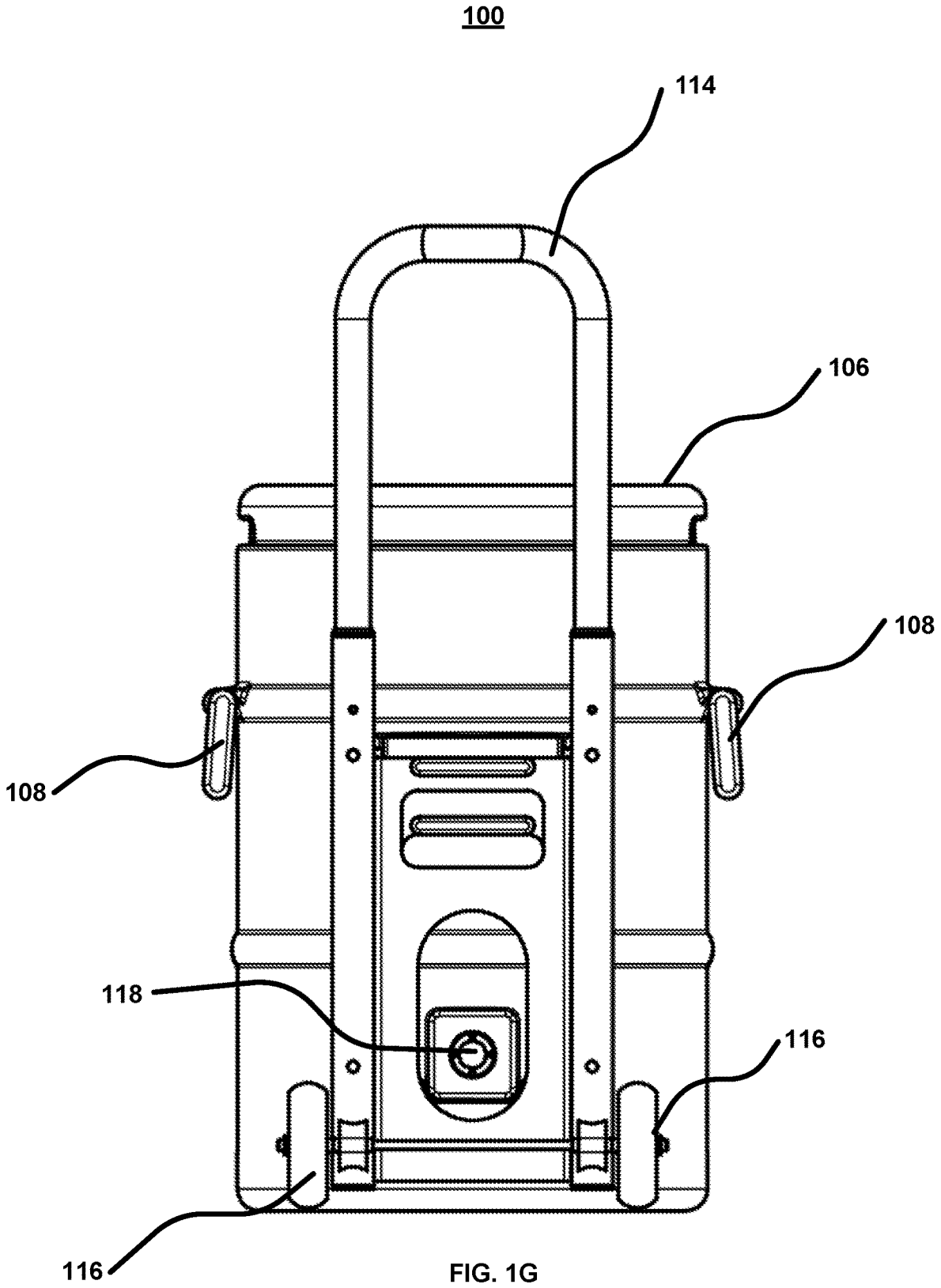
FIG. 1G is a rear view of the beverage dispenser according to exemplary embodiments.
Figure 2A:
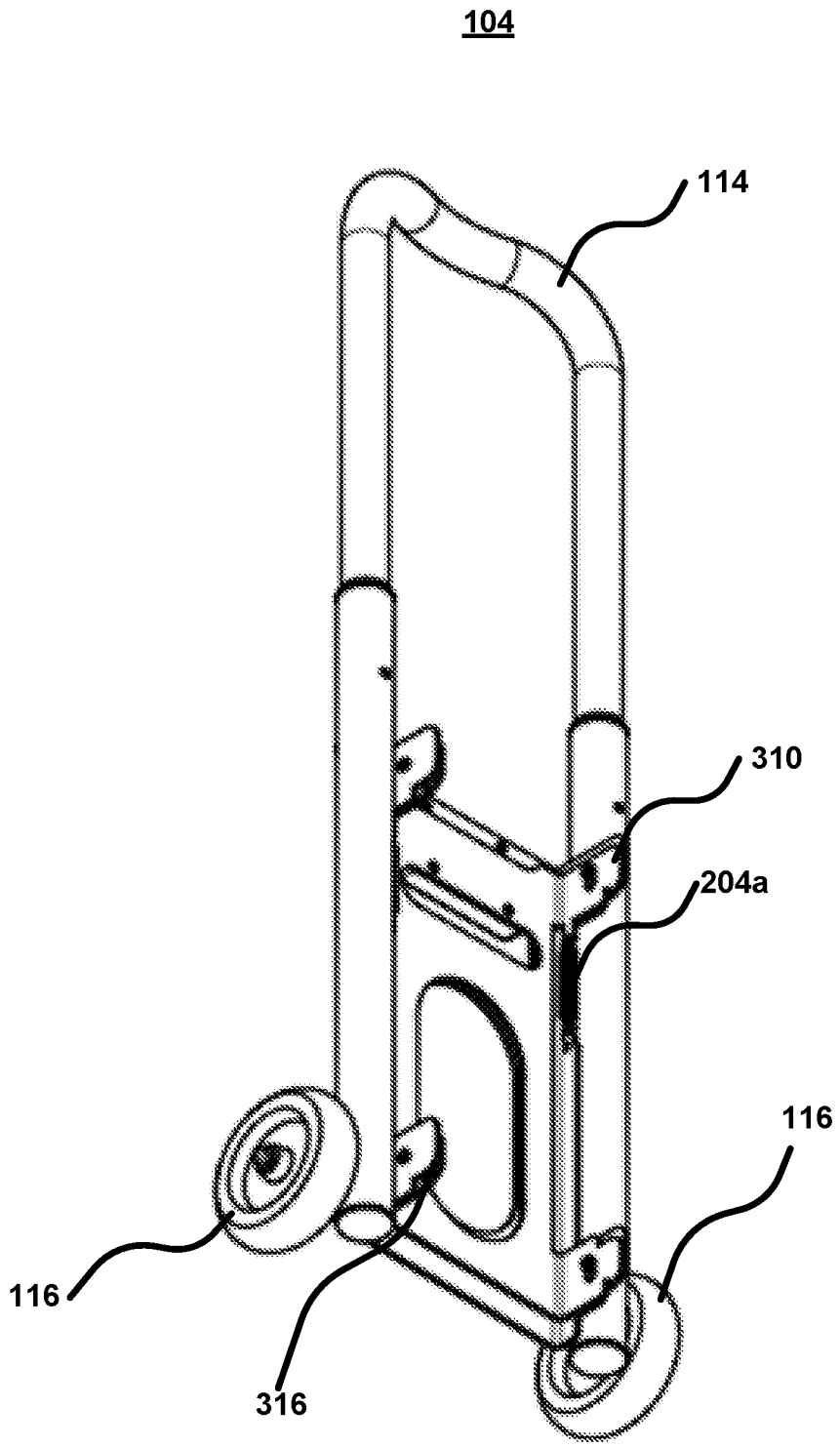
FIG. 2A is a bottom perspective view of a cart for a beverage dispenser according to exemplary embodiments.
Figure 2B:
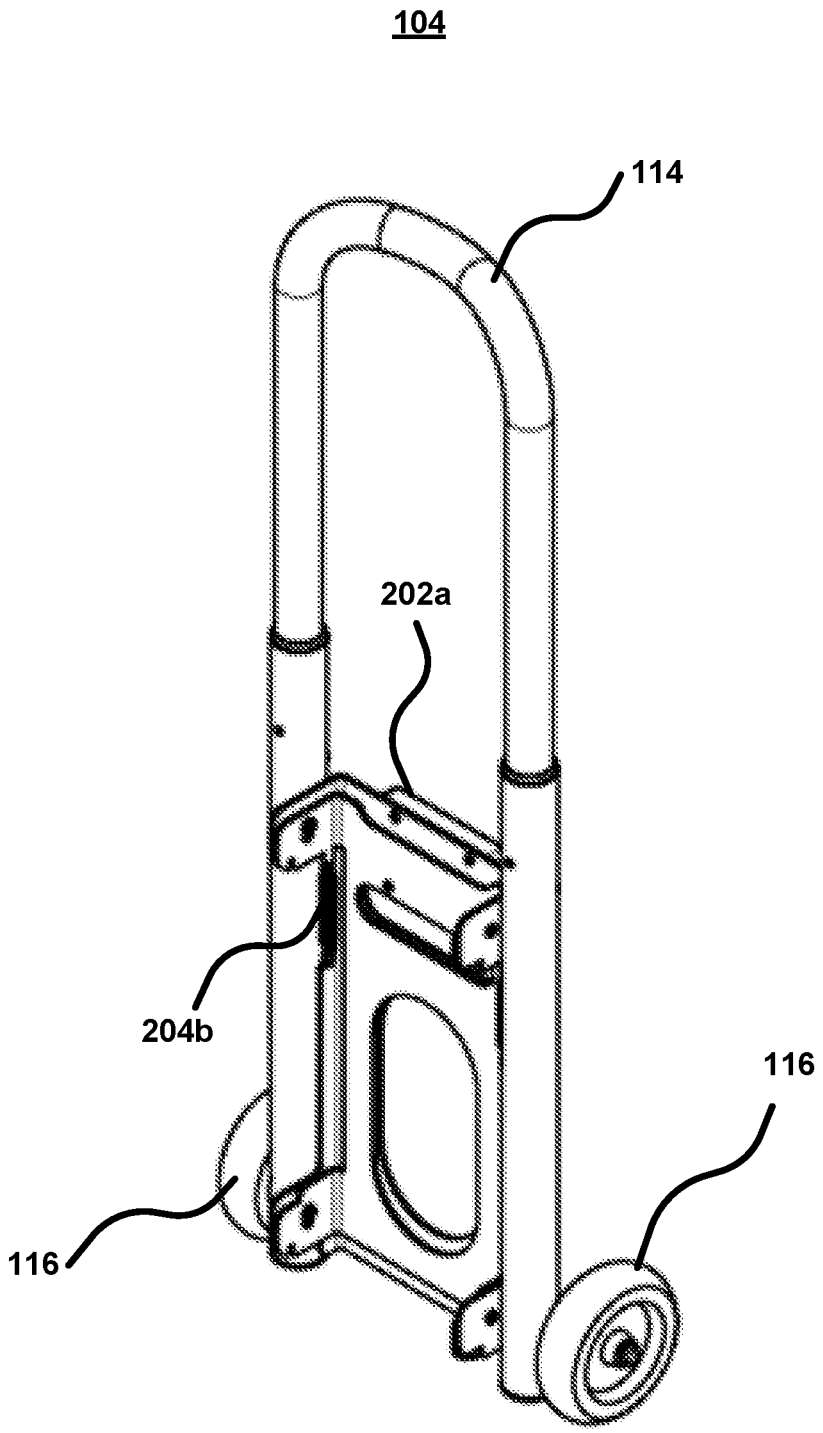
FIG. 2B is a top perspective view of the cart for a beverage dispenser according to exemplary embodiments.
Figure 2C:
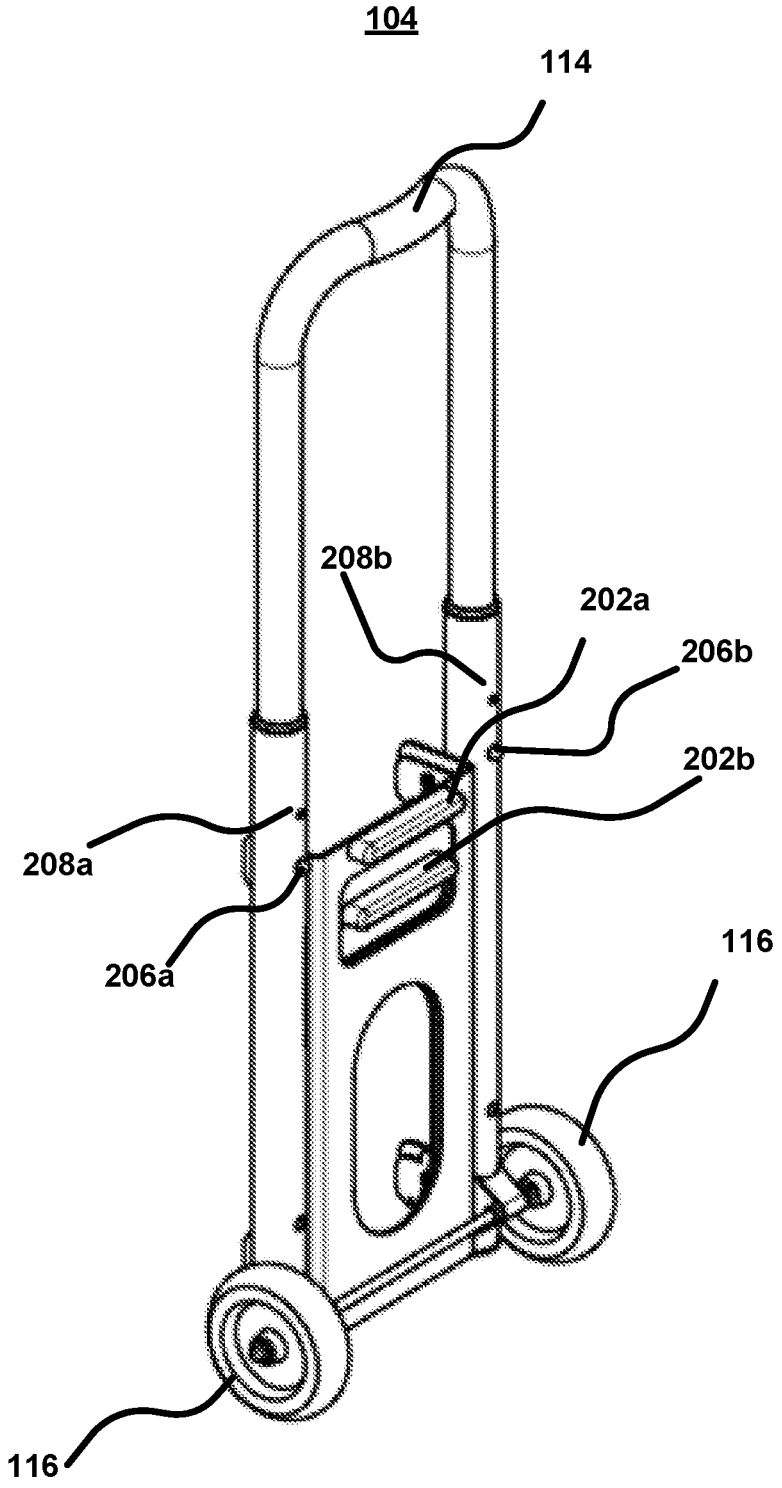
FIG. 2C is a rear perspective view of the cart for a beverage dispenser according to exemplary embodiments.
Figure 2D:
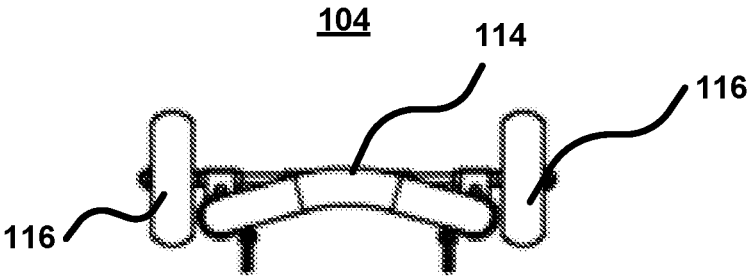
FIG. 2D is a top view of the cart for a beverage dispenser according to exemplary embodiments.
Figure 2E:
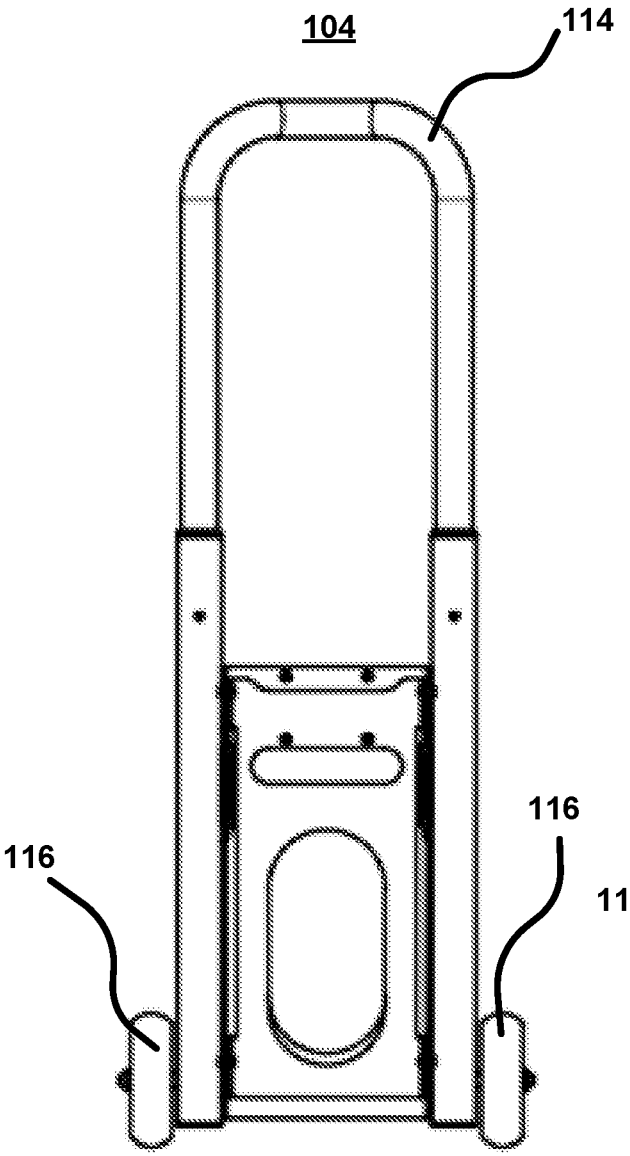
FIG. 2E is a rear view of the cart for a beverage dispenser according to exemplary embodiments.
Figure 2F:
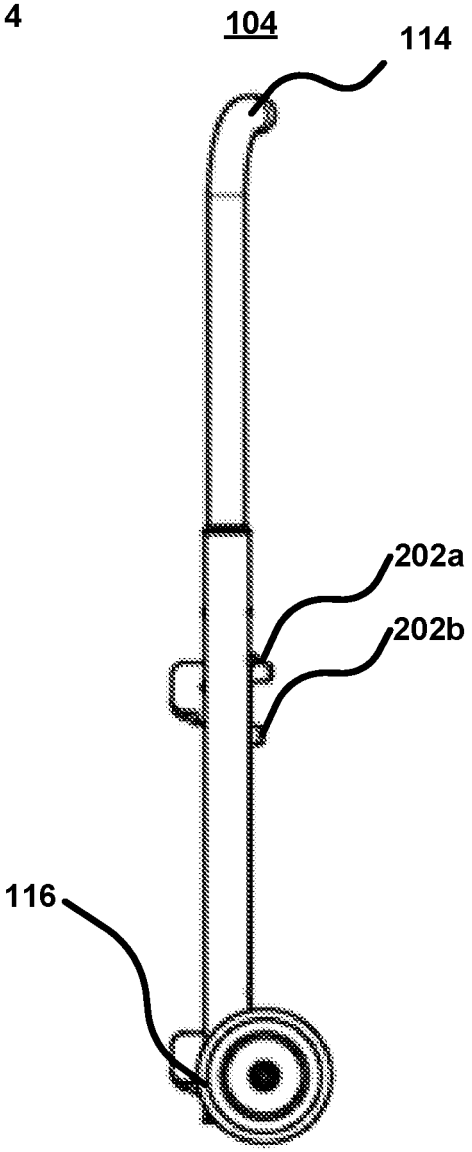
FIG. 2F is a side view of the cart for a beverage dispenser according to exemplary embodiments.

Located proximal a lower portion of the cooler portion 102 may be a beverage dispensing area 110. The beverage dispensing area may have an arced shape to match the curve of the cooler portion 102 as depicted in FIGS. 1A and 1B, for example. The beverage dispensing area 110 may occupy an arc that is approximately one-half of the circumference the cooler portion 102. The beverage dispensing area may be enclosed by a movable cover 112. In FIG. 1, this movable cover 112 is depicted in the closed or lowered position. The movable cover 112 may slide upwards (that is, towards the lid 106, to expose an inner portion of the beverage dispensing area 110 (as depicted and described herein). The beverage dispensing area may container an assembly to receive beverage containers inserted into the cooler portion 102 through one or more internal tubes (e.g., five tubes) and assist with dispensing of these beverage containers (e.g., through a can catcher assembly). The movable cover 112 may be transparent. In some embodiments, the movable cover 112 may be opaque. The movable cover 112 may be made of plastic or another suitable material.

The cart 104 may be removably coupled to the cooler portion 102. The cart 104 may be made of plastic, metal, and/or combinations thereof. The cart 104 may have a handle portion 114. The handle portion 114 may be telescoping. The cart 104 may have wheels 116. There may be two wheels 116 located on opposite sides of the cart 104. In FIG. 1A, for example, only one wheel 116 is shown because of the view perspective.

A drain plug 118 may be used to drain the interior volume of the cooler portion 102. The drain plug 118 may penetrate from the exterior shell through to the interior volume. The drain plug 118 may have a cap that may be openable or removable to allow for opening of the drain plug to allow for drainage of fluid from the interior volume.

Some embodiments of the apparatus 100 may lack the beverage dispensing area and the can catcher assembly. Beverage containers may be removed through the upper portion of internal tube assemblies. In various embodiments, the tubes may be mounted horizontally. This configuration would alter the structure of the apparatus 100 to facilitate this orientation as appreciated by one of ordinary skill in the art.

FIGS. 2A, 2B, 2C, 2D, 2E, and 2F (collectively, FIG. 2) depict the cart 104 (or, caddy) according to exemplary embodiments. The cart 104 may have a handle portion 114. In exemplary embodiments, the handle portion 114 may be extendable or telescoping. For example, the handle portion 114 may be adjusted in height by depressing a button (206*a* and 206*b*) on each side of the frame and raising the handle such that the button (206*a* and 206*b*) engages with another set of holes (208*a* and 208*b*) in the frame at a higher level (it should be appreciated that the reverse operation can be performed to lower the handle). The rear side of the cart 104 may have a set of bars 202*a* and 202*b*. The bar 202*b* (the lower of the two bars) may be squeezed upwards (towards 202*a*, which may be fixed) to pull in, using springs 204*a* and 204*b* (collectively, spring 204), a latching mechanism (310 and 316) that is configured to mate with the cooler portion (such as cooler portion 102 of FIG. 1). Note that the spring 204 is located on both sides of the cart. For example, in FIG. 2A, only one spring 204*a* may be visible and in FIG. 2B, the other spring 204*b* may be visible. Spring 204 couples the latching mechanisms 310 and 316, as best depicted in FIGS. 3E and 3F. The bar 202*b* may cause a frame portion 318 to slide upwards, stretching the spring 204

Figure 3A:
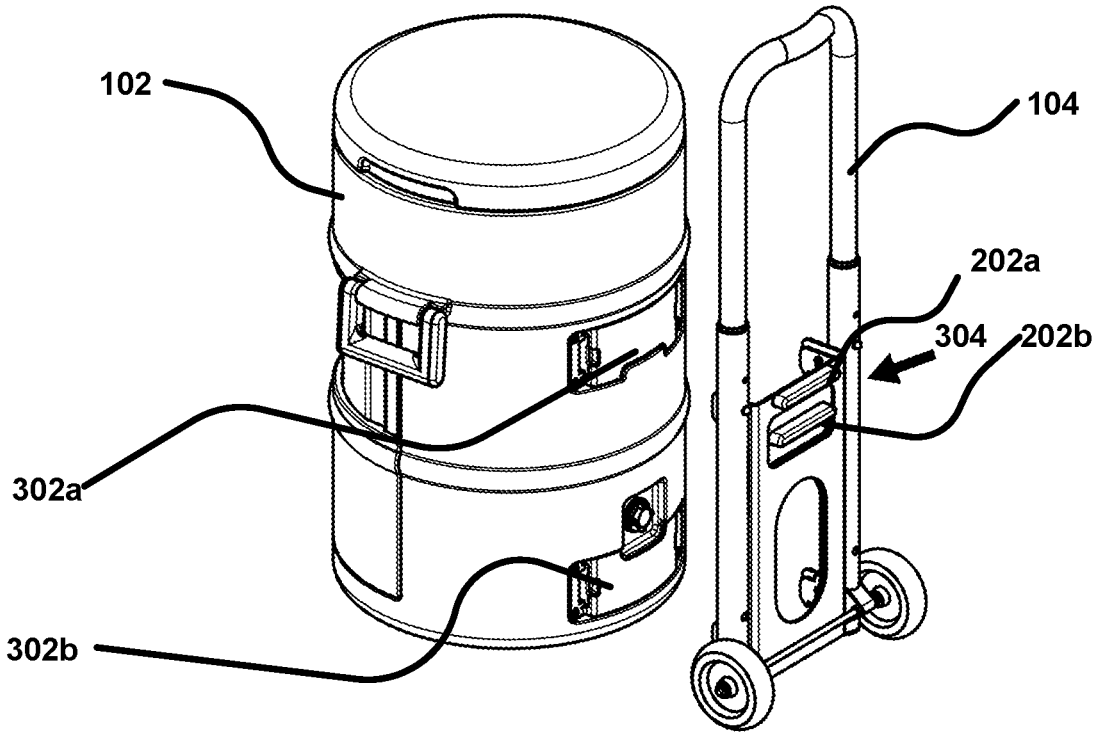
FIG. 3A is rear perspective view of a first step in attaching the cart to the beverage dispenser according to exemplary embodiments.
Figure 3B:
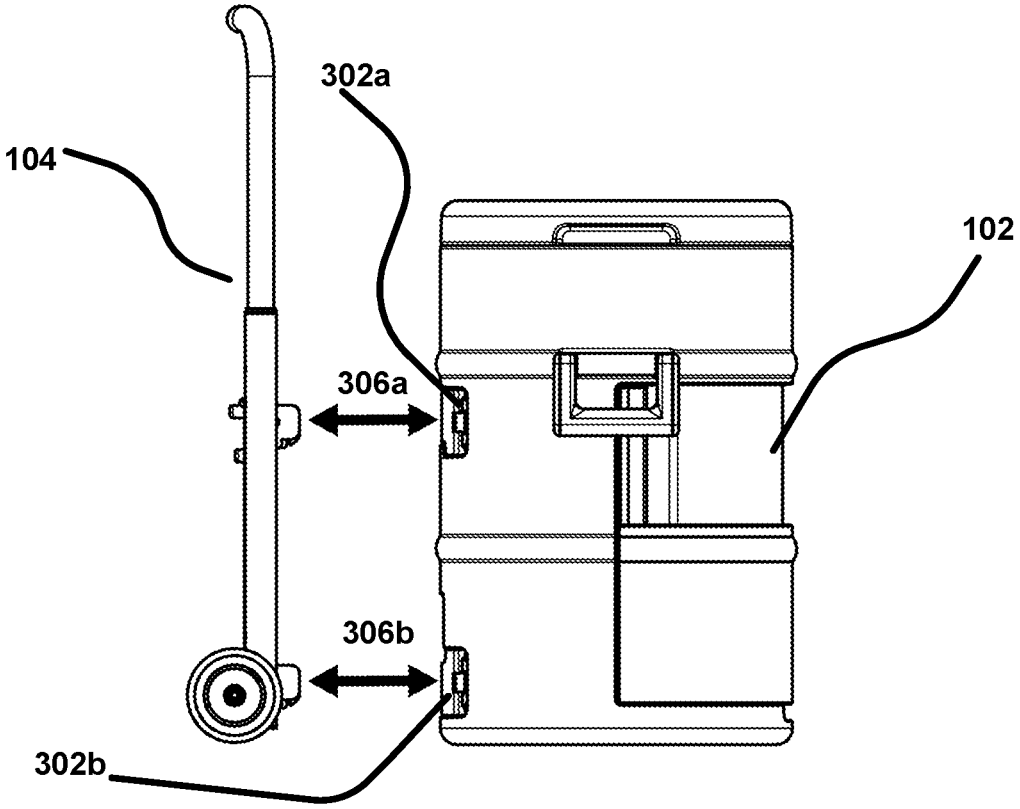
FIG. 3B is a side view of a second step in attaching the cart to the beverage dispenser according to exemplary embodiments.
Figure 3D:
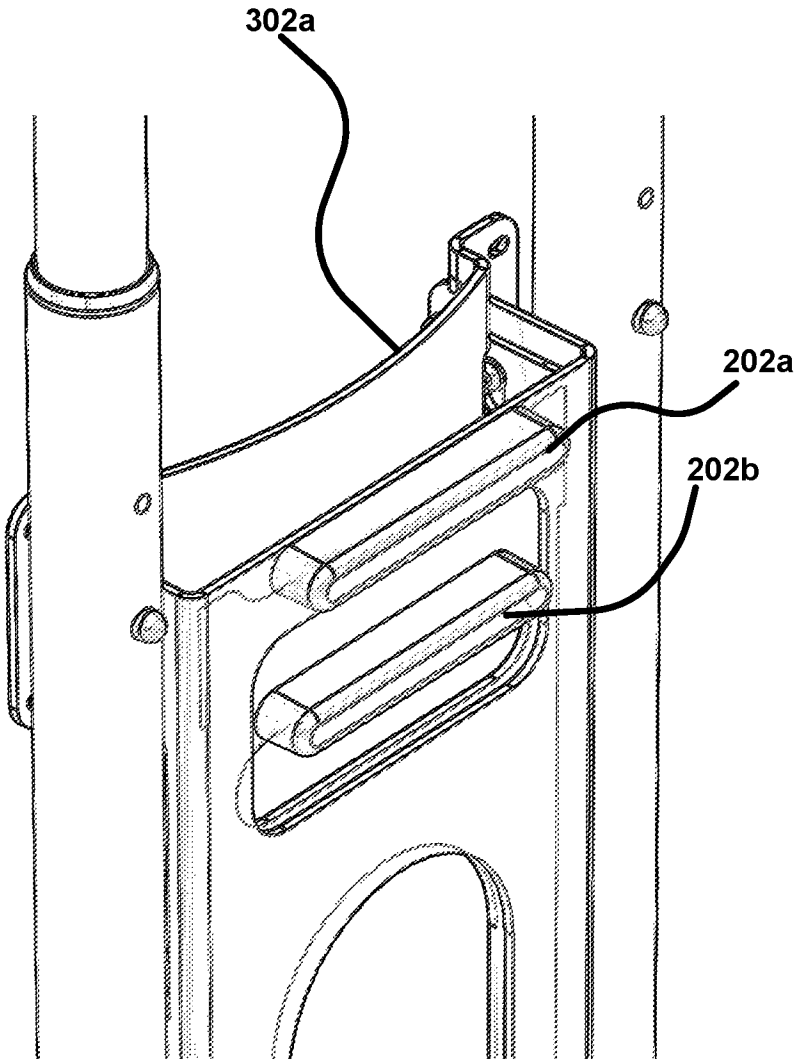
FIG. 3D is a second view of the attachment mechanism of the cart according to exemplary embodiments.

FIGS. 3A and 3B depict the cart 104 removed from the cooler portion 102. FIGS. 3C, 3D, 3E, and 3F depict the securement mechanism and actuation. All of these figures are collectively, FIG. 3.

Figure 3C:
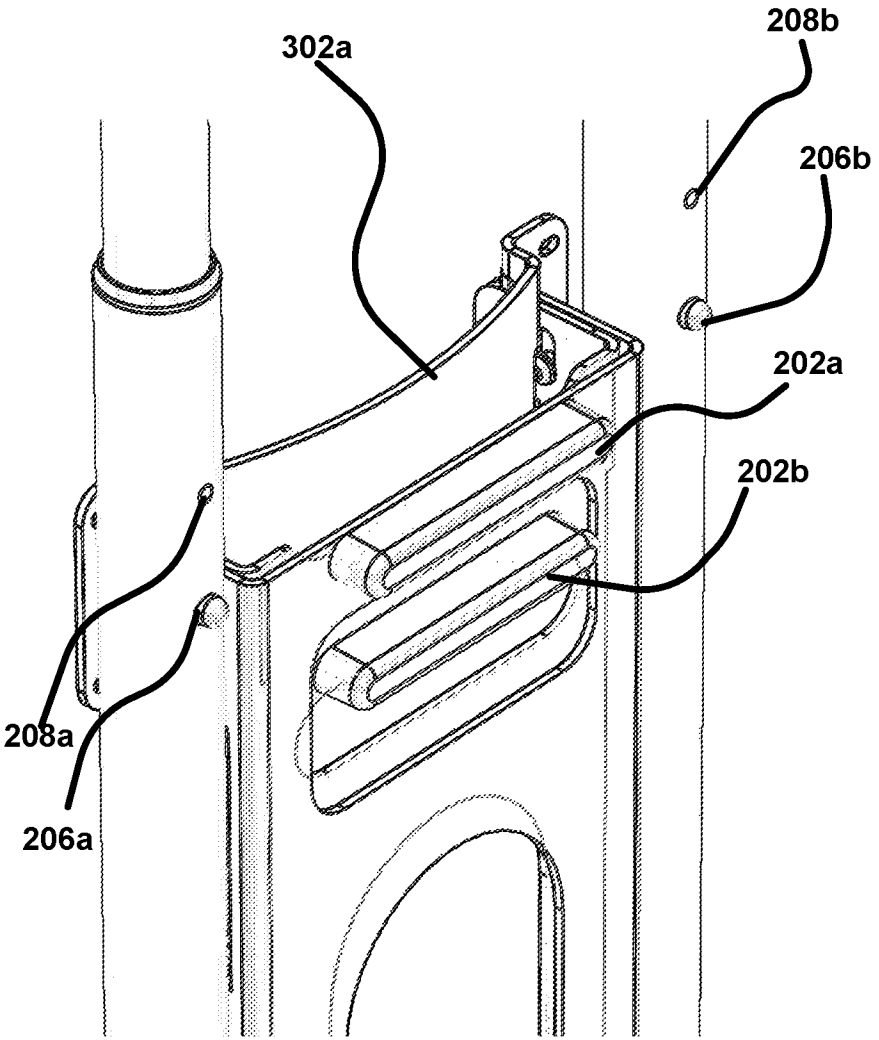
FIG. 3C is a first view of the attachment mechanism of the cart according to exemplary embodiments.
Figure 3F:
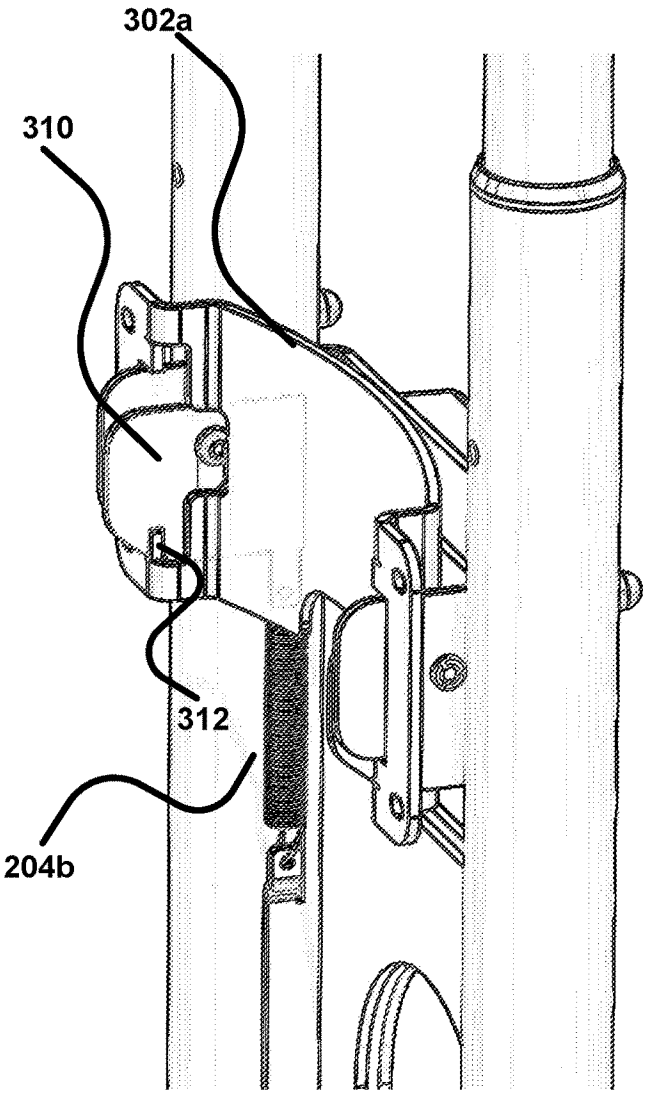
FIG. 3F is a fourth view of the attachment mechanism of the cart according to exemplary embodiments.
Figure 3E:
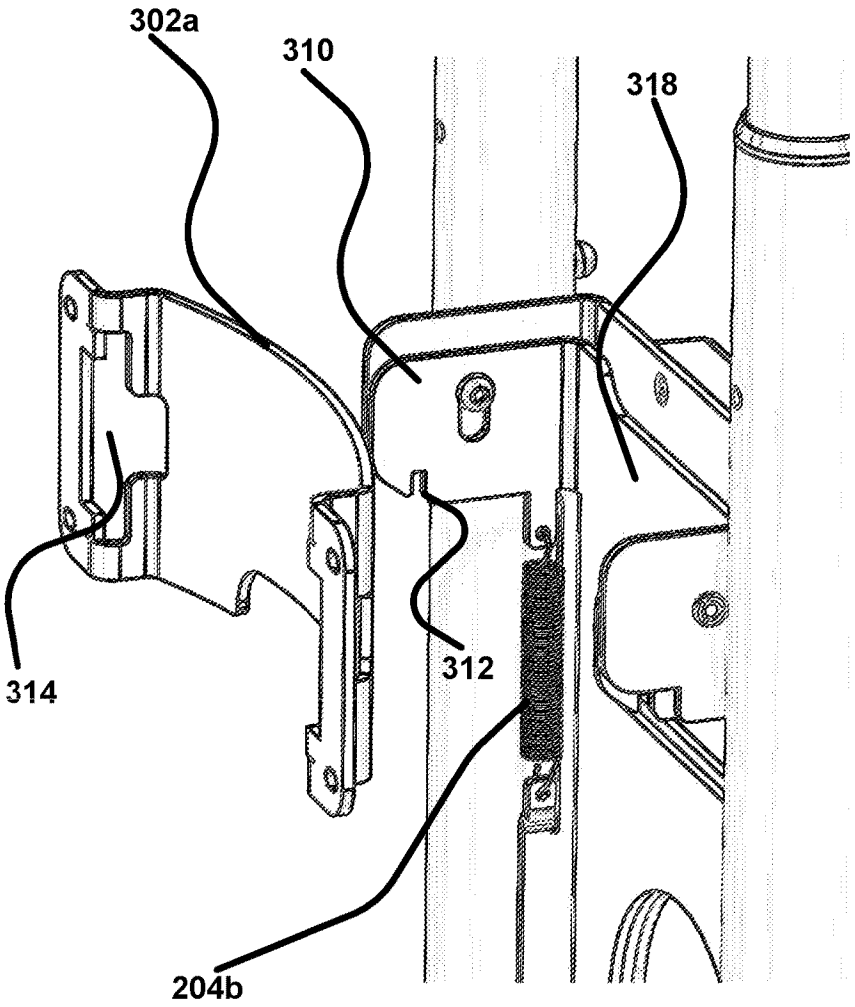
FIG. 3E is a third view of the attachment mechanism of the cart according to exemplary embodiments.

According to exemplary embodiments, operation of the cart to attach to the cooler portion may be as follows:

STEP ONE—the two bars (202*a* and 202*b*), indicated at the arrow 304, may be pushed together to add spring tension (specifically, the lower bar 202*b* is pushed upwards to 202*a*) and lift up a latching mechanism 310 and 316 by moving upwards the frame portion 318; this position is depicted in FIG. 3C; FIG. 3E shows the reverse side, prior to actuation; the latching mechanism 310 may have tooth or hooked portion 312 that is configured to mate with a lip or cut-out 314 in the plate portion 302*a;*

STEP TWO—the cart 104, or caddy, may be slid into place adjacent to cooler portion 102 in the direction of the arrows 306*a* and 306*b* (the arrows indicate the alignment of the latching mechanisms on the cart 104 with the plates 302*a* and 302*b* on the rear of the cooler portion); and STEP THREE—the two bars (202*a* and 202*b*) may be released which allows spring tension to lower the latching mechanism to clamp onto plates attached to cooler and secure the cart 104 to the cooler portion (such as depicted in FIG. 1); this position is depicted in FIG. 3D and from the reverse side in FIG. 3F (note: in FIGS. 3C, 3D, 3E and 3F, the plate portion 302*a* (i.e., the upper of the two plates) is depicted removed for the cooler portion and shown to depict the engagement process). The engagement with the lower plate 302*b* is the same as a similar latching mechanism 316 on lower portion of the cart engages with that plate and is actuated in the same matter as the latching mechanism 310 depicted in FIGS. 3E and 3F; both are coupled to spring 204.

Figure 4A:
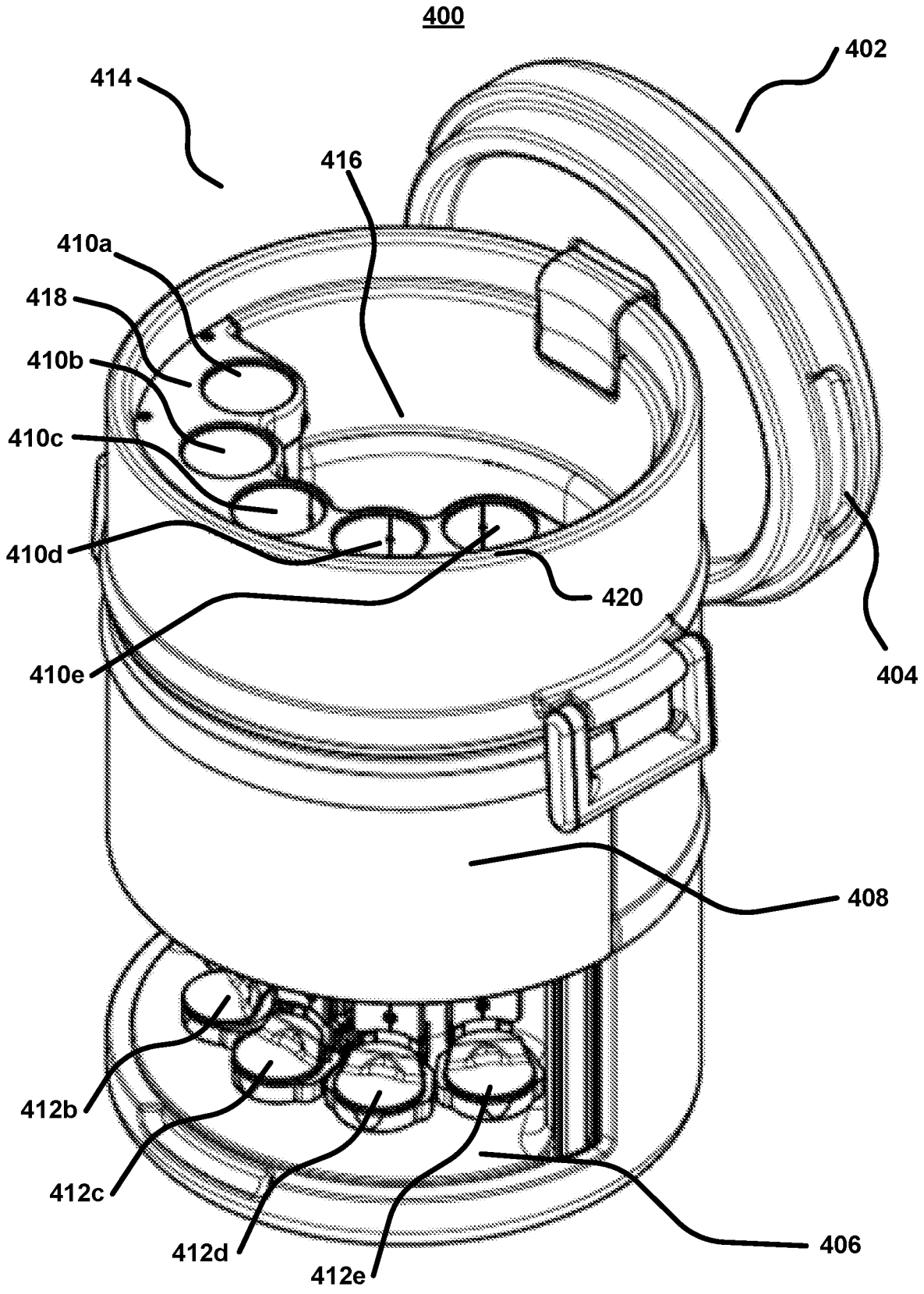
FIG. 4A is a top perspective view of a beverage dispenser with a lid in an open position and a beverage dispensing area in an open position according to exemplary embodiments.
Figure 4B:
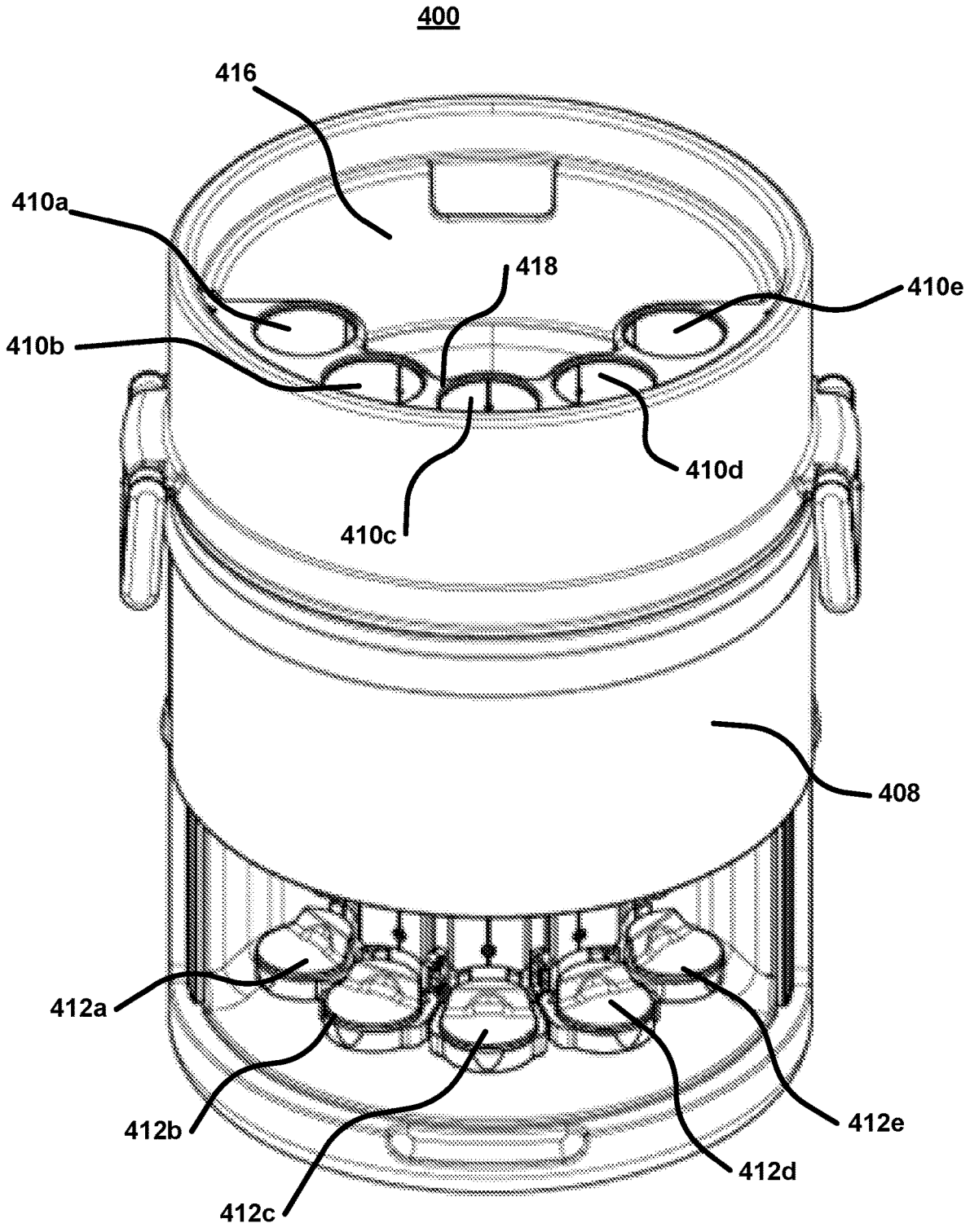
FIG. 4B is a top front perspective view of the beverage dispenser with the lid removed and the beverage dispensing area in an open position according to exemplary embodiments.

FIGS. 4A, 4B, 4C, 4D, 4E, 4F, 4G, and 4H (collectively, FIG. 4) depict a beverage dispenser 400 according to exemplary embodiments. The beverage dispenser 400 may be similar to or the same as the cooler portion 102 described above with respect to FIG. 1, for example. The beverage dispenser 400 is depicted in FIG. 4 (such as FIG. 4A) with a lid 402 in an open position, exposing the interior of the beverage dispenser 400. In FIGS. 4B through 4H, the lid is not shown for clarity. The lid 402 may be removable and, when removed, may no longer be attached to the beverage dispenser 400. In various embodiments, the lid 402 may have a strap or other attachment mechanism (not shown) such that when opened, the lid 402 may remain attached to the beverage dispenser 400. In FIG. 4A, the lid 402 is depicted in an open position and located to the rear of the beverage dispenser, in a position in which a user may hold the lid while accessing the interior of the beverage dispenser 400. The lid 402 may have a recessed portion 404 that may serve as a handle or leverage point to handle the lid 402 to enable it to be removed (a complementary recess portion may be located on the opposite of the lid 402, which is not visible in FIG. 4A). The lid 402 may seat within the beverage dispenser 400 to create a seal to prevent or limit temperature escape from the interior to the atmosphere. Thus, to remove (and seat) the lid 402, a user may be required to apply an amount of force either in a upward direction (to remove) or in a downward directed (to seat).

Also, in FIG. 4 (such as FIG. 4A), a beverage dispensing area 406 is shown in an open position. The beverage dispensing area 406 may have a slidable partition or cover that may be raised and lowered by a user to alternately uncover or cover the beverage dispensing area In various embodiments, the cover may slide upward into the outer shell 408. In some embodiments, the cover may slide to the left or right into the outer shell 408.

The outer shell 408 may surround and contain an interior volume 414. Within that interior volume, located proximal a front portion of the beverage dispenser 400, may be an series of tubes 410 (410*a*, 410*b*, 410*c*, 410*d*, 410*e*) (collectively, 410) with a can catcher assembly 412 (412*a*, 412*b*, 412*c*, 412*d*, 412*e*) (collectively, 412). The can catcher assembly 412 is described below. It should be appreciated, that, while five tubes 410 are depicted, various embodiments may have more or less tubes. Further, the can catcher assembly 412 is depicted here in its lowered position (e.g., the position it would be in when loaded with one or more beverage containers, for illustrative purposes).

Directly behind the tubes 410, may be a open volume 416. The tubes 410 may be secured to the outer shell 408 by an upper bracket 418.

Each tube 410 may be cylindrical in shape and sized to accommodate one or more beverage containers, such as, a typical 12 oz. can (based on the size of such in the United States) (beverage containers are not shown in FIG. 4 while FIG. 5 depicts beverage containers in the tubes). For example, in exemplary embodiments, a typical 12 oz. can referred to herein is a traditional US 12 oz. beer or soda can. According to exemplary embodiments, each tube 410 may have an inside diameter that is slightly larger than the diameter of a standard (United States) 12 oz. beverage can. For example, the tube inner radius may be 36.58 mm, resulting in an inner diameter of 73.16 mm and the outer radius of a typical 12 oz. can, as described herein, may be 33.02 mm (outer diameter of 66.04 mm). This allows for a can to be inserted into a tube 410 (such as 410*a*) through the upper opening and have sufficient space between the outer edge of the can cylinder and the inner edge of the tube cylinder. Each tube 410 may hold or contain up to four 12 oz. beverage cans. It should be appreciated that various embodiments may hold more or less beverage containers. The slightly larger diameter (than the can diameter) allows for air to escape as the can moves downward but still provide an air cushion to assist with braking the can during its downward descent. The air cushion is created because the lower end of the tube is plugged or sealed, at least in part by forming a partial seal, by either the can catcher assembly in the raised position or by one or more beverage cans. The lower cylindrical end of each tube (which is proximate 424 in FIG. 4C, for example, and is above the tongue portion 426) may be plugged or sealed with the puck portion of the can catcher assembly 412, when the can catcher assembly is in the unloaded or raised position (that is, beverage container(s) is/are not present in the tube). It should be appreciated that the seal is not "perfect" given that there may be some air gap between the puck portion given tolerances between the different parts. However, the seal or plug does not need to be perfect to create the air cushion as described herein. The seal or plug assists in creating the air cushion to slow the descent of a beverage can inserted and dropped into a tube. Once a beverage container (e.g., a can) contacts the can catcher, the weight of the container may cause the can catcher assembly to lower to a second position that is lower than the neutral position. This first can in the tube, or one that is resting on the can catcher assembly, may then provide the seal or plug in the tube to assist in creating the air cushion for the next beverage can, and so on as additional beverage cans may be added to a given tube. In various embodiments, the tube diameter may be more or less to accommodate different sized beverage containers, such as, for example, smaller diameter 12 oz., but taller in height, cans or 8 oz. cans having a smaller diameter and shorter height or larger diameter cans with a taller height, such as, for example, 16 oz. cans. A mix of different tube diameters may be used in a beverage dispenser to provide flexibility on the types of beverage containers that may be used with the device. Further, the dimensions of the tube inner diameter may be changed to accommodate can defects since there may be manufacturing variations. In various embodiments, the tubes may be individually removable to allow for changing tubes to accommodate different can sizes. For example, embodiments may have one or more tubes that are of a different size than the rest to allow for a mixture of different beverage containers to be used. In some embodiments, individual tubes may be removable to allow for reconfiguration of the beverage dispenser.

Figure 4C:
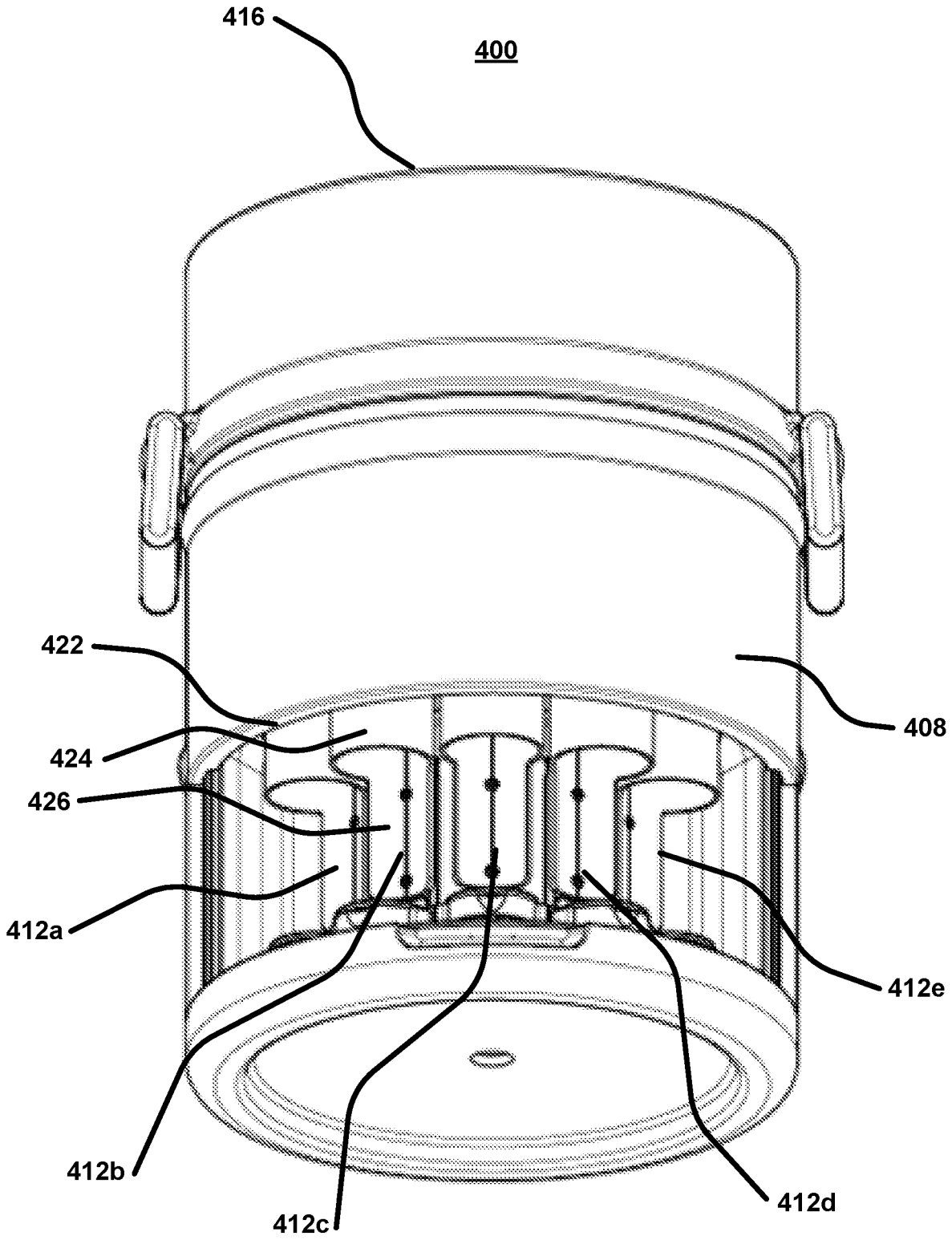
FIG. 4C is a bottom perspective view of the beverage dispenser with the lid removed and the beverage dispensing area in an open position according to exemplary embodiments.

The full cylindrical portion 424 of each tube 410 may extend from proximate an upper portion 420 of the beverage dispenser 400 to proximate an upper portion 422 of the beverage dispensing area. As shown in FIG. 4C, the lower end of the tube 410 may terminate just below 422. Each tube 410 may have a lower portion or tongue 426 that extends beyond the fully cylindrical portion of each tube to the can catcher 412. Note: in FIG. 4C, only one of 424 and 426 are labelled for ease of illustration. Each tube 410 has the same structure as can be seen in FIG. 4.

Figure 4D:
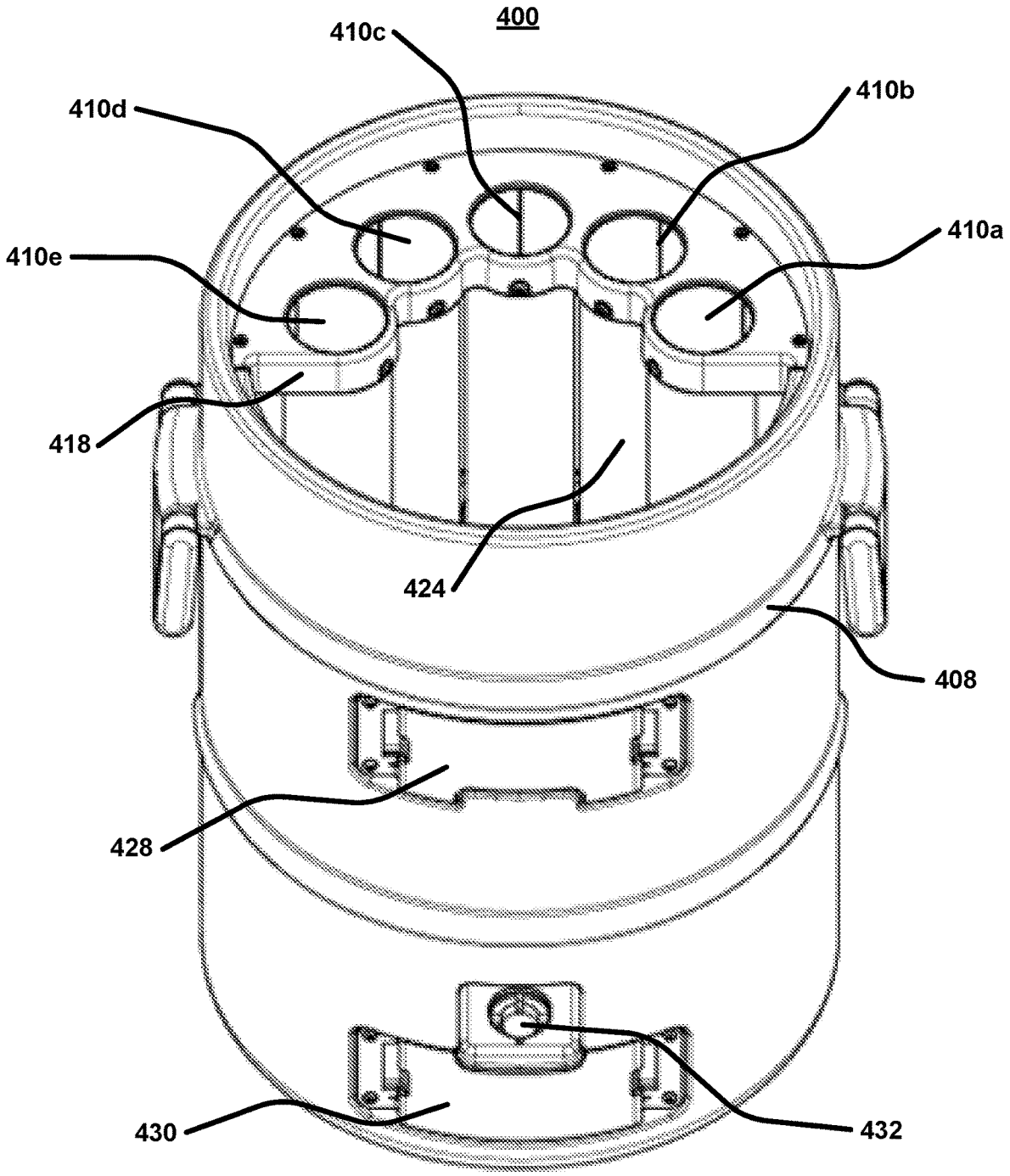
FIG. 4D is a top rear perspective view of the beverage dispenser with the lid removed and the beverage dispensing area in an open position according to exemplary embodiments.

As depicted in FIG. 4D, for example, the rear portion of the beverage dispenser 400 may have cut-outs 428 and 430, containing plates to mate with a detachable cart (not shown here but described above with respect to FIGS. 1, 2, and 3). A drain plug 432 may allow for drainage of the open volume 416. The drain plug 432 may be a removable cap that allows an interior pipe or tube 436 to drain any liquid from the open volume 416. The drain plug may snap on or be secured via threads.

Figure 4E:
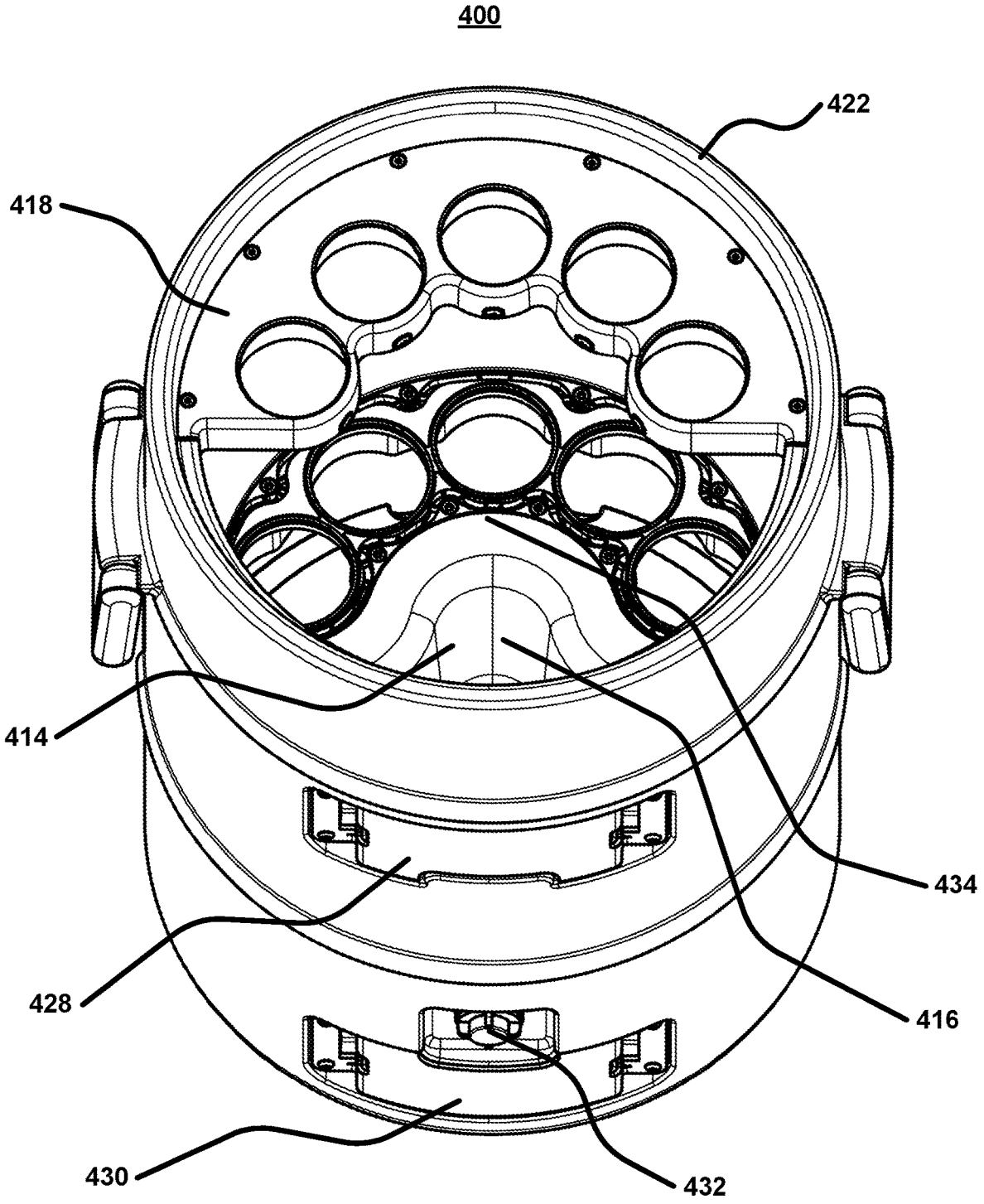
FIG. 4E is another top rear perspective view of the beverage dispenser with the lid removed and the beverage dispensing area in an open position and the tubes removed according to exemplary embodiments.
Figure 4F:
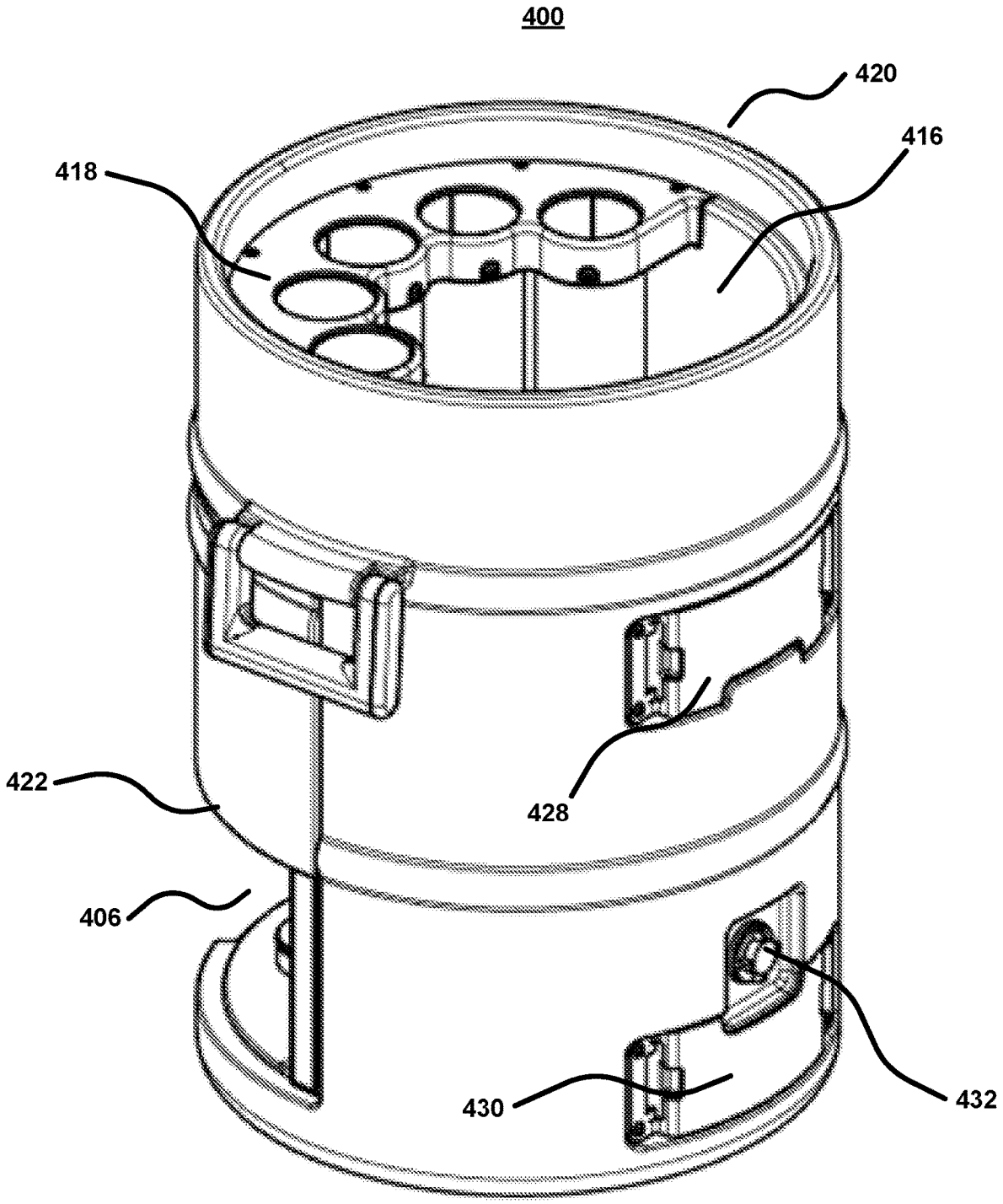
FIG. 4F is a rear side perspective view of the beverage dispenser with the lid removed and the beverage dispensing area in an open position according to exemplary embodiments.
Figure 4G:
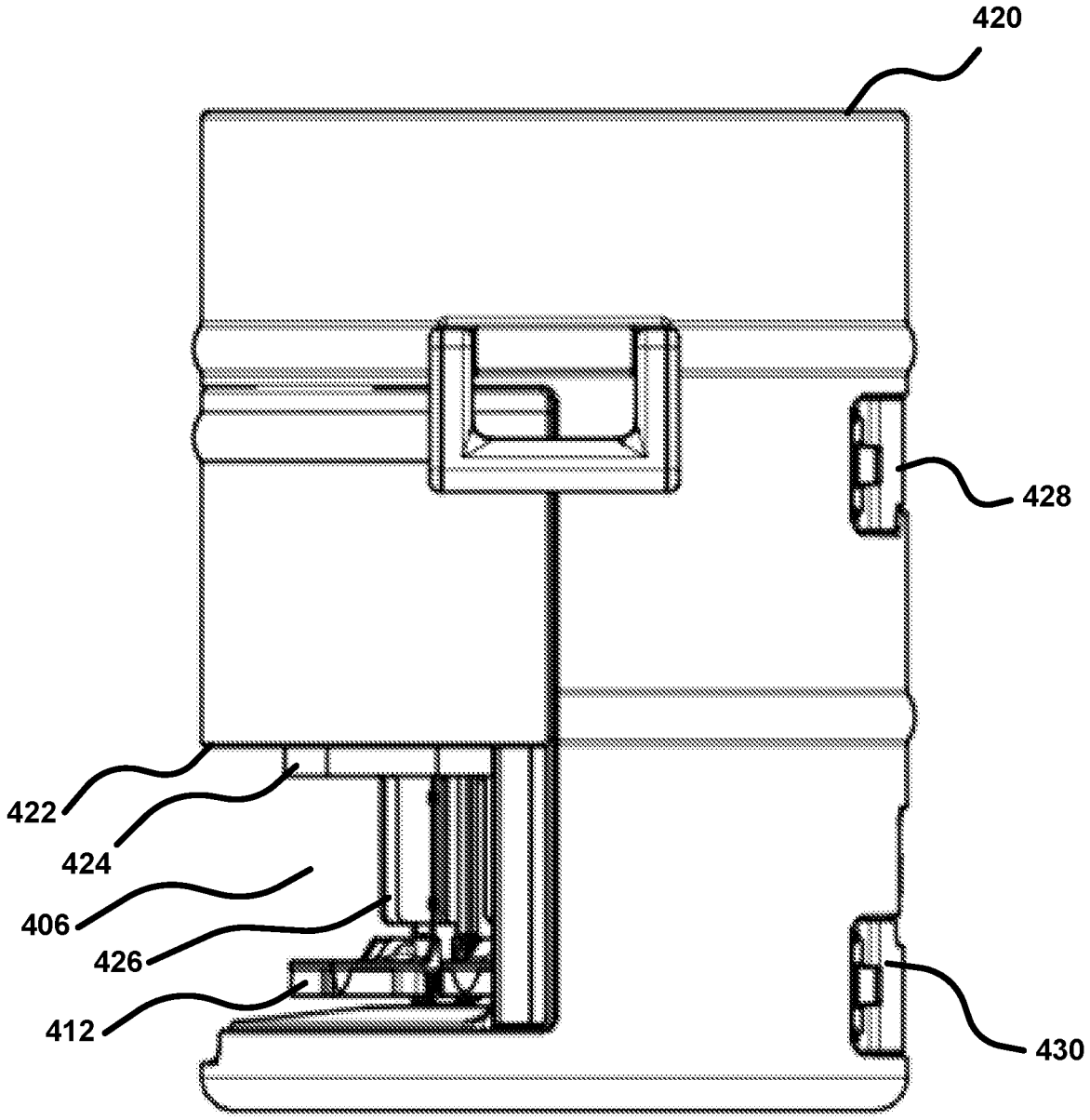
FIG. 4G is a side view of the beverage dispenser with the lid removed and the beverage dispensing area in an open position according to exemplary embodiments.
Figure 4H:
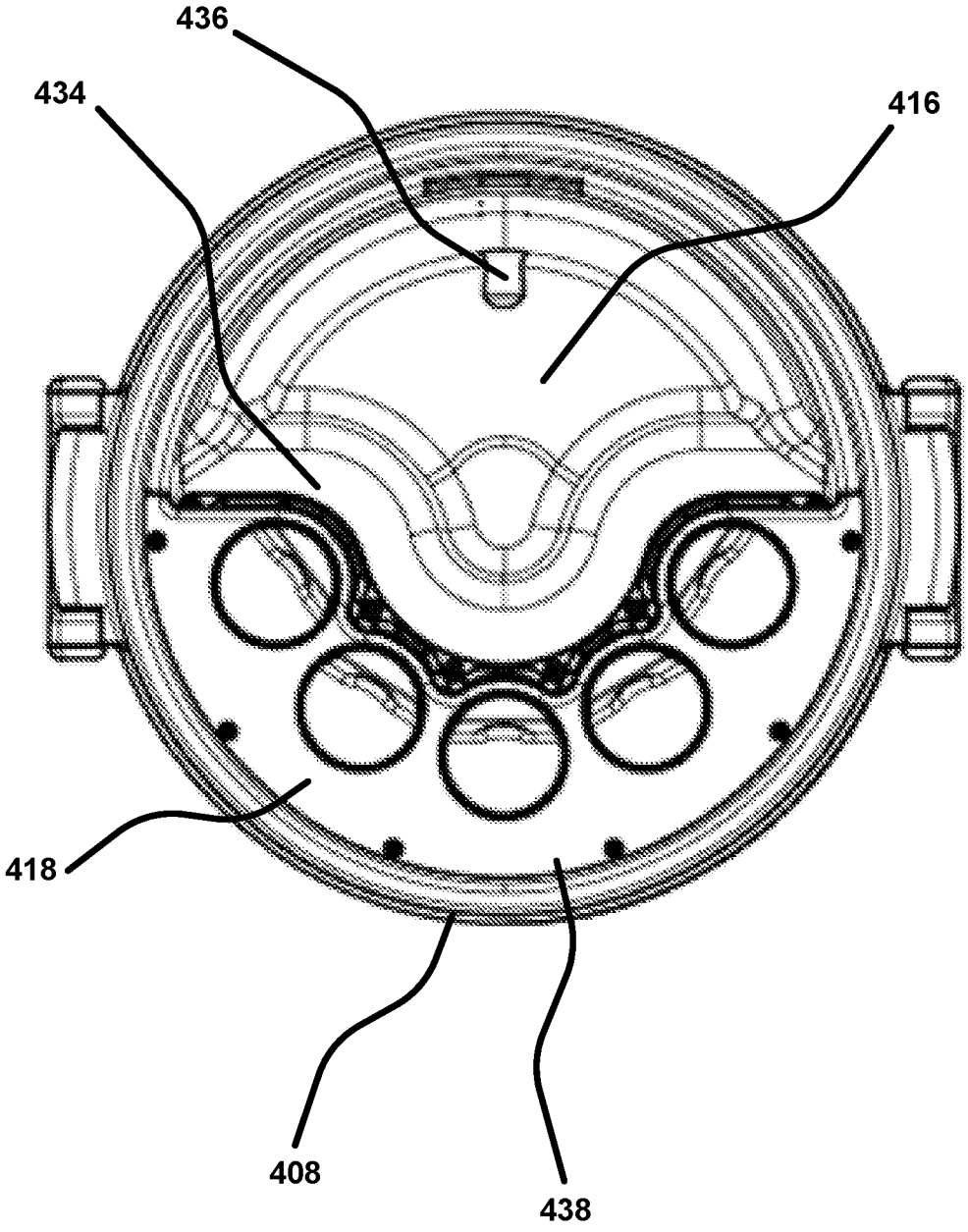
FIG. 4H is a top view of the beverage dispenser with the lid removed and the beverage dispensing area in an open position according to exemplary embodiments.
Figure 5A:
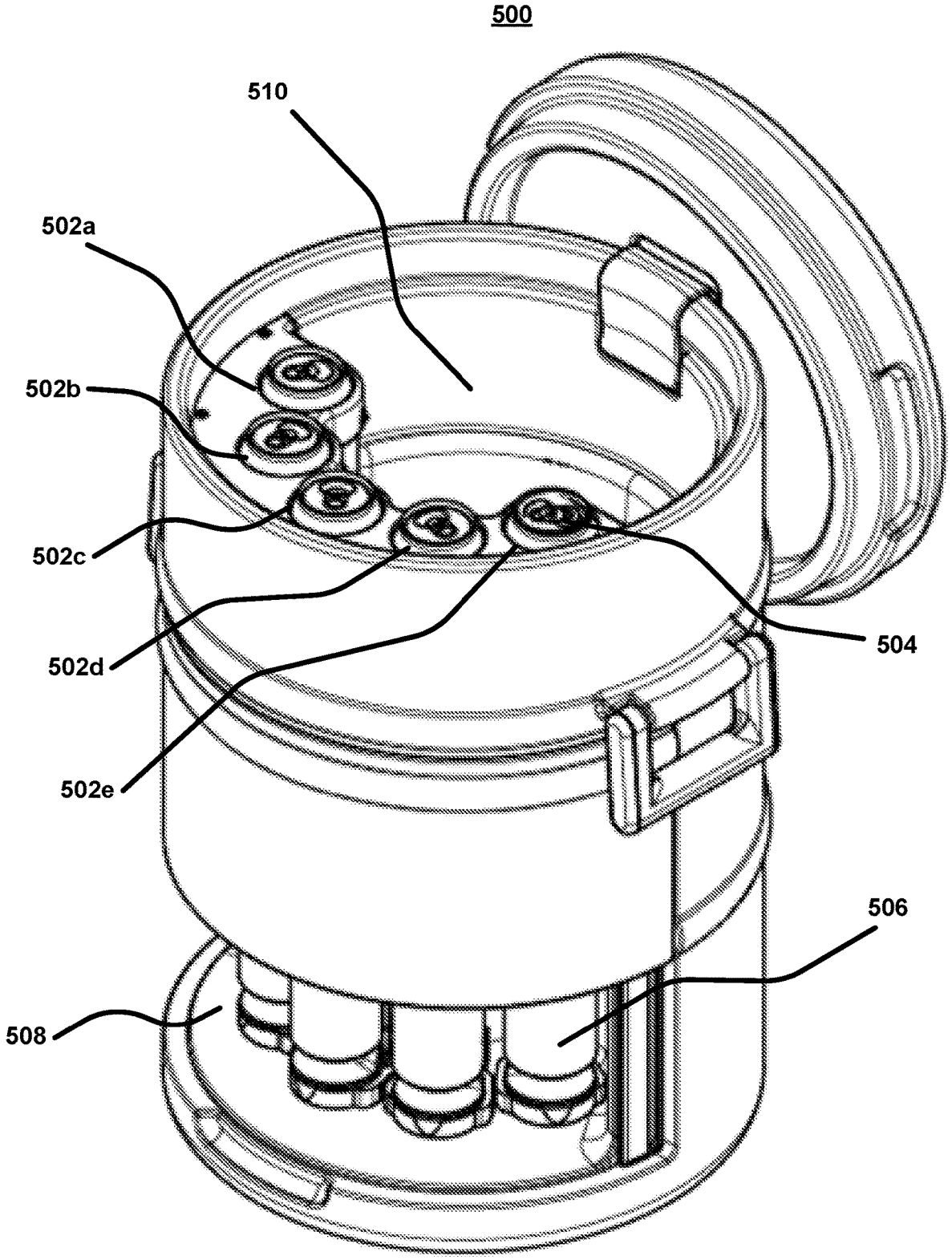
FIG. 5A is a top perspective view of a beverage dispenser, containing beverage containers, with a lid in an open position and a beverage dispensing area in an open position and containing beverage containers according to exemplary embodiments.
Figure 5B:
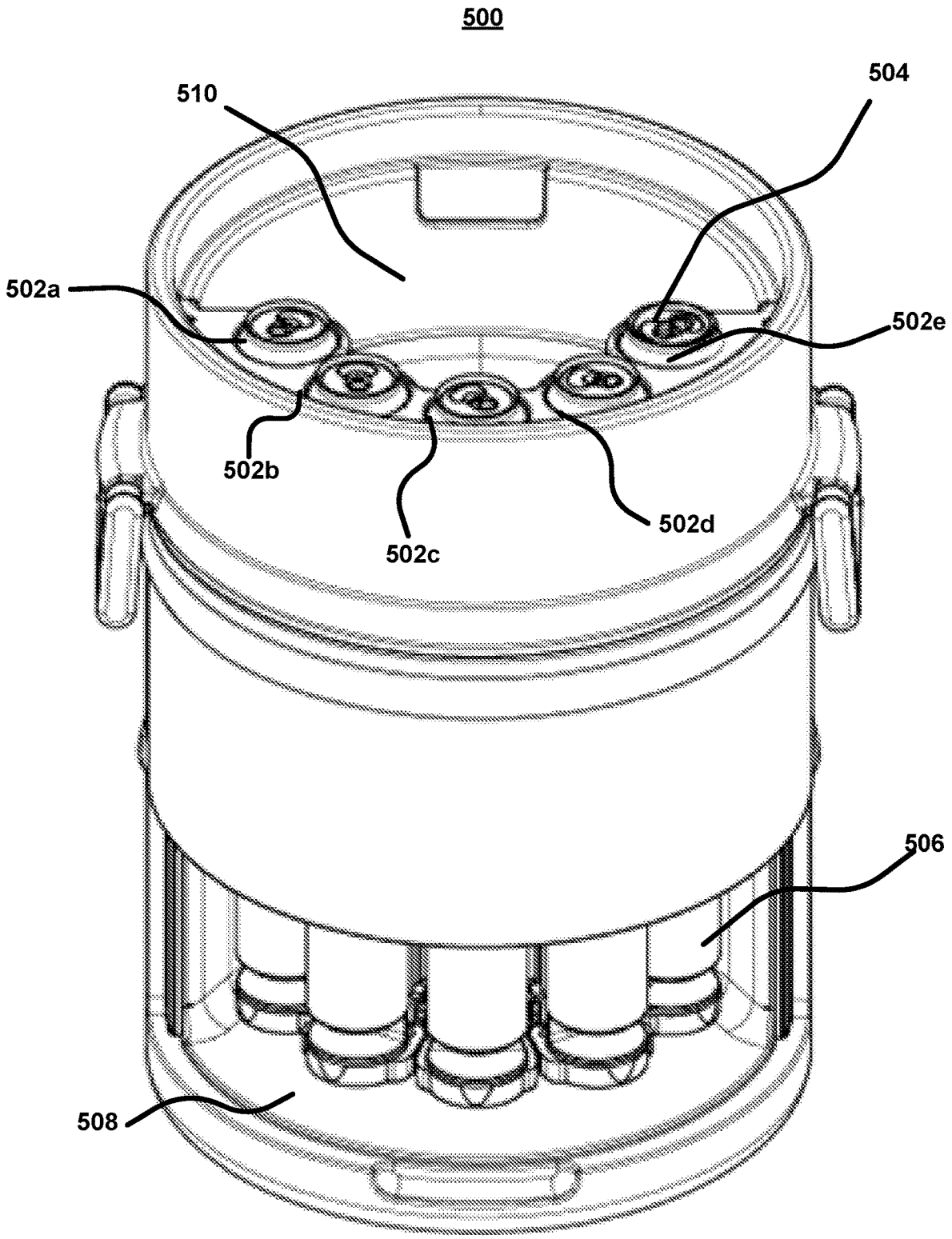
FIG. 5B is a top front perspective view of the beverage dispenser, containing beverage containers, with the lid removed and the beverage dispensing area in an open position according to exemplary embodiments.
Figure 5C:
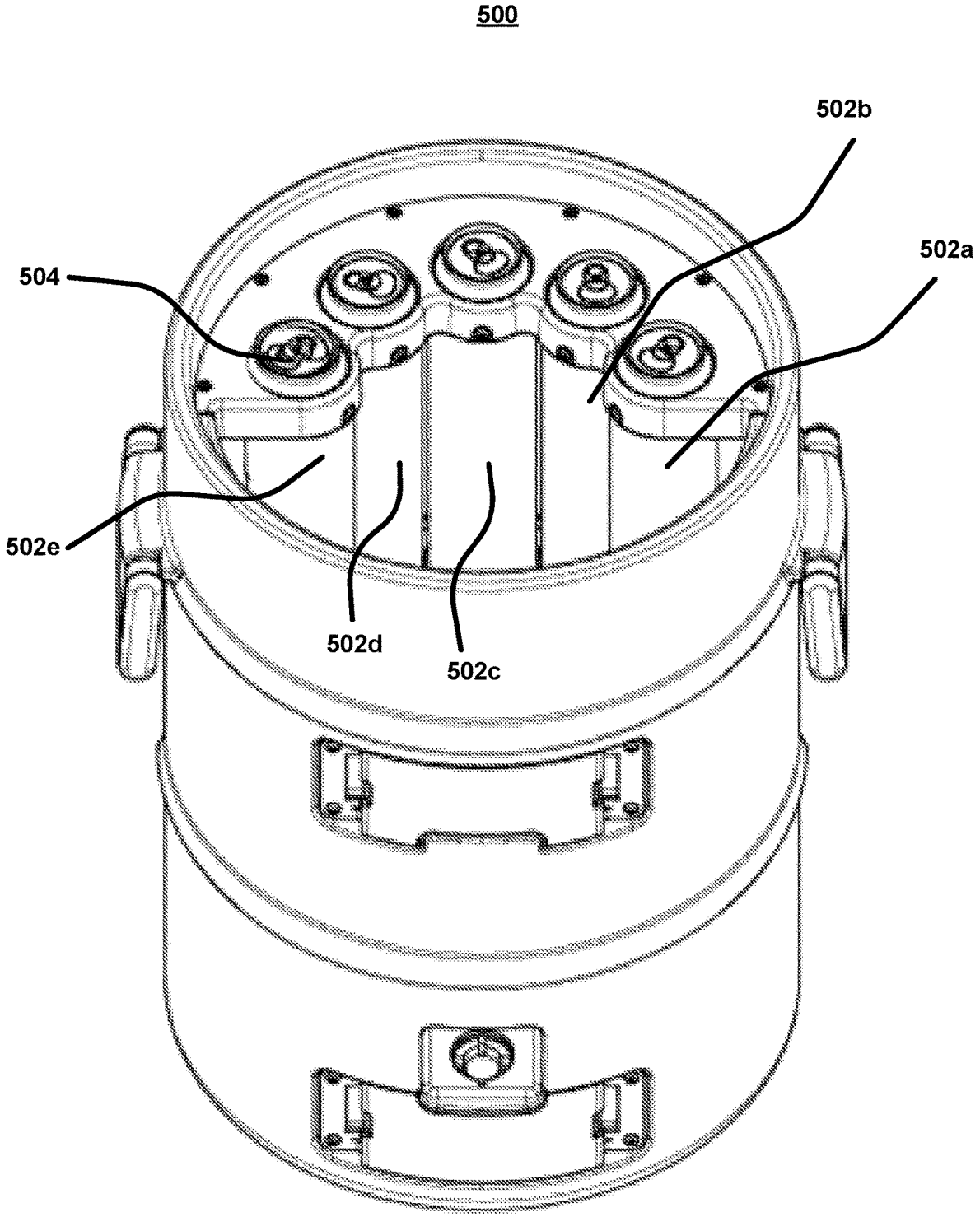
FIG. 5C is a top rear perspective view of the beverage dispenser, containing beverage containers, with the lid removed and the beverage dispensing area in an open position according to exemplary embodiments.
Figure 5D:
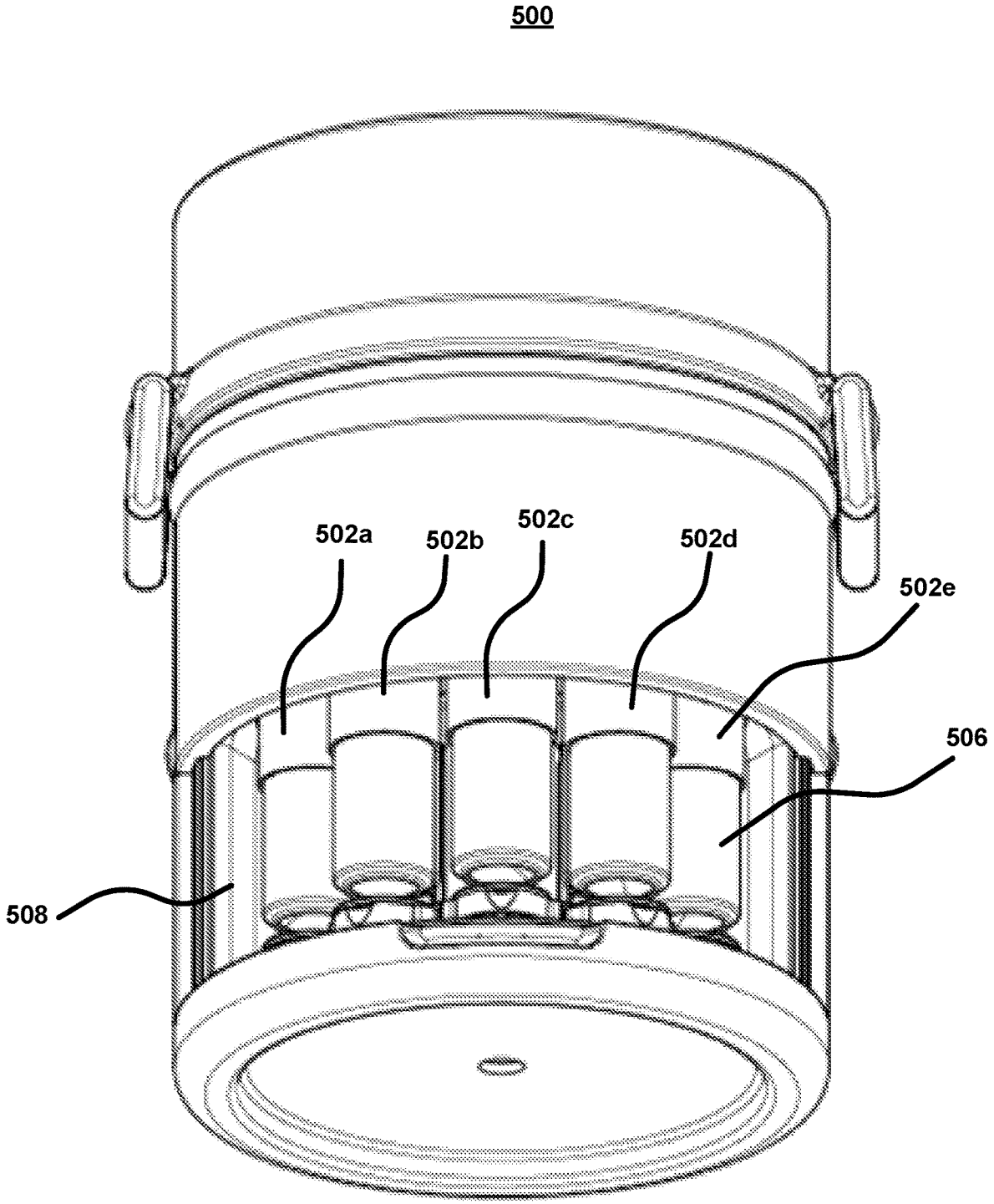
FIG. 5D is a bottom front perspective view of the beverage dispenser, containing beverage containers, with the lid removed and the beverage dispensing area in an open position according to exemplary embodiments.
Figure 5E:
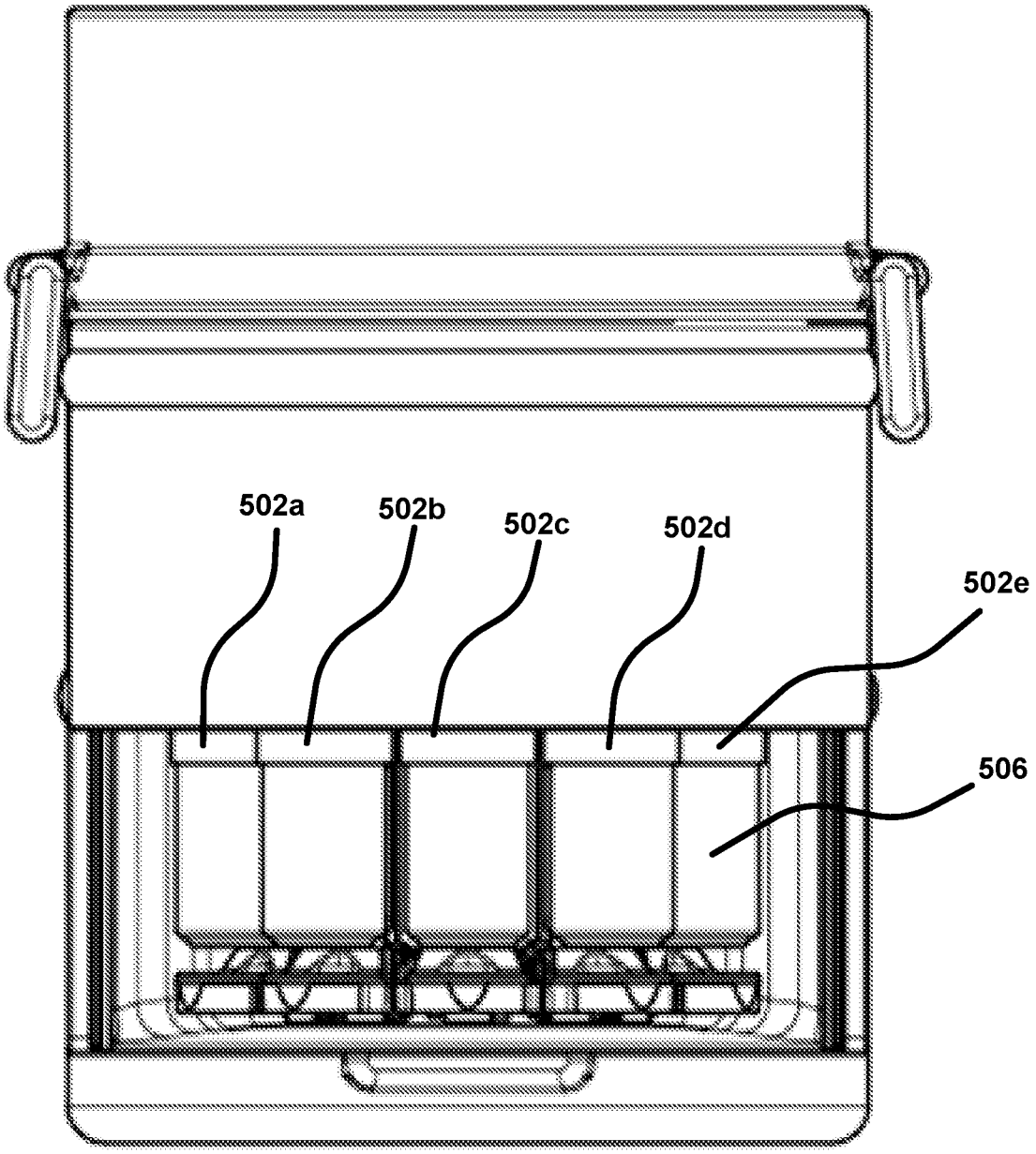
FIG. 5E is a front view of the beverage dispenser, containing beverage containers, with the lid removed and the beverage dispensing area in an open position according to exemplary embodiments.
Figure 5F:
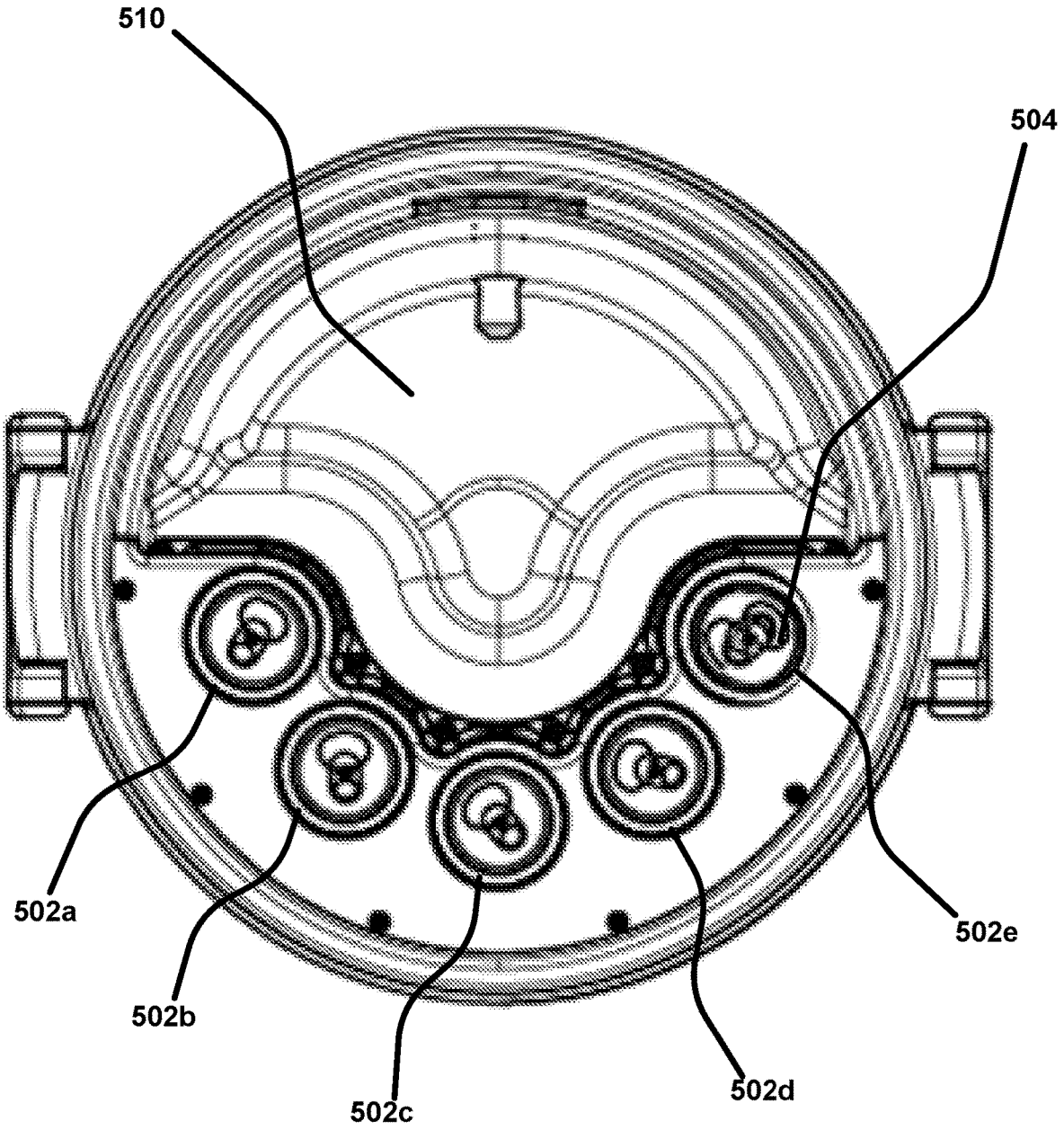
FIG. 5F is top view of the beverage dispenser, containing beverage containers, with the lid removed and the beverage dispensing area in an open position according to exemplary embodiments.
Figure 6A:
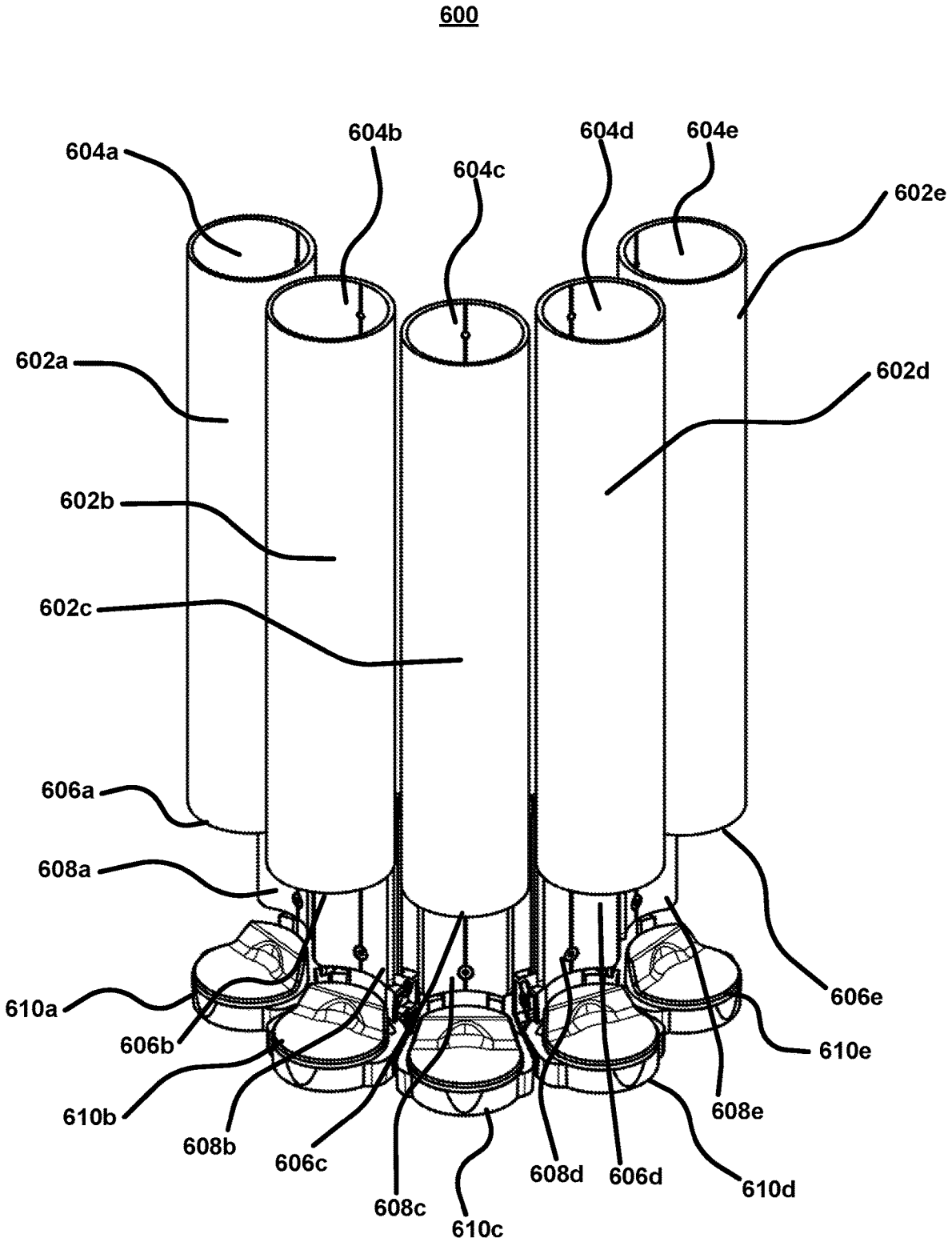
FIG. 6A is top perspective view of a tube set with can catchers according to exemplary embodiments.
Figure 6B:
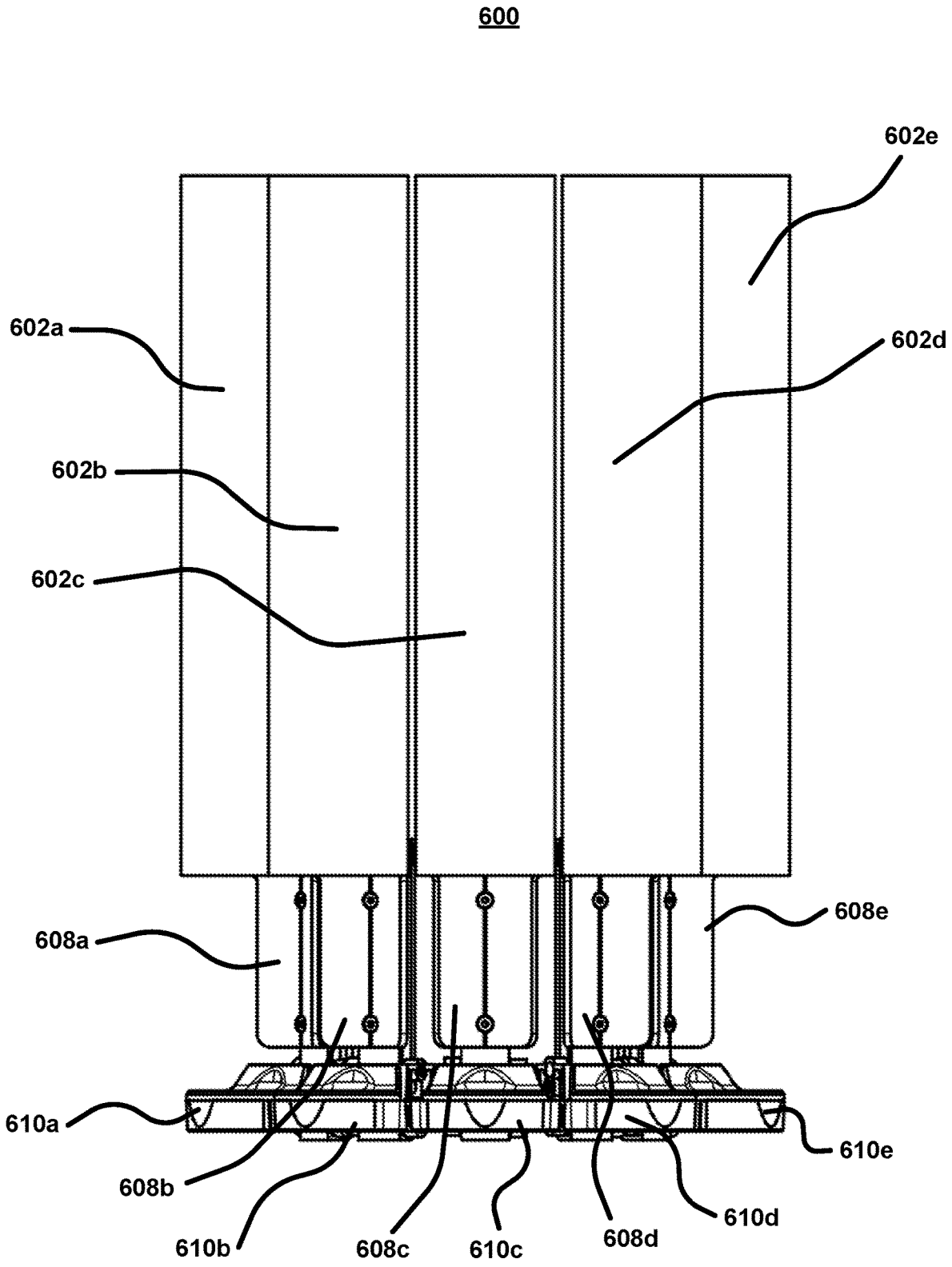
FIG. 6B is a front view of the tube set with can catchers according to exemplary embodiments.
Figure 6C:
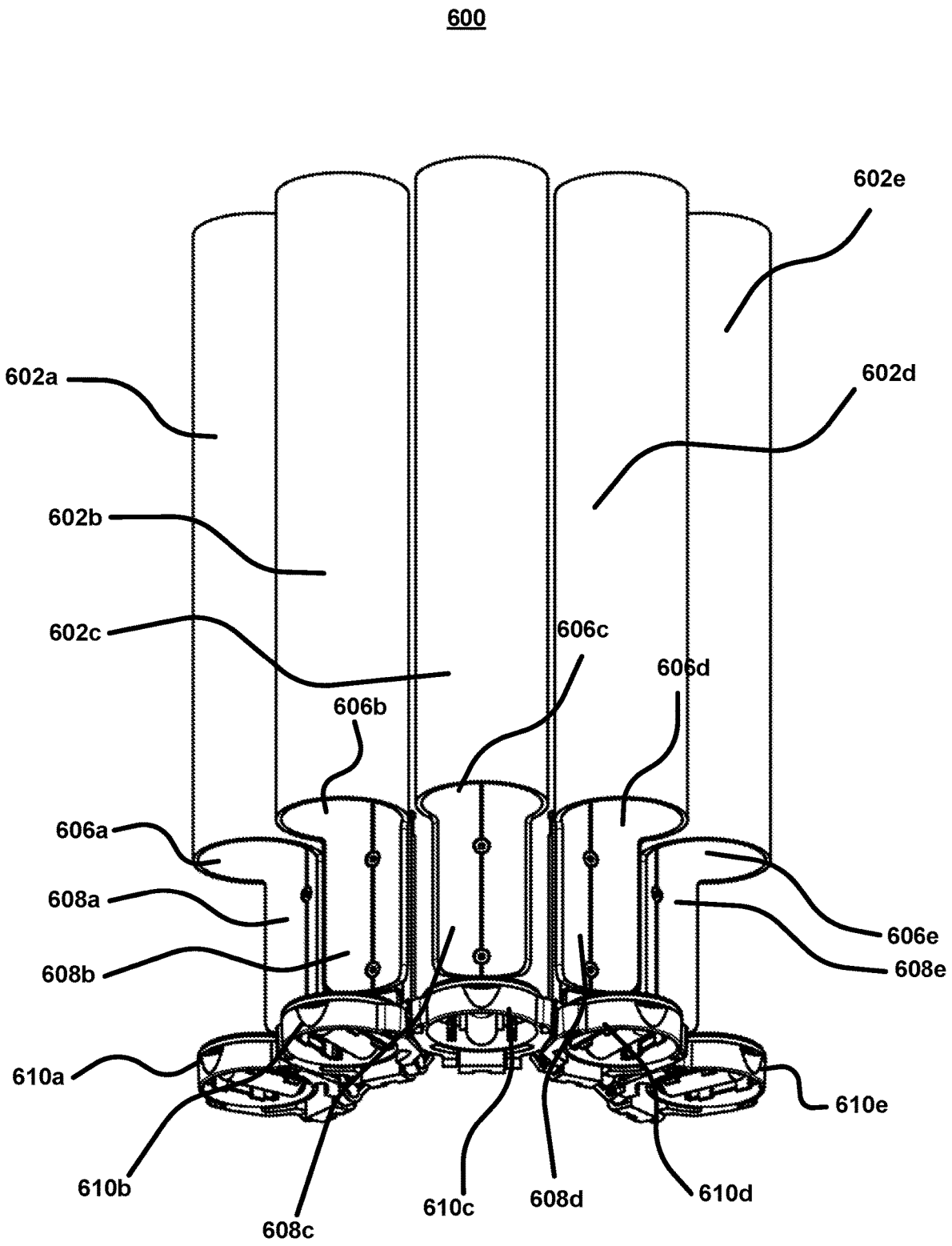
FIG. 6C is a bottom front perspective view of the tube set with can catchers according to exemplary embodiments.
Figure 6D:
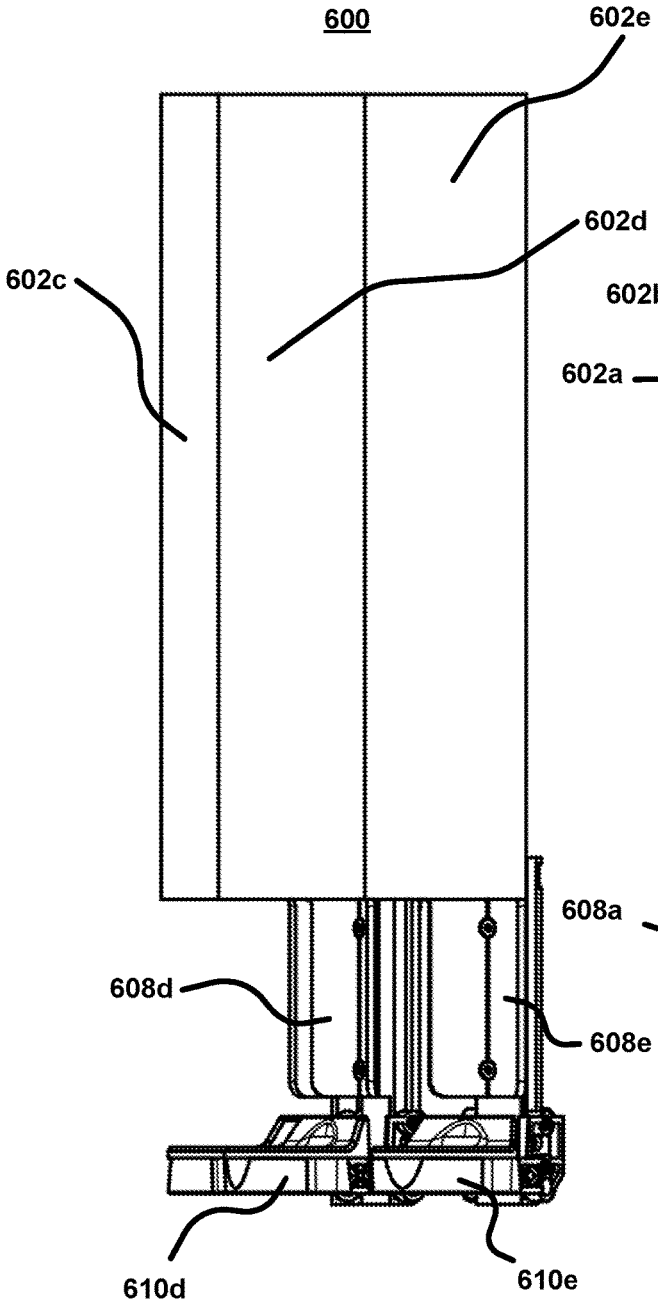
FIG. 6D is a side view of the tube set with can catchers according to exemplary embodiments.
Figure 6E:
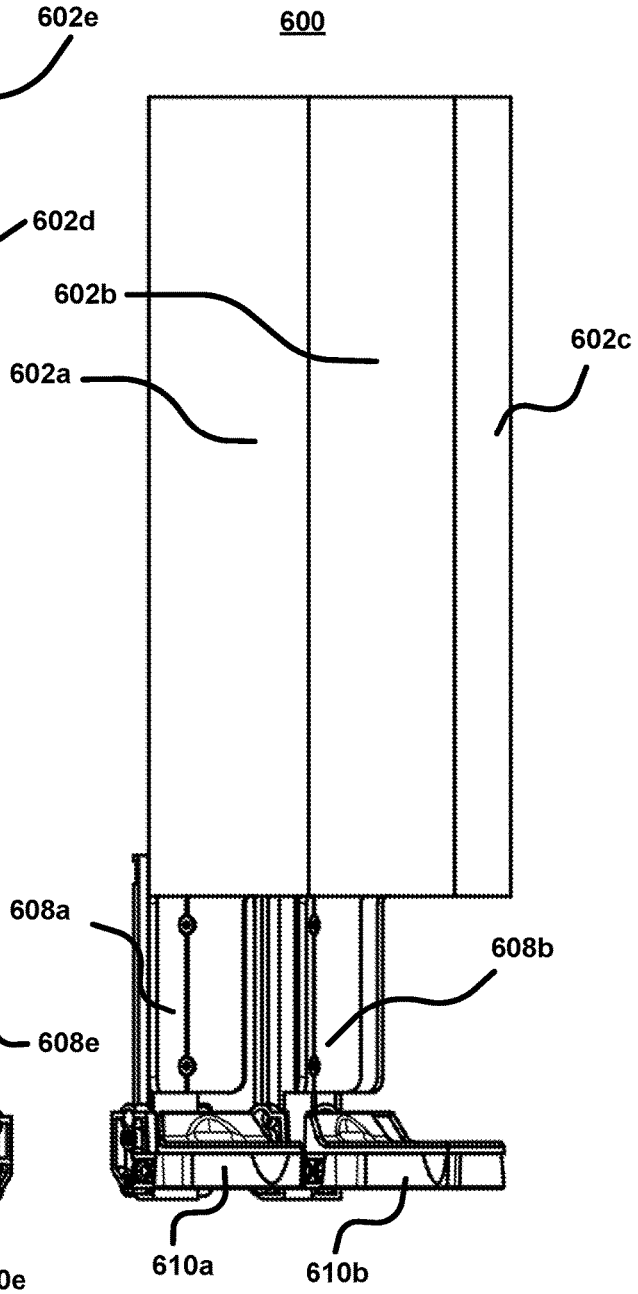
FIG. 6E is an opposite side view of the tube set with can catchers according to exemplary embodiments.
Figure 6F:
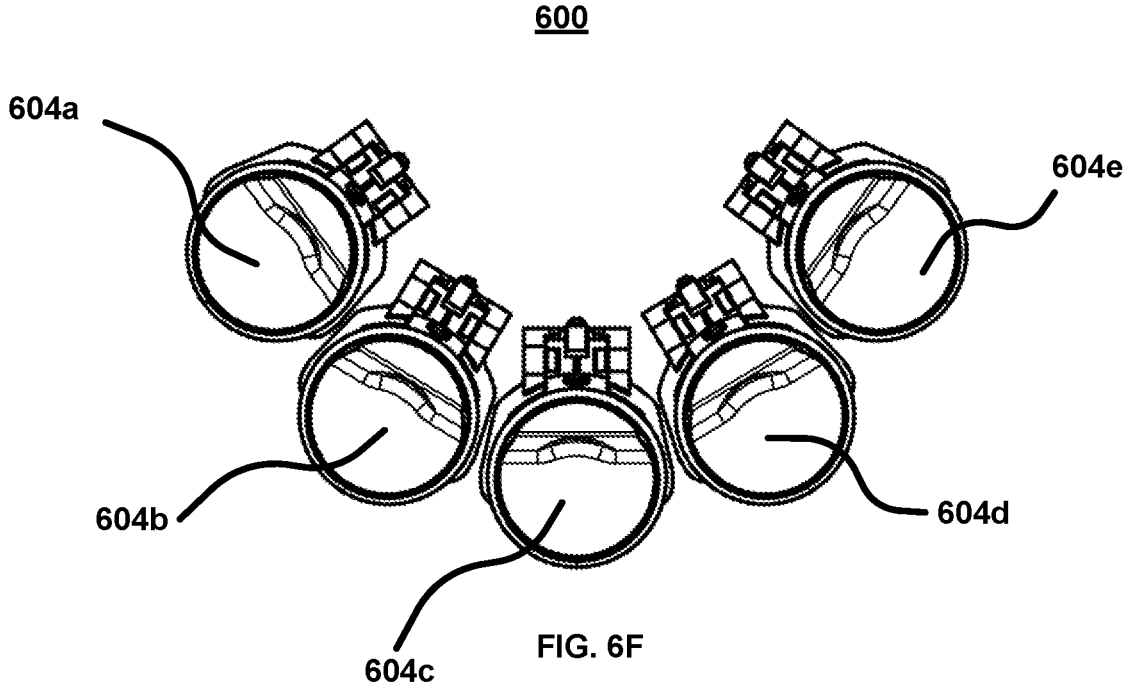
FIG. 6F is a top view of the tube set with can catchers according to exemplary embodiments.
Figure 6G:
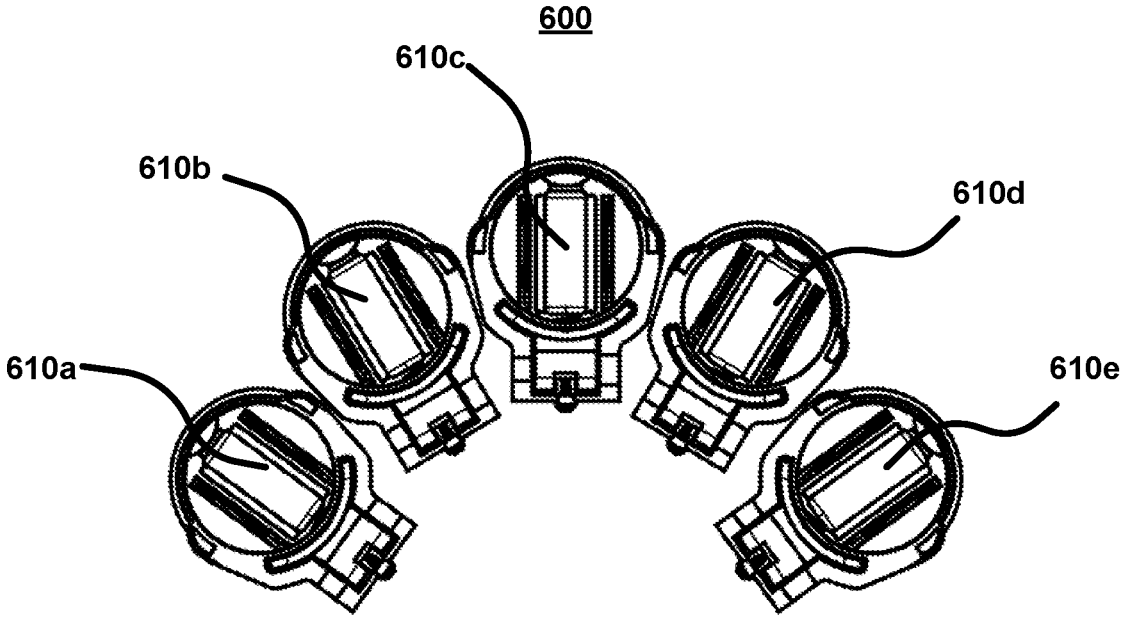
FIG. 6G is a bottom view of the tube set with can catchers according to exemplary embodiments.
Figure 6H:
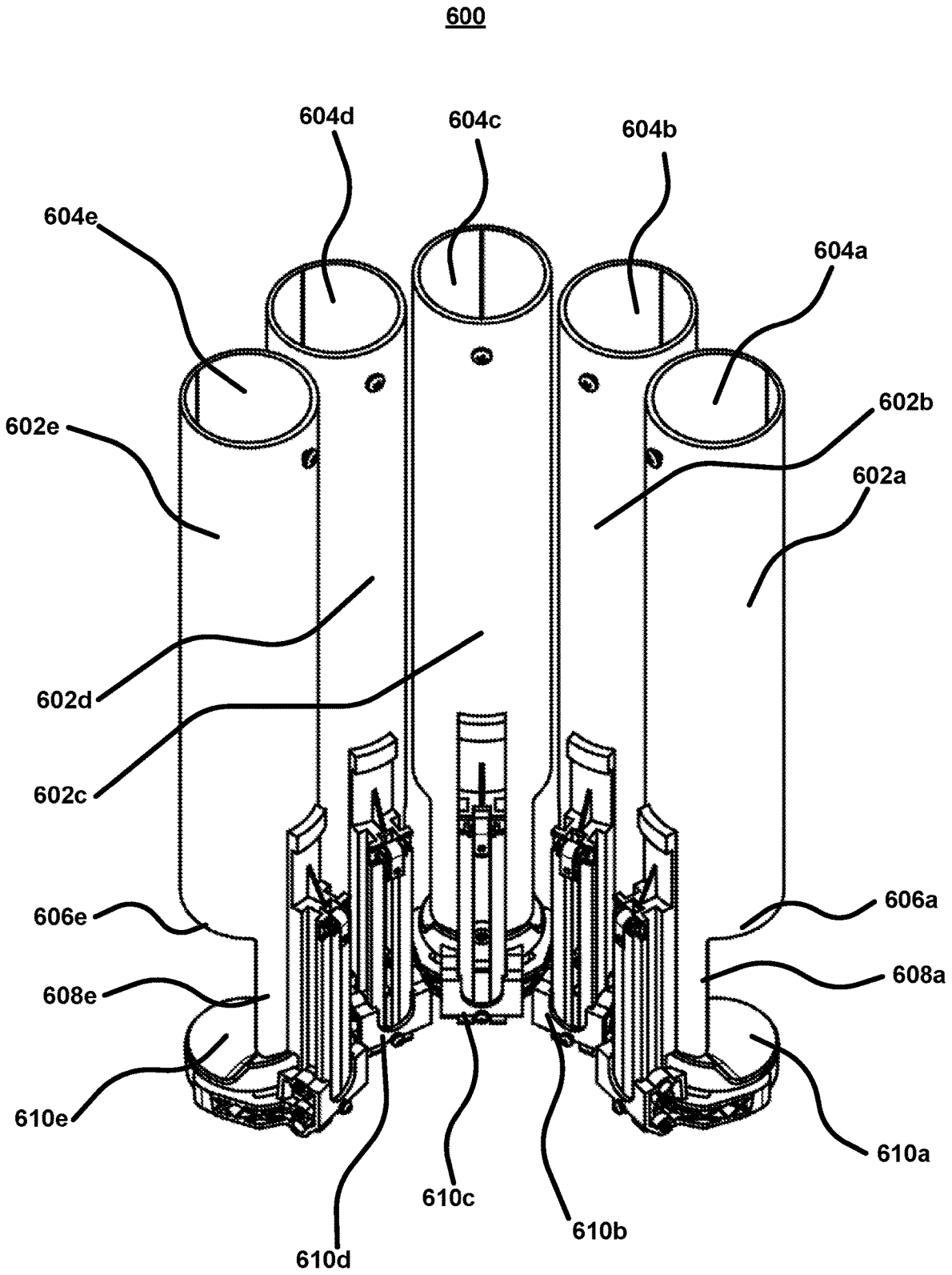
FIG. 6H is a top rear perspective view of the tube set with can catchers according to exemplary embodiments.
Figure 6I:
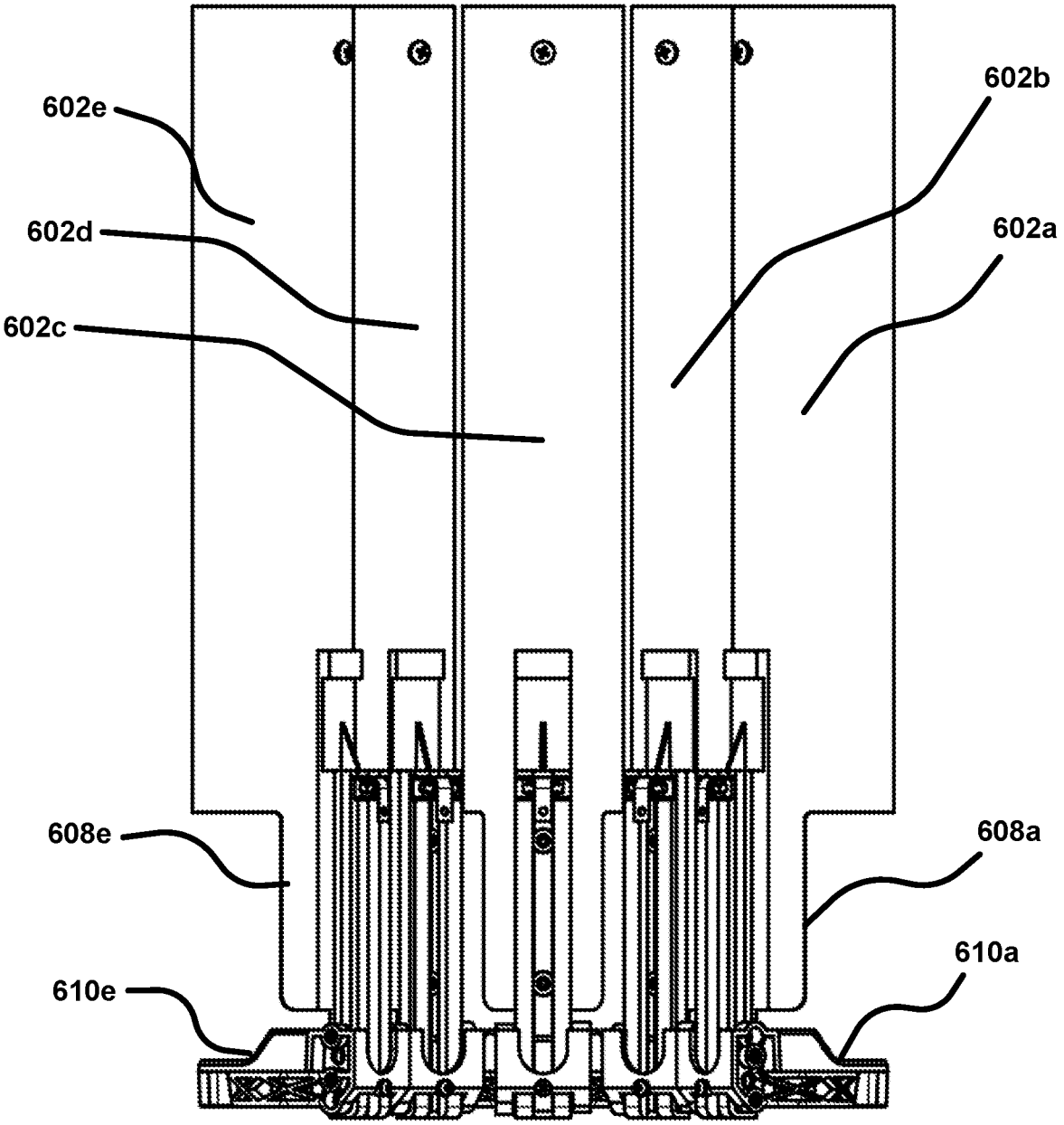
FIG. 6I is rear view of the tube set with can catchers according to exemplary embodiments.
Figure 6J:
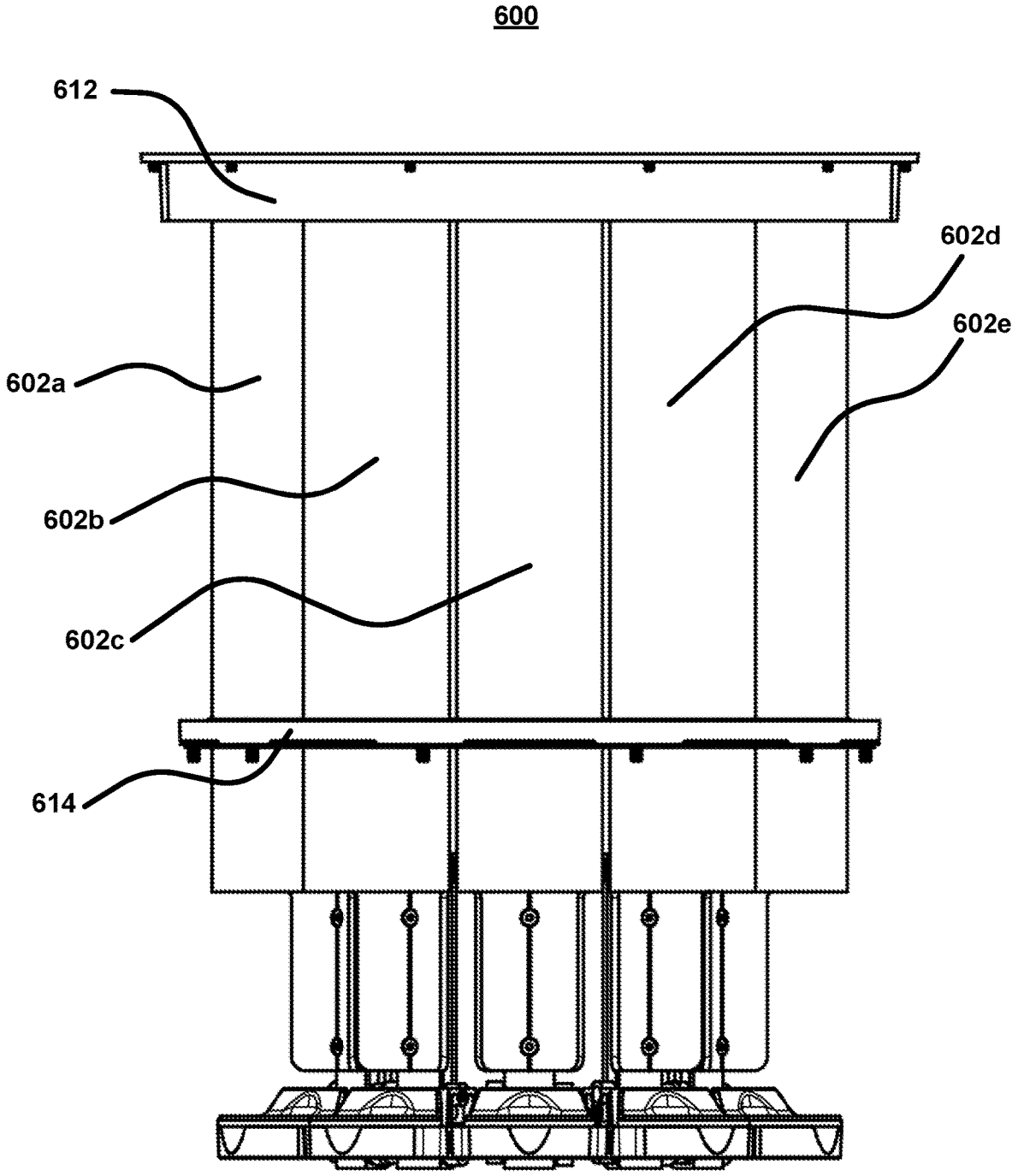
FIG. 6J is a front view of the tube set with can catchers and mounting brackets according to exemplary embodiments.
Figure 6K:
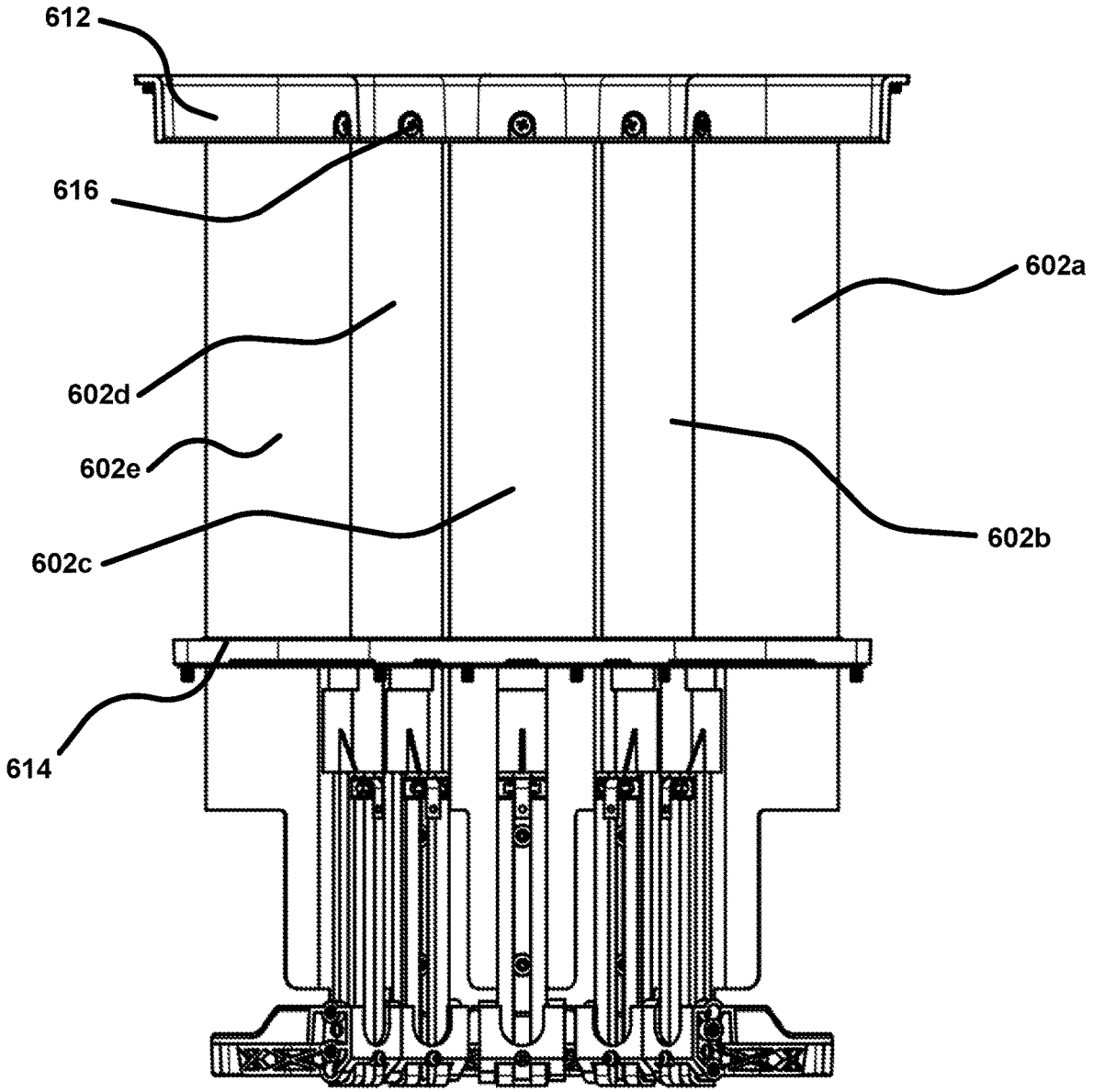
FIG. 6K is a rear view of the tube set with can catchers and mounting brackets according to exemplary embodiments.
Figure 6L:
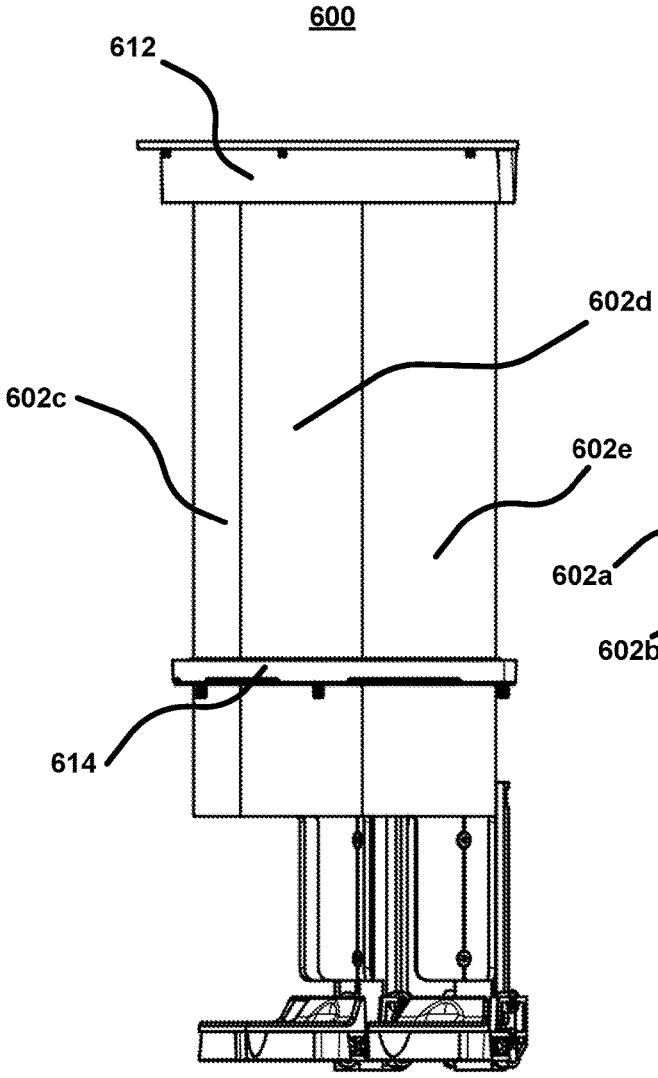
FIG. 6L is a side view of the tube set with can catchers and mounting brackets according to exemplary embodiments.
Figure 6M:
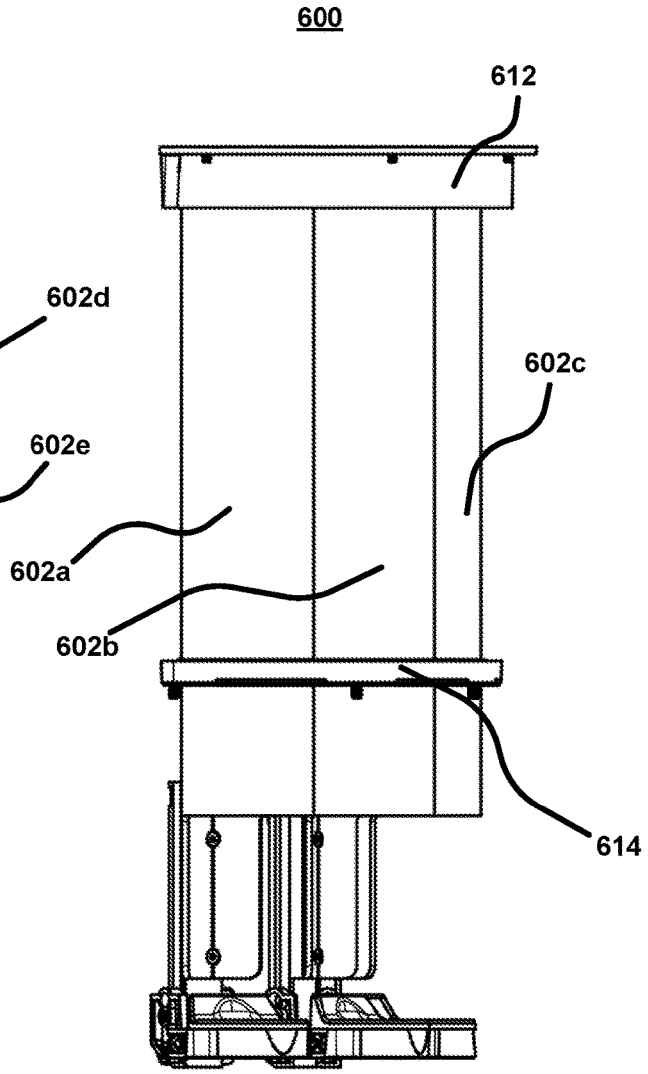
FIG. 6M is an opposite side view of the tube set with can catchers and mounting bracket according to exemplary embodiments.
Figure 7A:
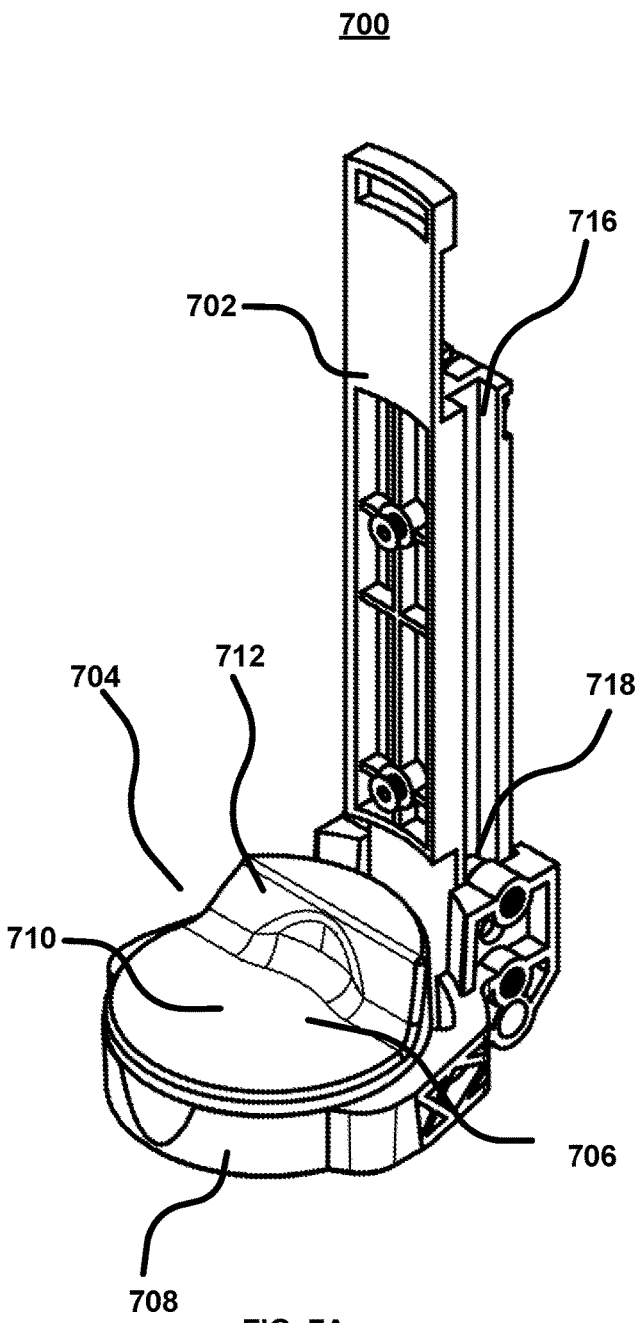
FIG. 7A is a top perspective view of a can catcher assembly according to exemplary embodiments.
Figure 7B:
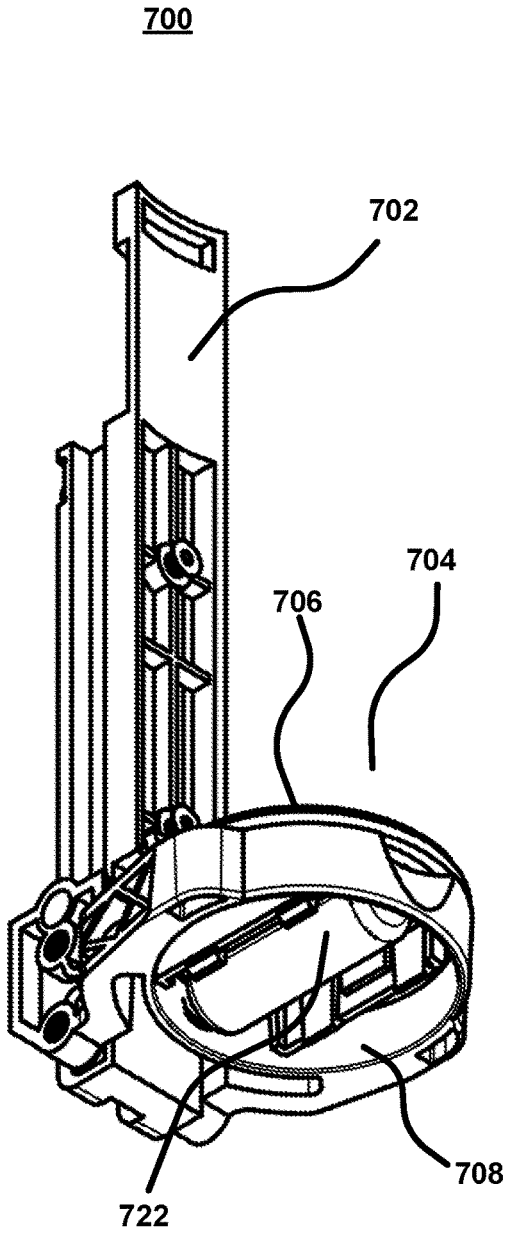
FIG. 7B is a bottom perspective view of the can catcher assembly according to exemplary embodiments.
Figure 7C:
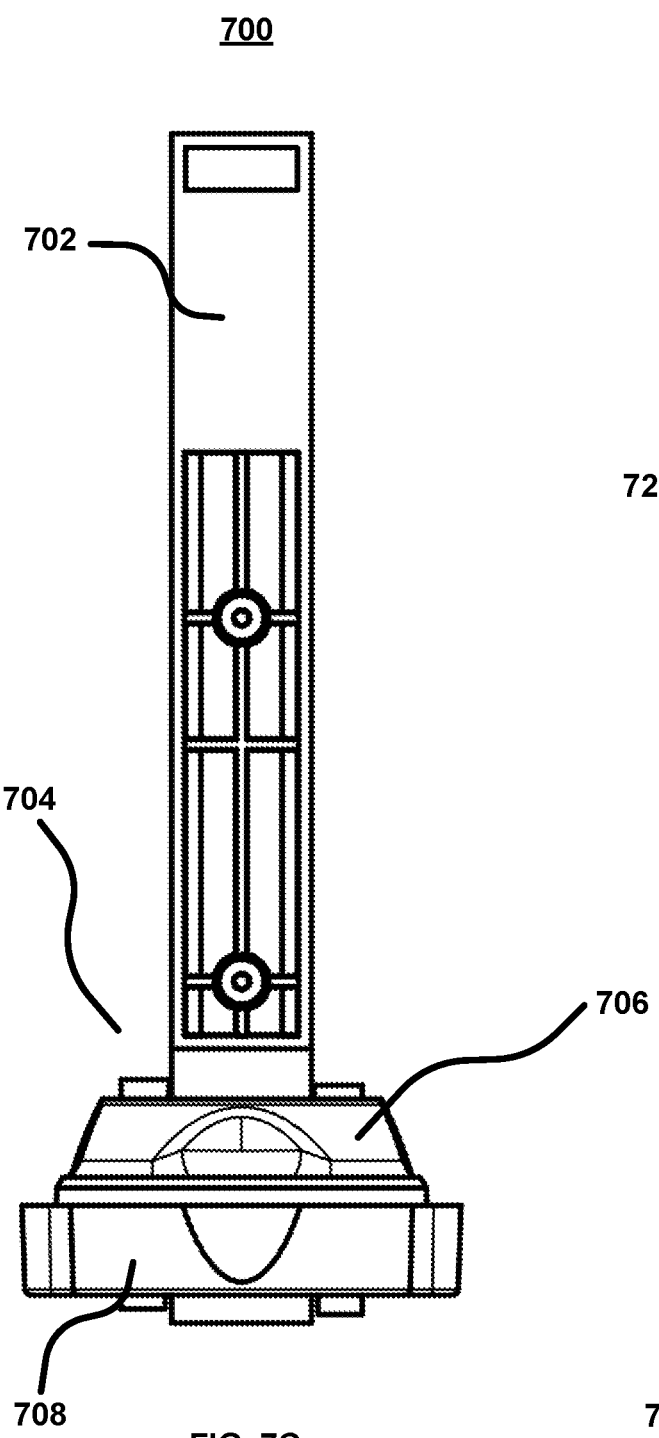
FIG. 7C is a front view of the can catcher assembly according to exemplary embodiments.
Figure 7D:
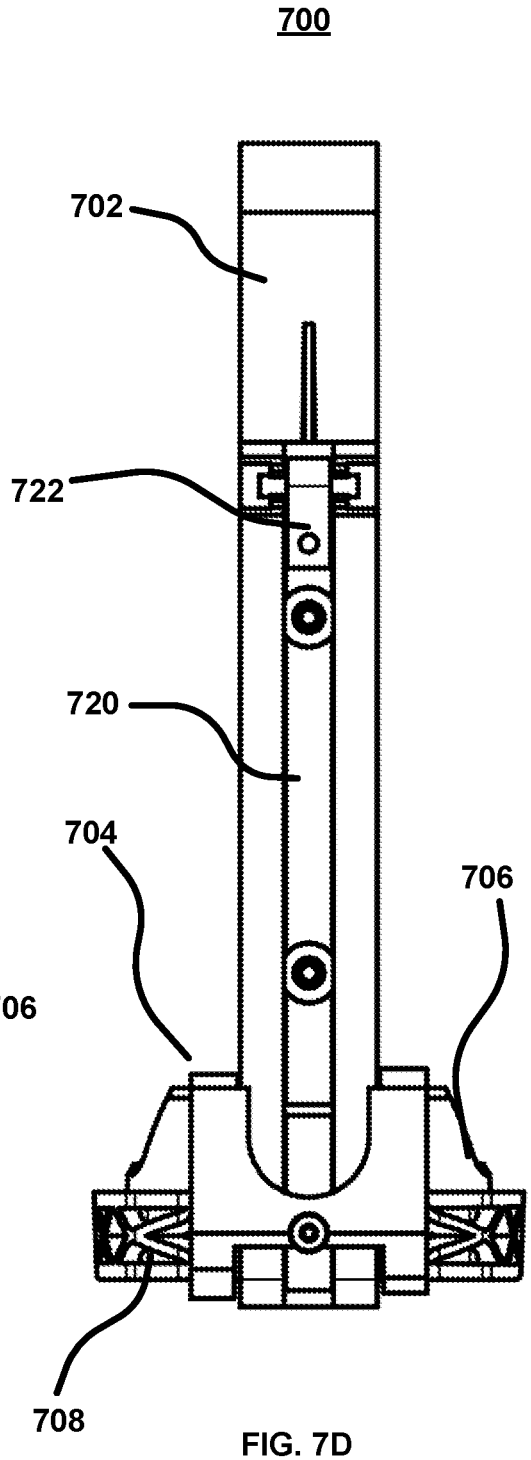
FIG. 7D is a back view of the can catcher assembly according to exemplary embodiments.
Figures 7E, 7F:
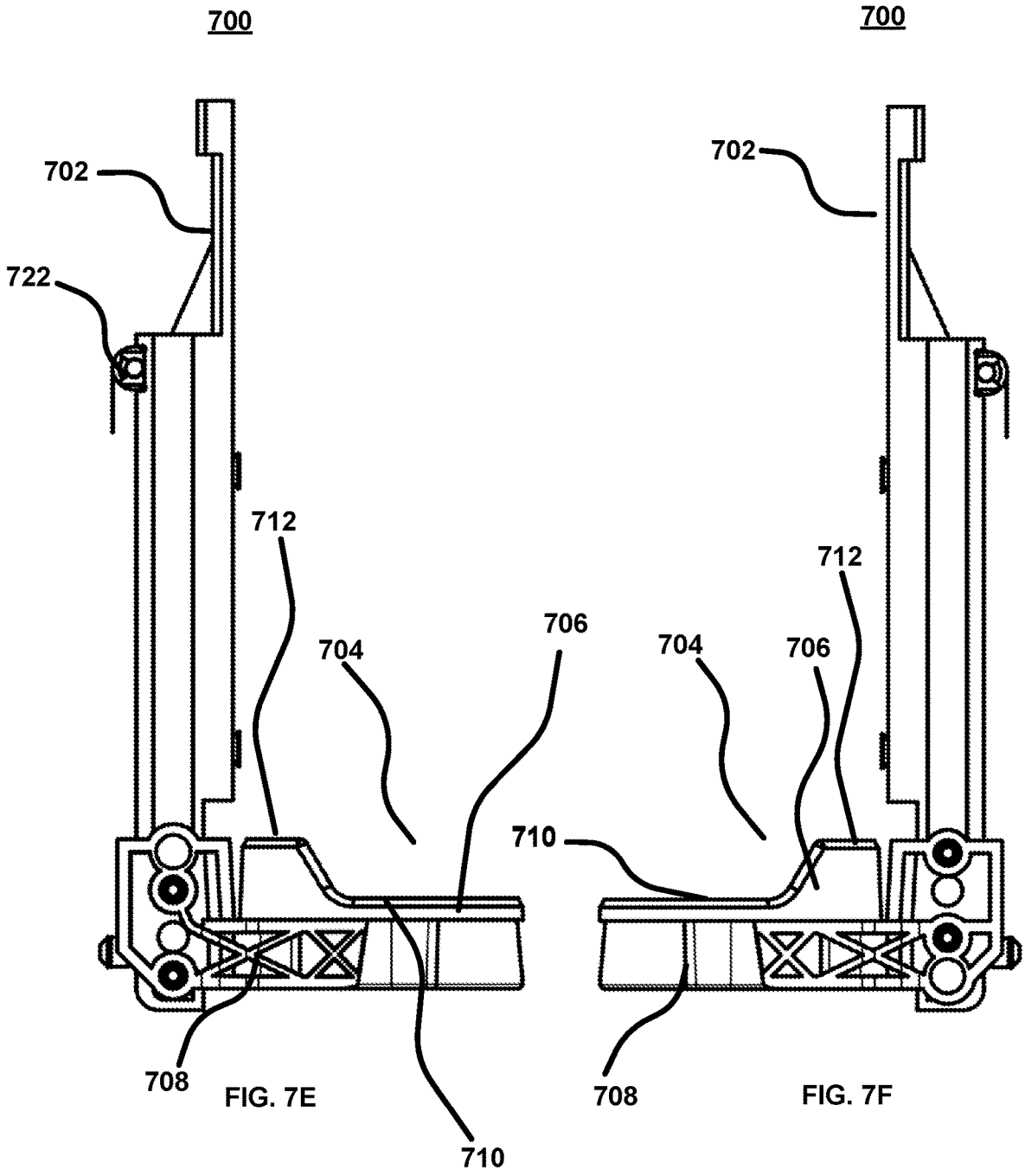
FIG. 7E is a side view of the can catcher assembly according to exemplary embodiments.
FIG. 7F is an opposite side view of the can catcher assembly according to exemplary embodiments.
Figure 7G:
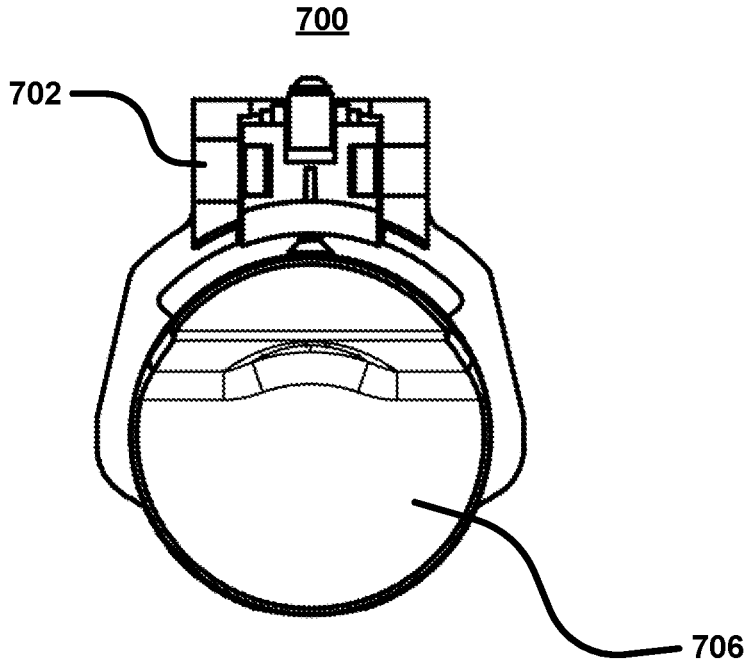
FIG. 7G is a top view of the can catcher assembly according to exemplary embodiments.
Figure 7H:
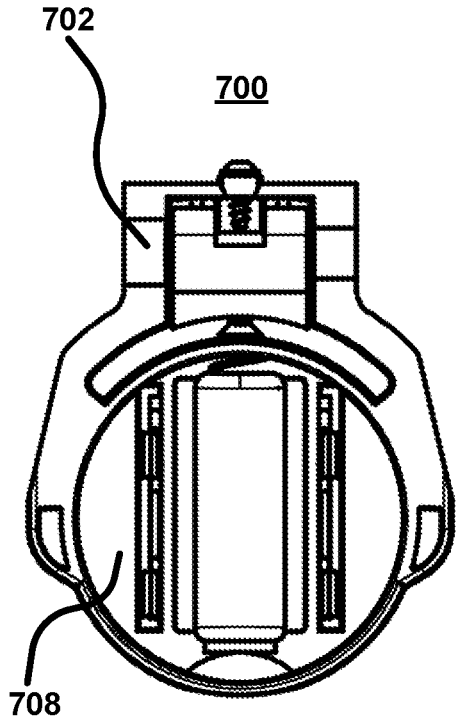
FIG. 7H is a bottom view of the can catcher assembly according to exemplary embodiments.
Figure 7I:
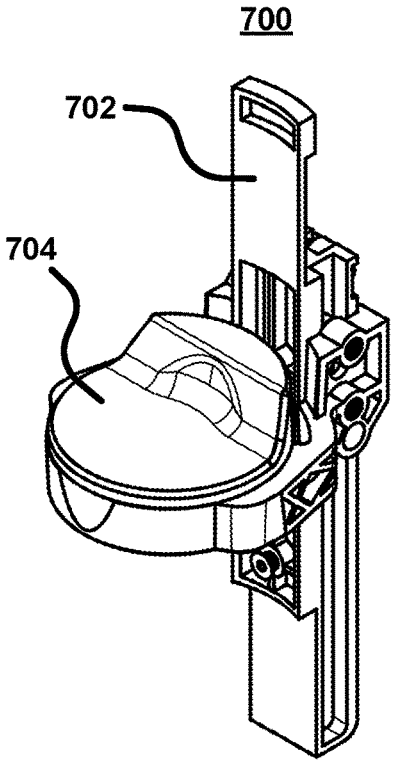
FIG. 7I is a top perspective view of the can catcher assembly in its neutral position according to exemplary embodiments.
Figure 7J:
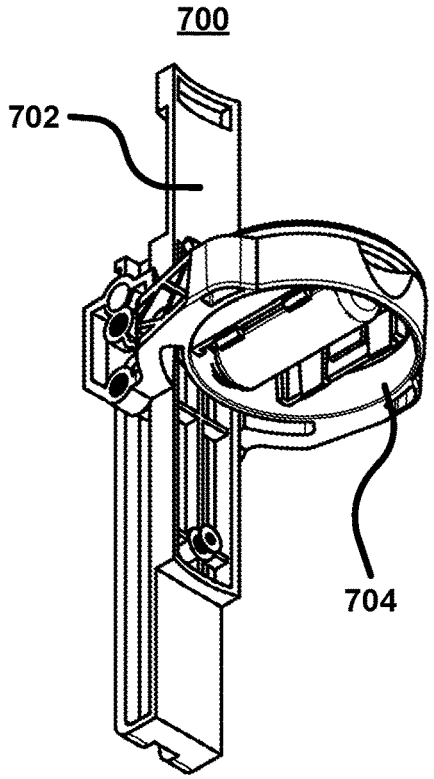
FIG. 7J is a bottom perspective view of the can catcher assembly in its neutral position according to exemplary embodiments.
Figure 7K:
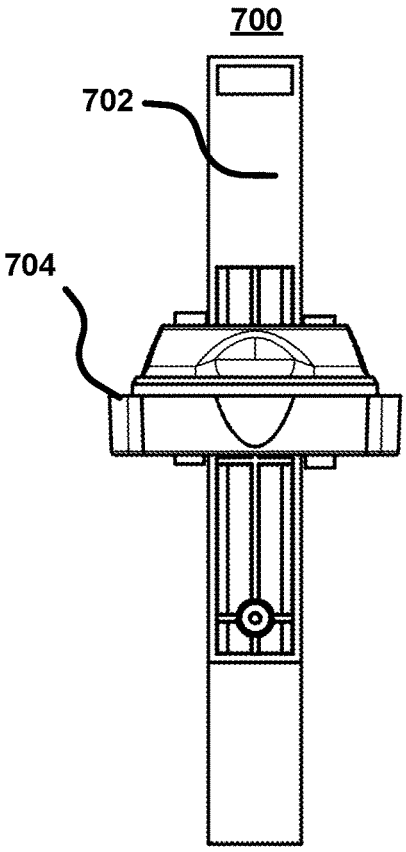
FIG. 7K is a front view of the can catcher assembly in its neutral position according to exemplary embodiments.
Figure 7L:
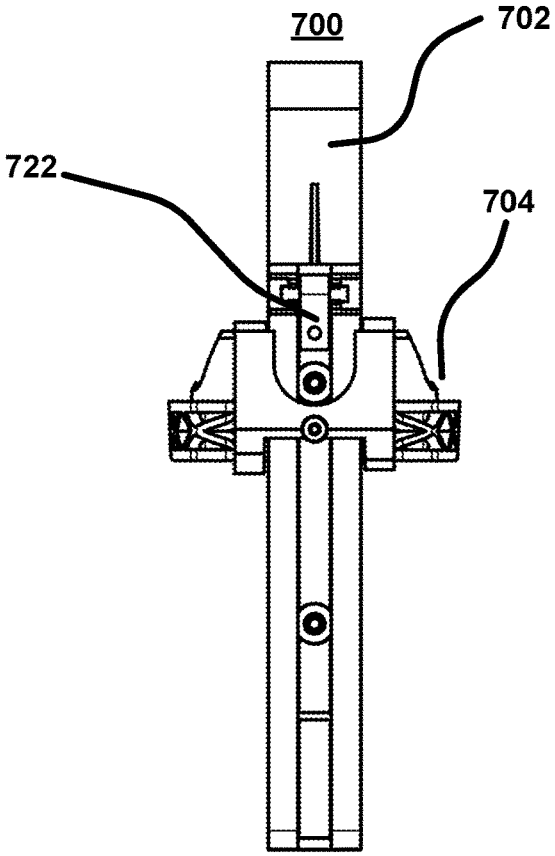
FIG. 7L is a back view of the can catcher assembly in its neutral position according to exemplary embodiments.
Figure 7M:
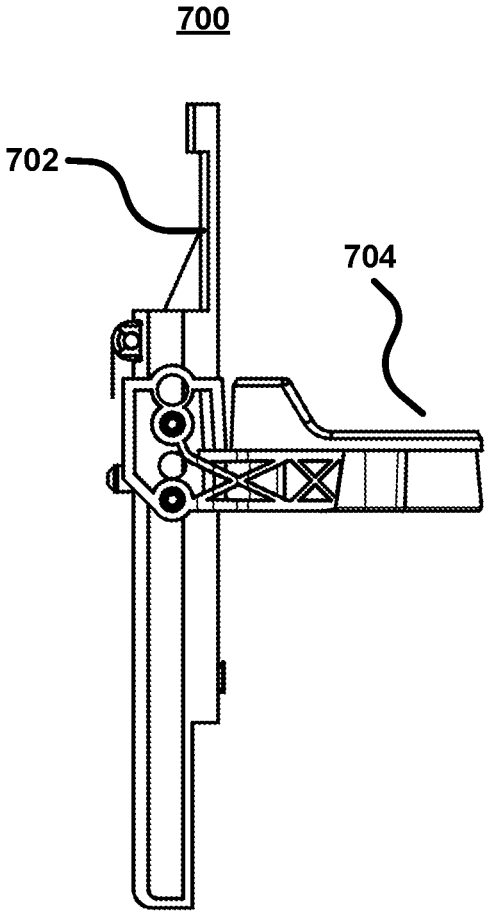
FIG. 7M is a side view of the can catcher assembly in its neutral position according to exemplary embodiments.
Figure 7N:
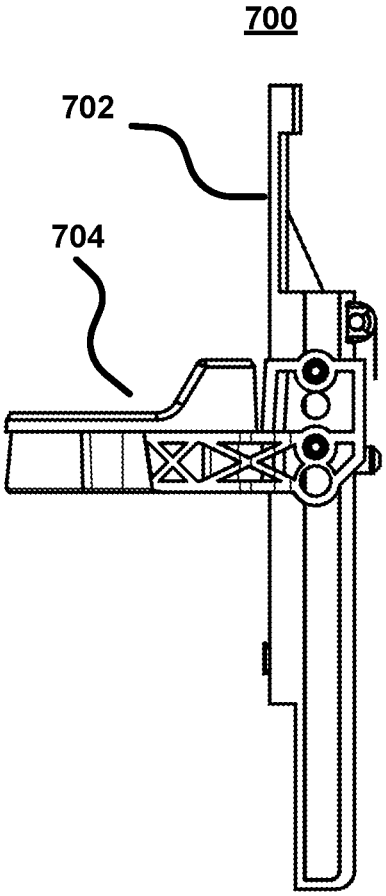
FIG. 7N is an opposite side view of the can catcher assembly in its neutral position according to exemplary embodiments.

In FIG. 4E, the interior volume 414 of the beverage dispenser can be best seen. In FIG. 4E, the tubes 410 have been removed. The upper bracket 418 is located proximate an upper portion 422 of the beverage dispenser. A lower bracket 434 is located below the upper bracket. Directly behind the brackets 418 and 434 is the open volume 416. The open volume 416 may be used to contain a cooling substance or medium, such as, for example, ice, dry ice, synthetic idea, other cooling mediums, or combinations thereof. The cooling substance located in this open volume may provide cooling to the tubes which in turn cool the beverage containers (e.g., cans) located therein. The tubes are designed to transmit the cooling properties of the cooling substance (e.g., ice) that is added to the open volume to the beverage containers within the tubes. To help facilitate this cooling, the tubes may be made from a material (such as metal or an alloy) with high thermal conductivity. For example, the tubes may be made from aluminum. In various embodiments, the open volume may be used to contain additional beverage containers, including containers that may not fit into the tubes (e.g., bottles or non-standard size cans). The open volume may have a capacity of 4.86 gallons in exemplary embodiments. The capacity may be more or less in other embodiments based on the size of the beverage container, the number and size of tubes, etc.

There may be an inner shell 438 that is spaced apart from the outer shell 408. Between the inner and outer shells may be open space. This open space may contain insulation. In various embodiments, the inner shell may be the inner wall of the outer shell. That is, the structure may be molded or formed in one piece and have no open space between the inner and outer shell.

FIGS. 5A, 5B, 5C, 5D, 5E, and 5F (collectively, FIG. 5) depict a beverage dispenser 500. The beverage dispenser 500 may be the same as the beverage dispenser 400 depicted in FIG. 4. Accordingly, not all of the parts and structure of the beverage dispenser 500 are labelled in FIG. 5 and the structure is explained in detail above with respect to FIG. 4. The beverage dispenser 500 may have tubes 502*a*, 502*b*, 502*c*, 502*d*, and 502*e* (collectively, tubes 502). The tubes 502 may be used to contain beverage containers such as 504 and 506. Each tube 502 may contain up to four beverage containers. The beverage containers may be a typical (standard sized in the United States) 12 oz. can (as described above with respect to FIG. 4). In some embodiments, 16 oz. or 8 oz. cans may be used, in which case less or more than four containers may be inserted into each tube 502. In various embodiments, a mix of different size containers may be contained within the beverage dispenser 500 within the tubes 502. The beverage container 504 at the upper portion of tube 502*e* is different from the beverage container 506 at the bottom or lower end of tube 502*e* in the beverage dispensing area 508. There may be two additional beverage containers within the tube 502*e* between beverage containers 504 and 506 in a typical embodiment. The beverage containers (such as 506) may be inserted at the upper portion of the tube 502 (e.g., dropped into the tube) and the beverage container may travel down the tube (e.g., tube 502*e*) under the force of gravity, and slowed by the air cushion that is present in the tubes as described herein, until it reaches the lower end of the tube and the beverage dispensing area 508. Subsequent beverage containers, such as 504, may then be inserted and stack onto the container 506. In some embodiments, a user may insert cans upside down into the tubes 502. The beverage dispenser may still function as described below.

Further, additional beverage containers may be contained in the open volume 510 located behind the tubes.

FIGS. 6A, 6B, 6C, 6D, 6E, 6F, 6G, 6H, 6I, 6J, 6K, 6L, and 6M (collectively, FIG. 6) depict a tube set 600 with a can catcher according to exemplary embodiments. The tube set 600 may be used in the beverage dispenser described herein according to exemplary embodiments. In other embodiments, the tube set 600 may be used with other structures for containing and dispensing beverage containers. The tube set 600 may include five cylindrical tubes 602*a*, 602*b*, 602*c*, 602*d*, and 602*e* (collectively, tube(s) 602). Each tube 602 may have an opening located at its upper extremity (604*a*, 604*b*, 604*c*, 604*d*, 604*e*; collectively, 604). Each tube 602 may have another opening located opposite the openings 604 at a lower portion of the tube (606*a*, 606*b*, 606*c*, 606*d*, 606*e*; collectively, 606). Extending downward past the opening 606 may be tongue portion (608*a*, 608*b*, 608*c*, 608*d*, 608*e*; collectively, 608). The tongue portion 608 may have the same curvature as the tubes 602 as can be seem in FIG. 6. The tongue portion 608 may terminate above a can catcher assembly (610*a*, 610*b*, 610*c*, 610*d*, 610*e*; collectively, 610). The can catcher assembly is described below in FIG. 7. The tongue portion 608 may also be referred to as a cut-out in the tube. This tongue portion may allow for a beverage container that has been inserted into a tube 602 (e.g., 602*a*, 602*b*, 602*c*, 602*d*, and/or 602*e*) to be exposed for removal from the tube. The height of the tongue portion 608 may be approximately the height of a standard 12 oz. (US) beverage can (in exemplary embodiments, the spacing is lightly less than the height of the beverage can). For example, the cut-out may be 62.6 mm wide x 104 mm tall. Additionally, in exemplary embodiments, the can catcher assembly 610 may be mounted to the tongue portion 608. In FIG. 6, the can catcher assembly is depicted in its lower or weighted position for illustrative purposes.

Each tube 602 may have a diameter that is slightly larger than the diameter of a standard 12 oz. (US) beverage can. For example, the tube inner diameter may be 66.6496 mm and the outer diameter of a can may be 66.04 mm. Thus, there is 0.6096 mm of spacing (total) between the can and tube. This allows for a beverage can (such as shown in the various figures herein) to be inserted into a tube 602 through the top opening 604 and allow the beverage can to then drop or descend the length of the tube to the beverage dispensing area located at the lower opening of each tube. Each tube 602 may hold or contain up to four 12 oz. beverage cans (a standard US 12 oz. beer or soda can as described above). It should be appreciated that various embodiments may hold more or less beverage cans depending on the size of the beverage cans and the height of the tubes. The slightly larger diameter (than the can diameter) allows for air to escape as the can moves downward but still provide an air cushion to assist with braking the can during its downward descent. The internal tube diameter was tuned to provide a balance between: as close contact as possible with the beverage container, to maximize energy transfer for cooling purposes as described herein and allow sufficient air to pass around the beverage container as it drops down the tube to allow for a beverage container drop that is controlled without being too slow, and does not risk the beverage container(s) getting stuck in the tube due to potential dimensional variations between beverage containers (e.g., between different brands and types of cans or even variation between cans of the same type and brand).

The tubes 602 may be made of metal. According to exemplary embodiments, the tube 602 may be made of a metal with a high thermal conductivity. In other embodiments, different metals, alloys, or combinations thereof may be used. For example, aluminum may be used. In some embodiments, the tubes 602 may be made of a combination of metals or different materials. The tubes 602 may be made of metal to facilitate cooling of beverage containers (e.g., cans) in the tubes 602 as described above.

It should be appreciated that the tubes 602 may be arranged differently than depicted in FIG. 6. For example, the tubes 602 may be closer together to form more of a circle instead of an arc. Further, there may be more or less than five tubes. The arrangement and number of the tubes 602 may be dependent upon the application of the tubes 602.

FIGS. 6J, 6K, 6L, and 6M depict the tube set 600 with two mounting brackets 612 and 614 included. The upper mounting bracket 612 and the lower mounting bracket 614 may provide for stability of the tubes as well as provide mounting points for the tubes to external structure. For example, the mounting brackets 612 and 614 may be used to secure the tube set 600 to a beverage dispenser such as described herein. The mounting brackets 612 and 614 may be constructed of plastic, metal, or combinations thereof. In some embodiments, The mounting brackets 612 and 614 may be removably mounted within the beverage dispenser such as by screws or other similar securement mechanisms; in some embodiments, the mounting brackets may be snap fit, interference fit, or clipped into the outer shell of the beverage dispenser.

In various embodiments, the tube set 600 may be removably mounted within the brackets. That is, each tube may be removable from the bracket. For example, the tubes may be secured to the upper bracket 612 by a screw, such as screw 616 (labelled in FIG. 6K). The tubes may be similarly secured to the lower bracket 614. The screw(s) may be removable by a user to release the tube. This may allow for tubes to be changed for different tubes. In some embodiments, the entire assembly (tube set and mounting brackets) may be removable to allow for a different tube set to be inserted (such a tube set may have different mounting brackets to accommodate different sized tubes).

FIGS. 7A, 7B, 7C, 7D, 7E, 7F, 7G, 7H, 7I, 7J, 7K, 7L, 7M, and 7N (collectively, FIG. 7) depict a can catcher assembly 700 according to exemplary embodiments. The can catcher assembly 700 may be the assembly depicted in the various embodiments described above that is located at the lower portion of the tube assemblies such as depicted in FIG. 4. The can catcher assembly may be mounted to or attached to the tongue portion of the tube assembly, again such as depicted in FIG. 4. The can catcher assembly 700 may have two primary parts: a vertical rail portion 702 and a puck portion 704 (which may also be referred to as a paddle assembly). The puck portion 704 may slide or move vertically along the vertical rail portion 702. The vertical rail portion 702 may also serve as the mounting point to the tubes as described herein (e.g., to the tongue portion described above). The puck portion 704 may have two primary parts: an upper slidable surface 706 and a lower fixed surface 708. The upper slidable surface 706 may have two portions: a flat portion 710 and a ramped portion 712. The upper slidable surface 706 may be attached to a spring 830 (as depicted in FIG. 8D for example).

FIGS. 7I through 7N depict the puck portion 704 in its neutral or raised position. This position is the unloaded position (e.g., no beverage containers are present). This neutral or raised position is designed such that the puck portion 704 is located proximal the lower opening of each tube such that a seal or plug is created in the tube to facilitate formation of the air cushion to slow the descent of the first beverage container inserted and dropped into a tube. As noted above, the seal or plug may not be "perfect" due to tolerances between the parts but may be at least a partial seal of the lower opening of the tube.

The puck portion 704 may be mated with the vertical rail portion 702 and slide in a track 716 on the vertical rail portion 702 using two or more wheels 718. A constant tension spring 722 (also shown in FIG. 8D as 832) may provide for the puck portion to have its raised or neutral position. The spring may be mounted within the rail portion in a center portion 720. The spring 722 may be in the extended or tensioned state when the puck portion is in the bottom position.

A second spring (spring 830) that is a compression spring may be mounted within a barrel housing 722 on the puck portion 704. The spring 830 allow the upper slidable surface to move relative to the lower fixed portion 708 in a rearward direction (e.g., towards the vertical rail portion 702) according to exemplary embodiments a. A user may push the upper slidable surface in the rearward direction (compressing the spring) and the upper slidable surface may return to its neutral position once the user releases it because of the spring 830. FIG. 10B, for example, depicts this rearward position.

Figure 8B:
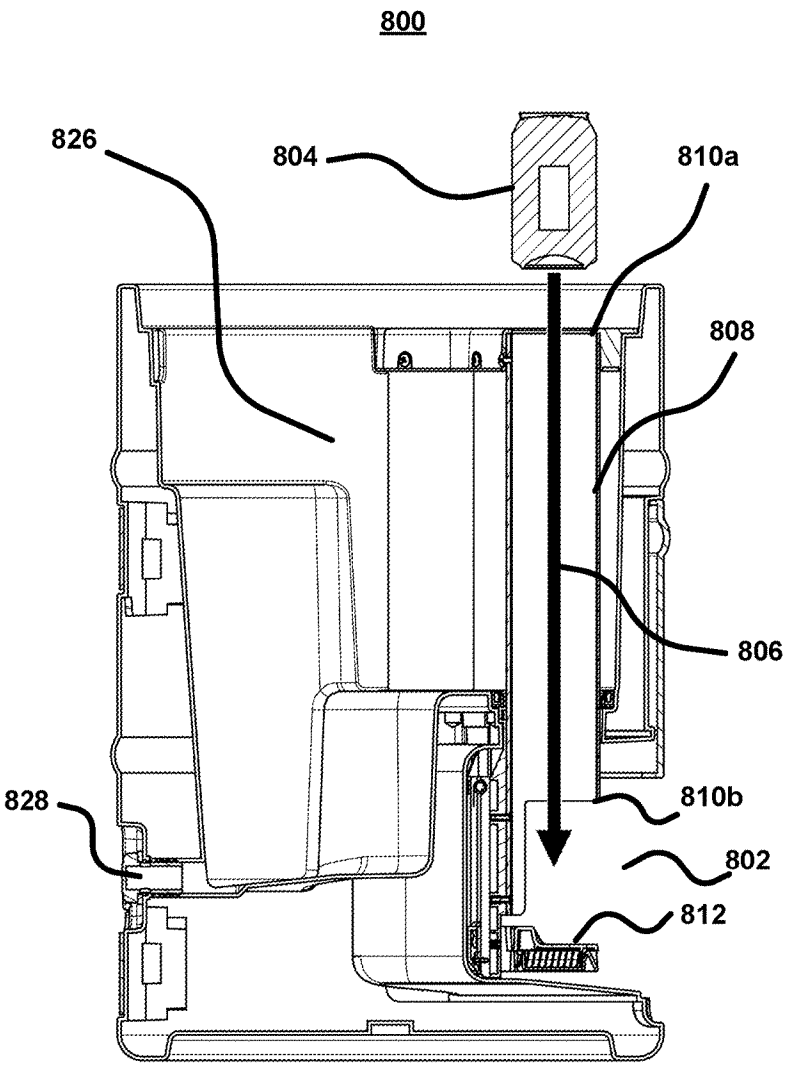
FIG. 8B is a cross-section of FIG. 8A taken along the line 8B-8B of FIG. 8A according to exemplary embodiments.
Figure 8A:
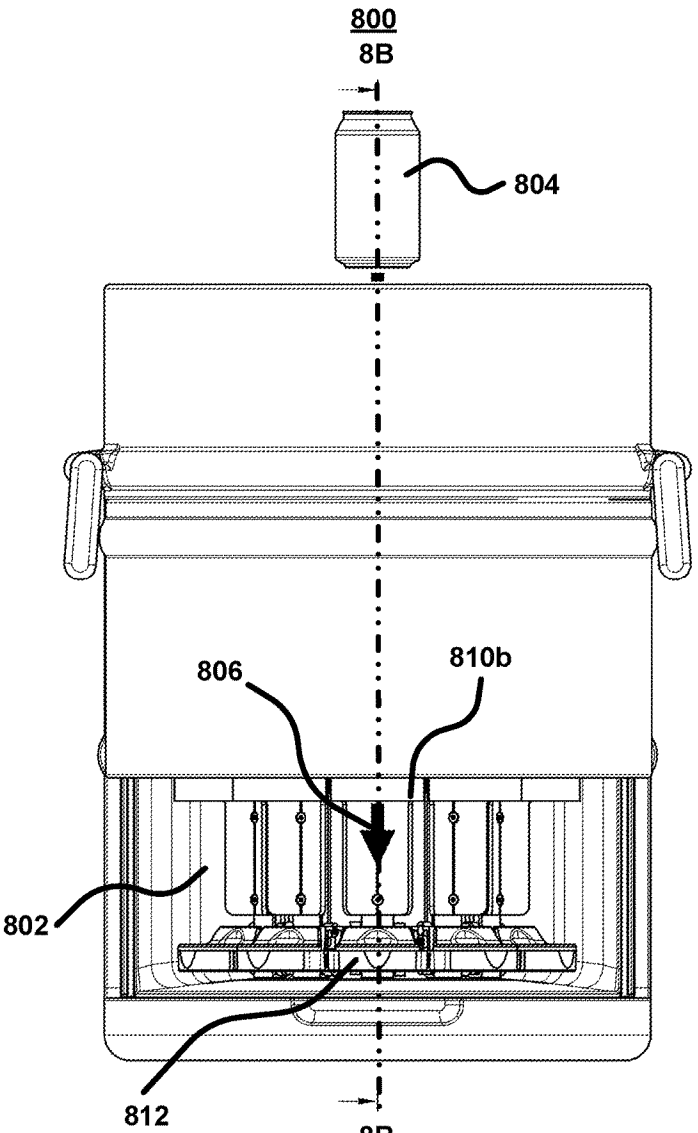
FIG. 8A is a front view of a beverage dispenser, with a beverage container being inserted, with the lid removed and the beverage dispensing area in an open position according to exemplary embodiments.
Figure 8C:
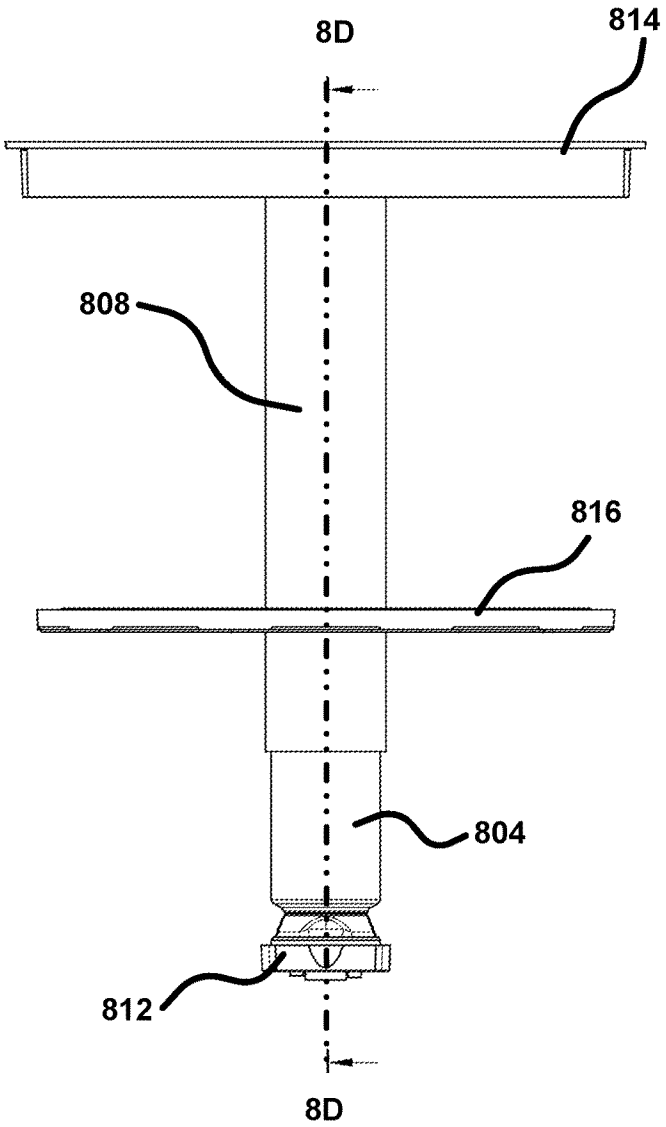
FIG. 8C is a front view of a tube of the beverage dispenser with mounting brackets containing a beverage container according to exemplary embodiments.
Figure 8D:
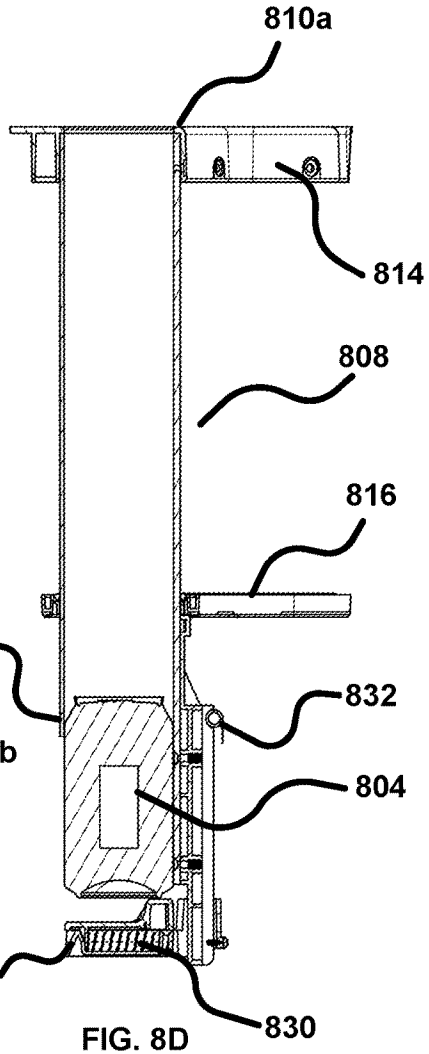
FIG. 8D is a cross-section of FIG. 8C taken along the line 8D-8D of FIG. 8C according to exemplary embodiments.

FIGS. 8A, 8B, 8C, 8D, 8E, 8F, 8G, 8H, 8I, 8J, and 8K (collectively, FIG. 8) depict various view of a beverage container and its internal structure in a condition of use, containing one or more beverage containers. FIG. 8A is a front view of a beverage dispenser 800 according to exemplary embodiments. In FIG. 8A, the lid has been removed and the beverage dispensing area 802 is shown in an open position and with no beverage containers present. The beverage dispenser 800 may be the same as the beverage dispenser 400 described above. FIG. 8B is a cross-sectional view of the beverage dispenser 800 taken along the line 8B-8B of FIG. 8A.

A beverage container 804 is depicted. According to exemplary embodiments, the beverage container 804 may be a 12 oz. can. The beverage container 804 may be inserted (e.g., dropped) in the direction of the arrow 806 into a tube 808 of the beverage dispenser 800. The tube 808 may be the center of five tubes in the beverage dispenser 800. The beverage container 804 may move, under the force of gravity and slowed by the air cushion in the tube, in the direction of the arrow 806 from the upper part 810*a* of the tube 808 (i.e., the tube opening) to a termination of the cylindrical portion 810*b* of the tube at an upper portion of the beverage dispensing area, ultimately impacting or contacting a can catcher assembly 812. The beverage container 804 may come to rest in the position shown in FIG. 5 with regards to beverage container 506 (albeit here in a different lateral location since the beverage container 804 is being inserted into a different tube than the one depicted in FIG. 5 for beverage container 506). Note that in FIGS. 8A and 8B, the can catcher assembly is depicted in its lowered position for illustrative purposes. In exemplary embodiments, the can catcher assembly 812 would be in its neutral or raised position, such as that depicted in FIGS. 7I through 7N.

In FIG. 8B, the open volume 826 located behind the tubes may be seen. This open volume may be used to contain cooling media, such as ice or the like, as well as contain additional beverage containers. A tube 828 may allow for the drainage of this open volume.

Figure 8E:
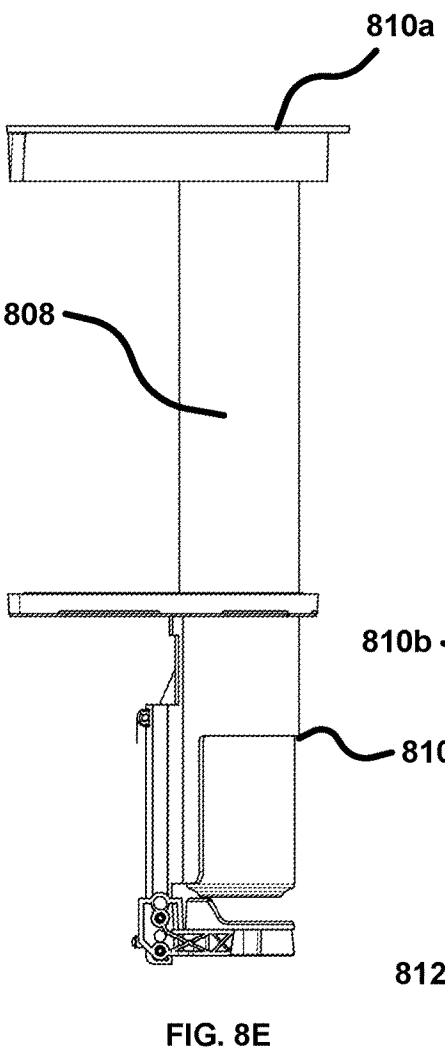
FIG. 8E is a side view of a tube of the beverage dispenser with mounting brackets containing a beverage container according to exemplary embodiments.

FIG. 8C is a front view of the tube 808 of FIGS. 8A and 8B. FIG. 8D is a cross-sectional view of the tube 808 taken along the line 8D-8D of FIG. 8C. FIG. 8E is a side view of the tube 808. In FIGS. 8C, 8D, and 8E, the beverage container 804 can be seen at the bottom position, in contact with the can catcher assembly 812. The mounting brackets 814 and 816 of the tube 808 (as well as for other tubes, not shown) are depicted.

Figure 8F:
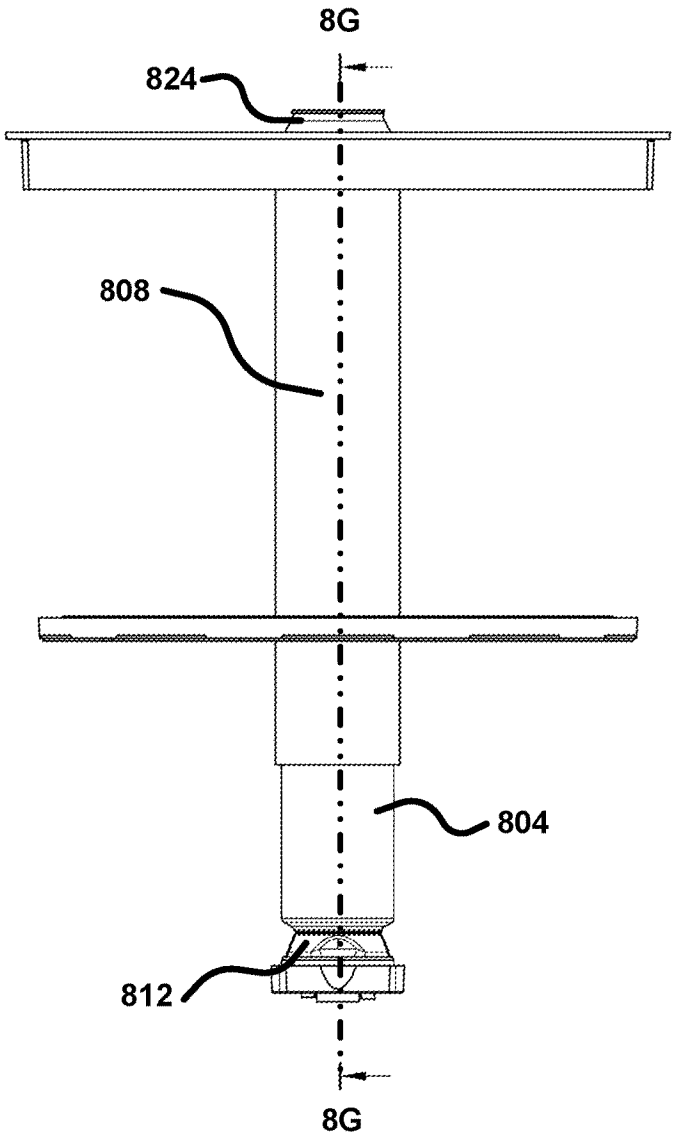
FIG. 8F is a front view of a tube of the beverage dispenser with mounting brackets containing multiple beverage containers according to exemplary embodiments.
Figure 8G:
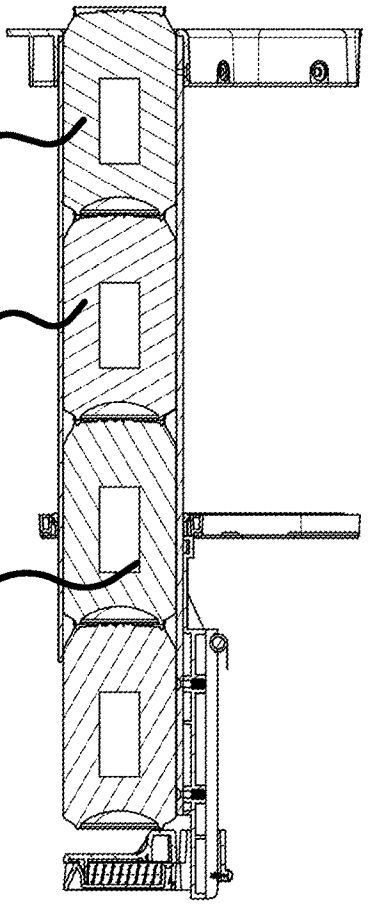
FIG. 8G is a cross-section of FIG. 8F taken along the line 8G-8G of FIG. 8F according to exemplary embodiments.
Figure 8H:
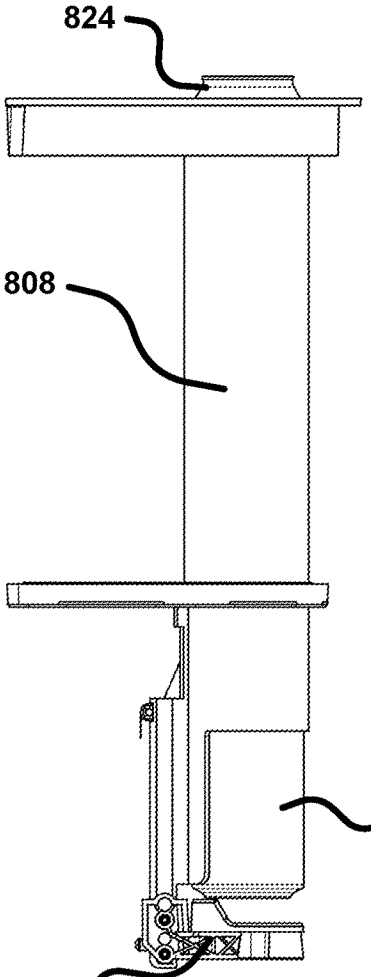
FIG. 8H is a front view of a tube of the beverage dispenser with mounting brackets containing multiple beverage containers according to exemplary embodiments.

FIG. 8F is a front view of the tube 808 of FIGS. 8A and 8B. FIG. 8G is a cross-sectional view of the tube 808 taken along the line 8F-8F of FIG. 8F. FIG. 8H is a side view of the tube 808. In FIGS. 8F, 8G, and 8H, the beverage container 804 can be seen at the bottom position, in contact with the can catcher assembly 812 (as in FIGS. 8C, 8D, and 8E). However, in FIGS. 8F, 8G, and 8H, additional beverage containers 820, 822, and 824 are depicted in addition to beverage container 804. The beverage containers 820, 822, and 824 can be seen to be stacked on top of one another, with only the upper portion of the container 824 visible at the upper portion of the tube 808 as depicted in FIGS. 8F, 8G, and 8H. The additional beverage containers 820, 822, and 824 may be sequentially loaded into the tube 808 following loading of beverage container 804.

Figure 8J:
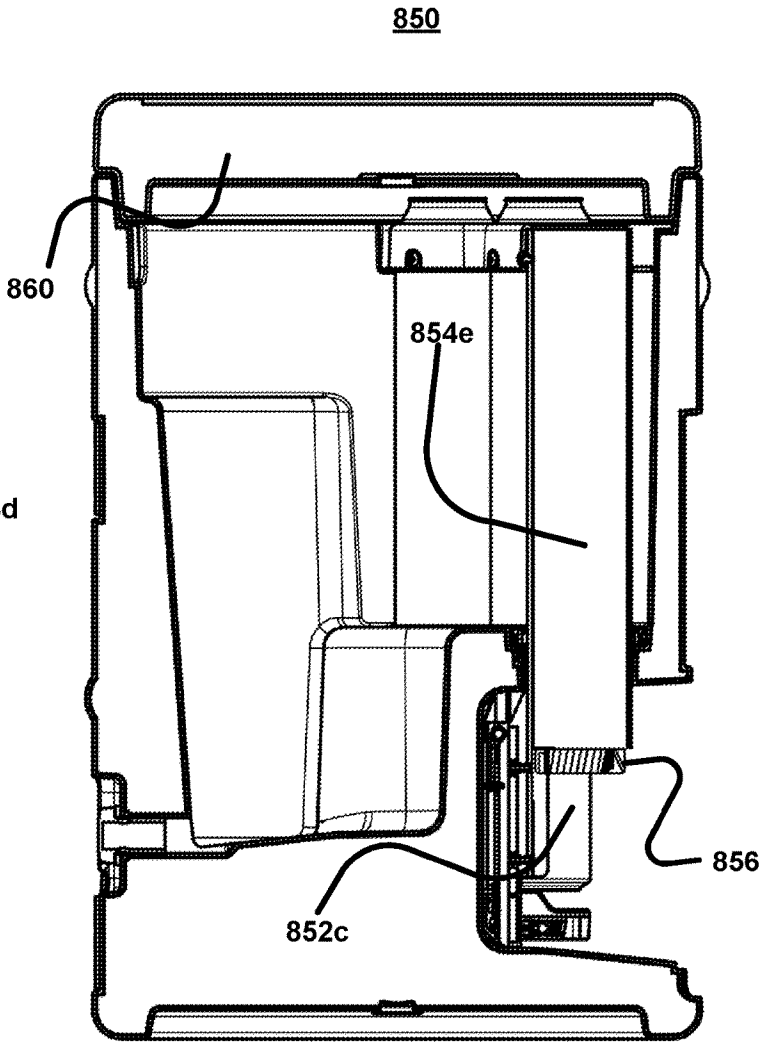
FIG. 8J is a cross-section of FIG. 8I taken along the line 8J-8J of FIG. 8I according to exemplary embodiments.
Figure 8I:
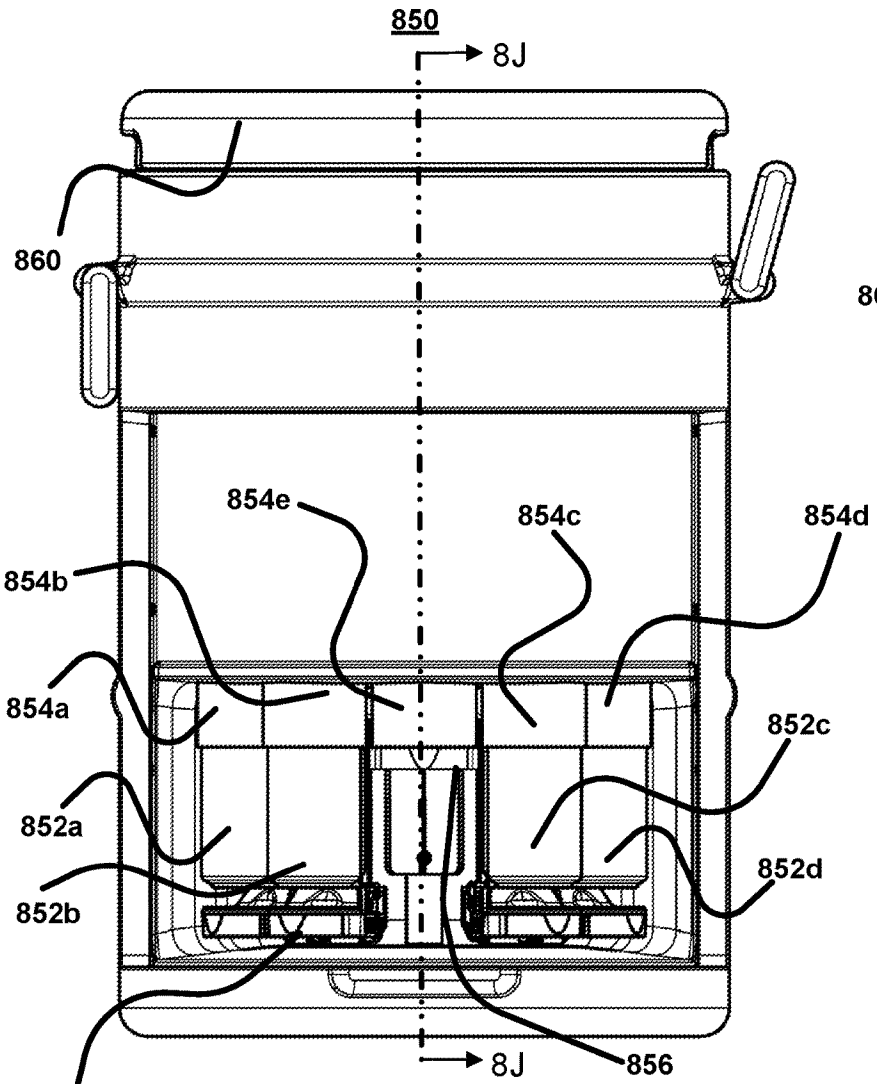
FIG. 8I is a front view of a beverage dispenser with the beverage dispensing area in an open position and containing beverage containers according to exemplary embodiments.

FIGS. 8I, 8J, an 8K depict a beverage dispenser 850 containing at least one beverage container (852*a*, 852*b*, 852*c*, and 852*d*) in four of the five tubes (854*a*, 854*b*, 854*c*, and 854*d*). The fifth tube (854*e*) is empty and the can catcher assembly 856 is depicted in the neutral or unloaded position. In this position, it is raised, as compared to when loaded such as can catcher assembly 858 under tube 854*b* (which is loaded with beverage container 852*b*). The beverage dispenser has a lid 860 on it. In this raised position, the can catcher assembly 856 (specifically, the puck portion) creates a seal or plug, at least partially, if not fully, of the tube 854*e* to facilitate an air cushion for a beverage container descending the tube. In the other tubes (854*a*, 854*b*, 854*c*, and 854*d*), this seal or plug is created by the beverage cans that have been inserted already. As with the seal from the can catcher assembly, the seal created by the beverage cans may not be perfect due to tolerances between the tube and the beverage can(s).

Figures 9A, 9B, 9C, 9D, 9E:
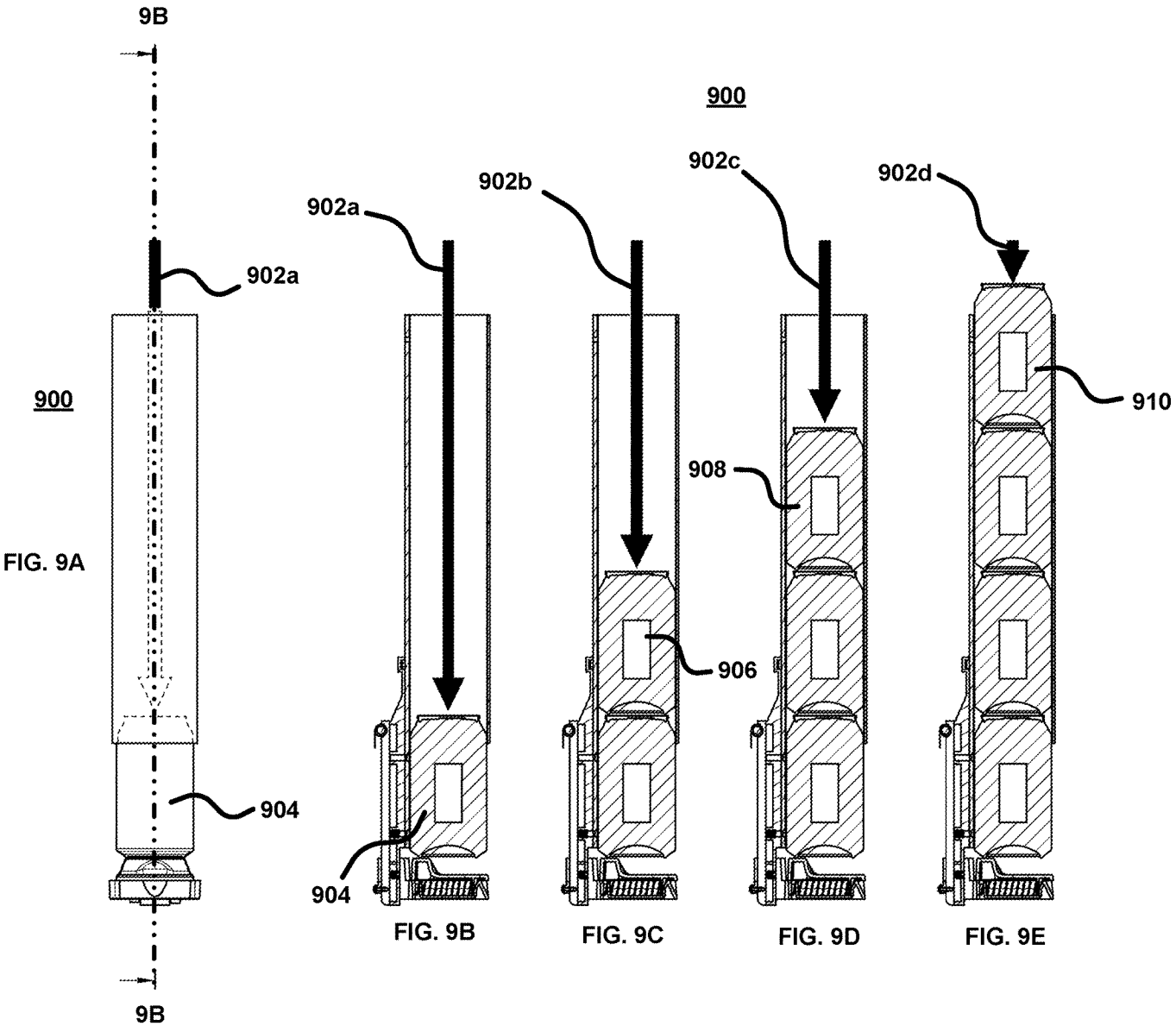
FIG. 9A is a front view of a tube according to exemplary embodiments.
FIG. 9B is a cross-section of FIG. 9A taken along the line 9B-9B of FIG. 9A according to exemplary embodiments.
FIG. 9C is a cross-section of FIG. 9A taken along the line 9B-9B of FIG. 9A according to exemplary embodiments.
FIG. 9D is a cross-section of FIG. 9A taken along the line 9B-9B of FIG. 9A according to exemplary embodiments.
FIG. 9E is a cross-section of FIG. 9A taken along the line 9B-9B of FIG. 9A according to exemplary embodiments.

FIG. 9A depicts a tube 900 according to exemplary embodiments. The tube may be same or similar the tubes described above, such as tube 808 of FIG. 8A, etc. FIGS. 9B, 9C, 9D, and 9E are cross-sectional views of the tube 900 taken along the line 9B-9B of FIG. 9A. In FIGS. 9A and 9B, a first beverage container 904 is inserted (e.g., dropped) into the tube 900 in the direction of the arrow 902*a*. In FIG. 9C, a second beverage container 906 is inserted into the tube 900 in the direction of the arrow 902*b*. In FIG. 9D, a third beverage container 908 is inserted into the tube 900 in the direction of the arrow 902*c*. In FIG. 9E, a fourth beverage container 910 is inserted into the tube 900 in the direction of the arrow 902*d*.

Figure 10A:
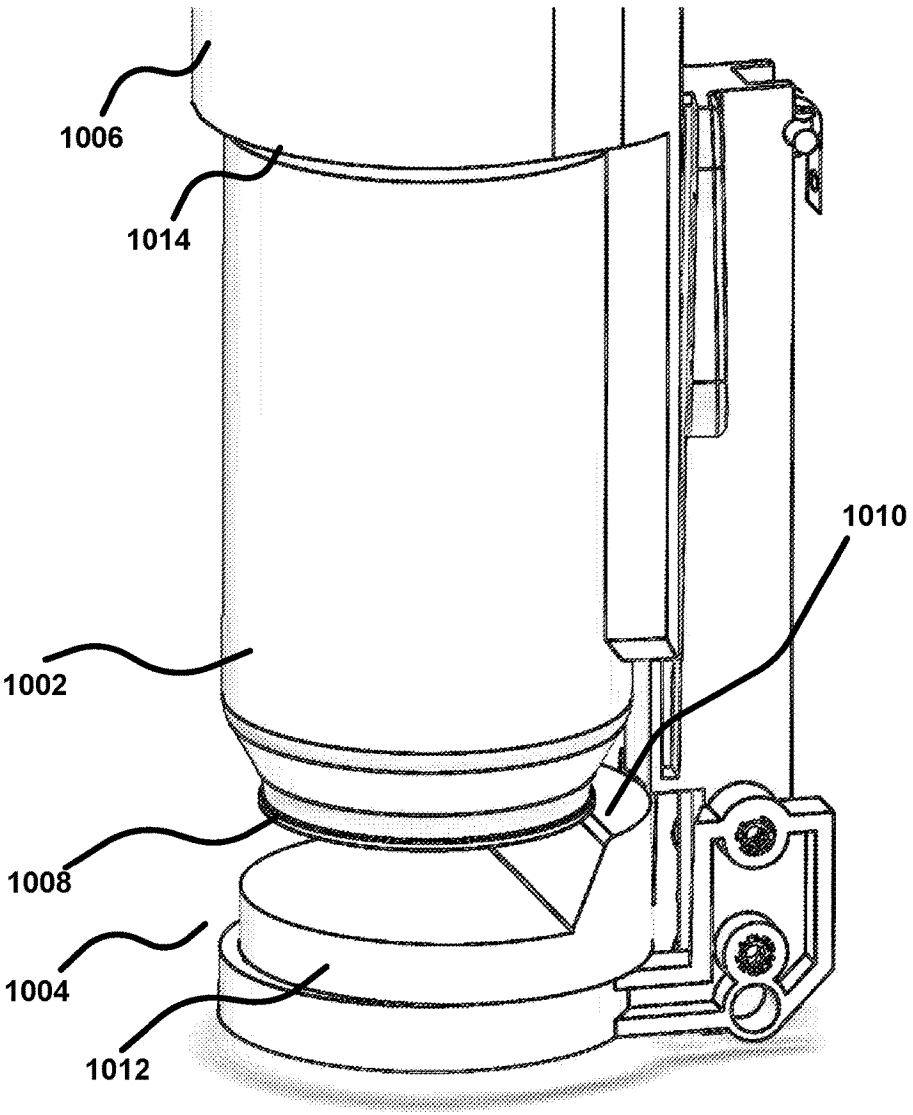
FIG. 10A is a first view of a beverage container on a can catcher assembly according to exemplary embodiments.
Figure 10B:
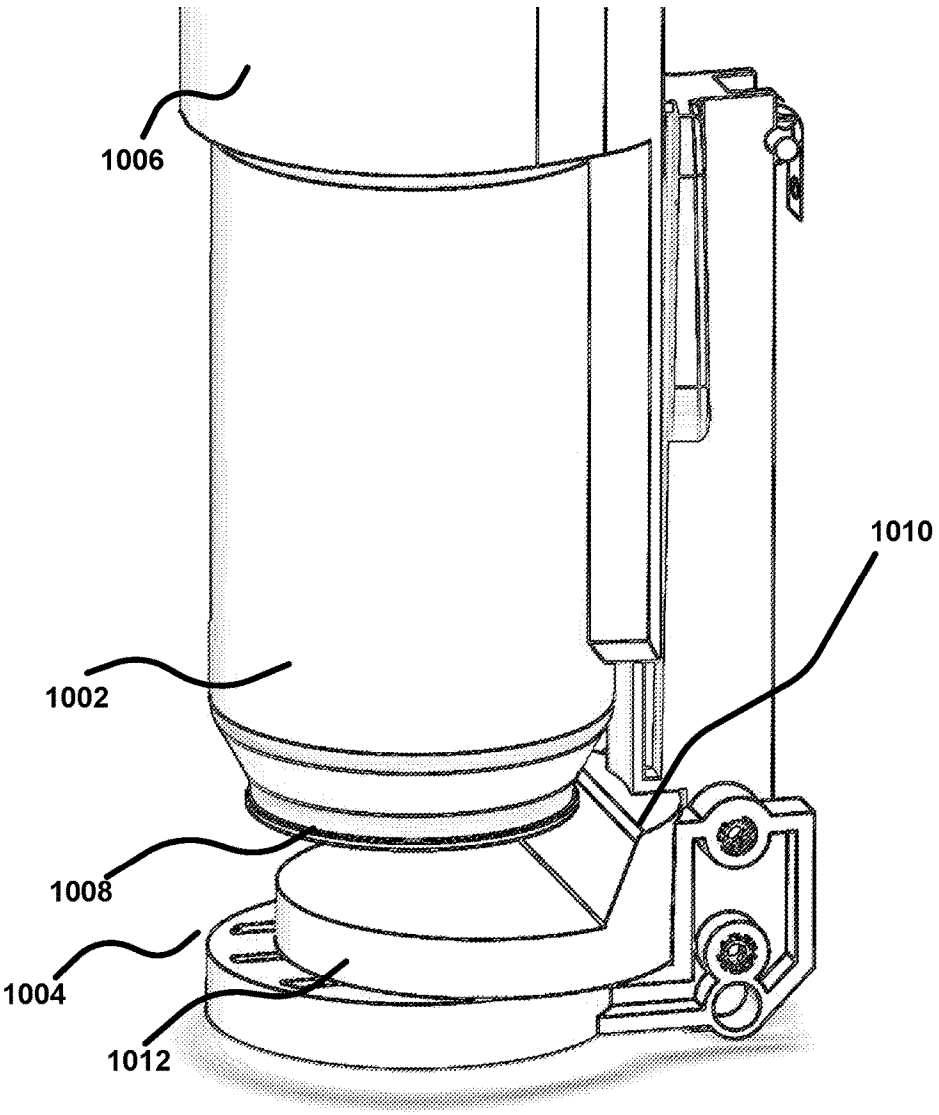
FIG. 10B is a second view of the beverage container on the can catcher assembly according to exemplary embodiments.
Figure 10C:
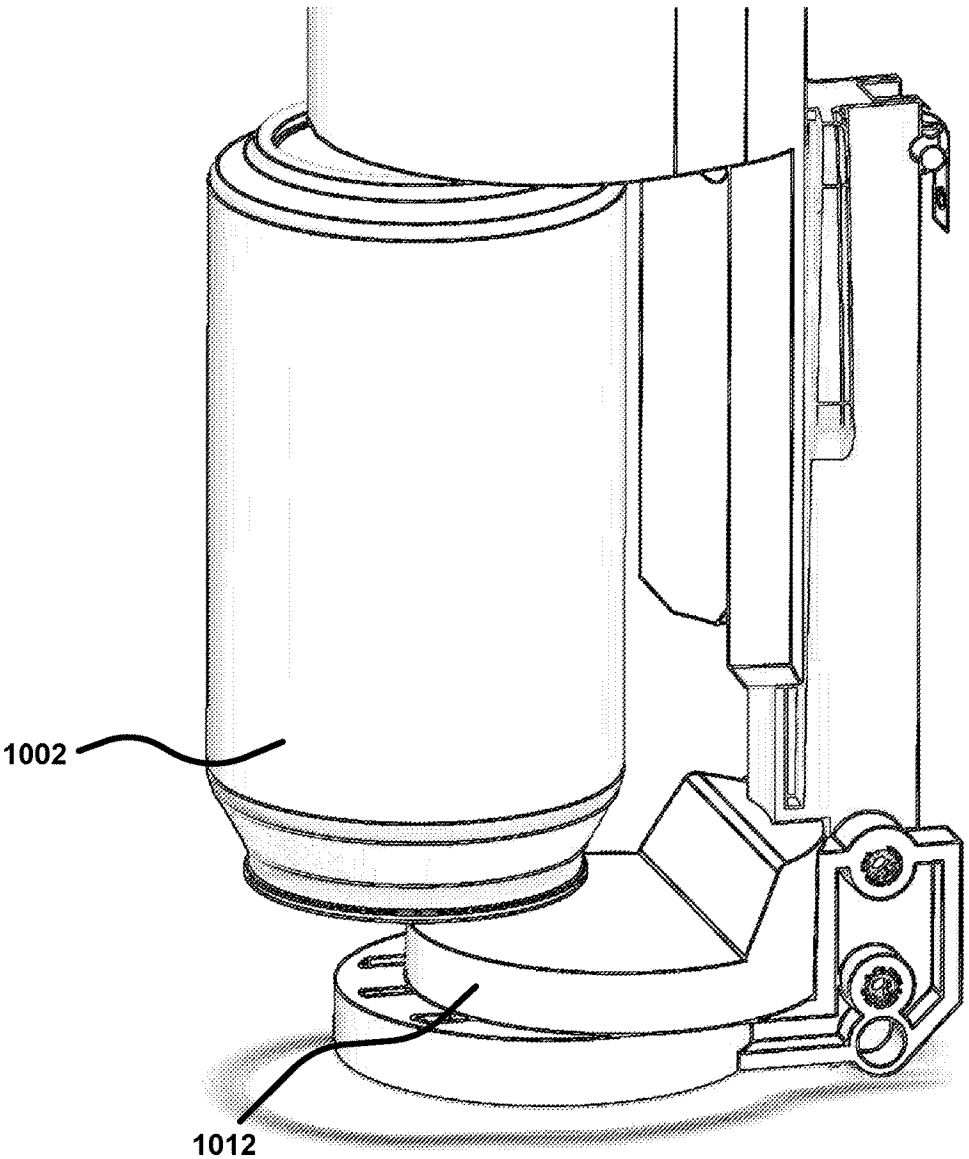
FIG. 10C is a third view of the beverage container on the can catcher assembly according to exemplary embodiments.

FIGS. 10A, 10B, and 10C depict three views (first, second, third, respectively) of a beverage container on a can catcher assembly. In FIG. 10A, a first view is depicted of a beverage container 1002 on a can catcher assembly 1004 according to exemplary embodiments, In this first view, the beverage container 1002 is at a bottom position, out of the cylindrical portion of the tube 1006 with the beverage container's lip 1008 resting on the ramped portion 1010 of the can catcher assembly's puck portion 1012. This is the position that the beverage container 1002 would be in at rest after being inserted into the tube 1006 (with the insertion occurring at an upper portion of the tube as described above). Here, the beverage container 1002 has transited the tube length from top to bottom, impacted the can catcher assembly 1004 (with the impact occurring when the can catcher is in its neutral or raised position as described above), and the weight of the beverage container 1002 causing the puck portion 1012 to lower to the position depicted. In this position, a portion of the beverage container 1002 remains within the tube opening 1014.

In FIG. 10B, the puck portion 1012 is shown moved towards the rear of the can catcher assembly 1004. This movement may be accomplished by a finger of the user. Once the puck portion 1012 is moved to the rear, the beverage container 1002 may then descend fully from the tube opening 1014, allowing the beverage container 1002 to be removed from the device as depicted in FIG. 10C. The puck portion 1012 may then return to its normal position.

Note, that in FIGS. 10A, 10B, and 10C, the beverage container 1002 is depicted inverted; that is, the beverage container is depicted inserted top down to illustrate a potential scenario that may occur with a user inserting beverage containers and the movement of the puck portion to facilitate removal of the beverage container by a user.

Figure 11A:
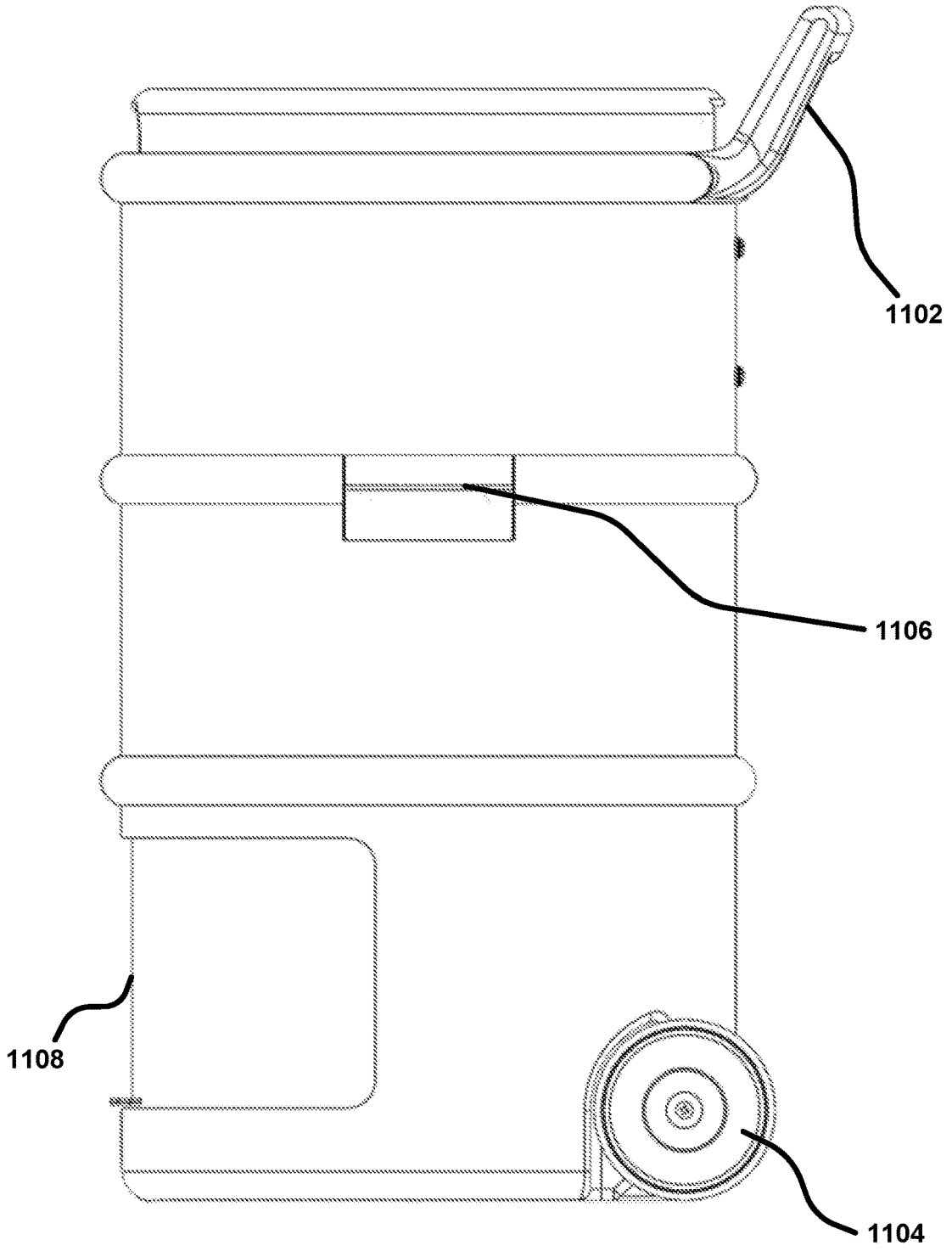
FIG. 11A is a side view of a beverage dispenser with an integrated cart according to exemplary embodiments.
Figure 11B:
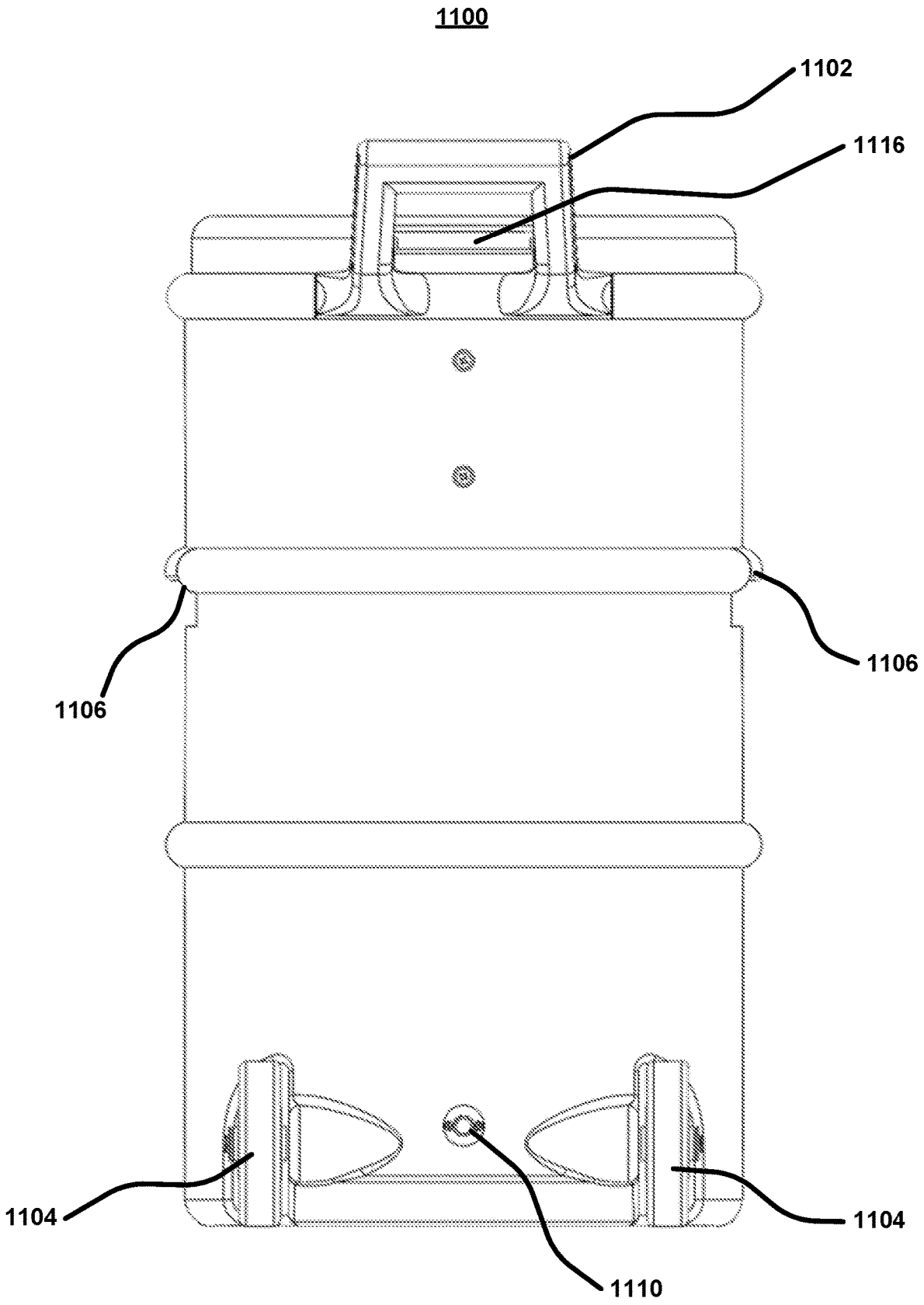
FIG. 11B is a rear view of the beverage dispenser with the integrated cart according to exemplary embodiments.
Figure 11C:
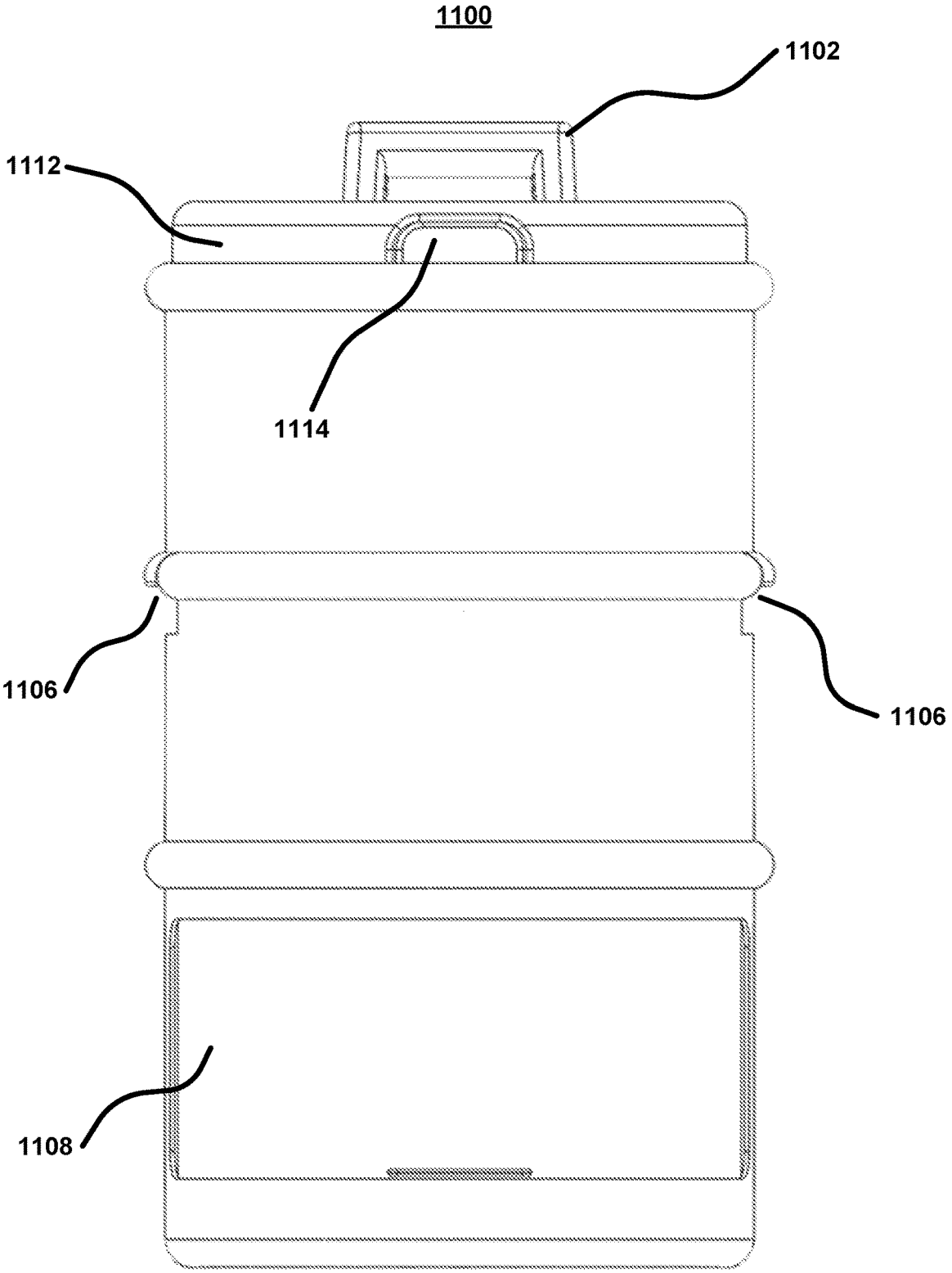
FIG. 11C is a front view of the beverage dispenser with the integrated cart according to exemplary embodiments.

Some embodiments of the beverage dispenser may have an integrated handle and wheels. That is, the beverage dispenser may have an integrated cart. FIGS. 11A, 11B, and 11C (collectively, FIG. 11) depict an example of this embodiment. The beverage dispenser 1100 may have a handle 1102 fixedly mounted an upper portion. The wheels 1104 may be mounted to a lower portion, opposite of and below the beverage dispensing area 1108. There may be two wheels 1104 as shown in FIG. 11B. The side of the beverage dispenser 1100 may include cut-outs or integrated handles 1106 which may allow for lifting of the beverage dispenser. These cut-outs may be an alternative to the handles described above. It should be appreciated that the integrated handles 1106 may be incorporated into the various embodiments described herein in place of the pivoting handles. It should also be appreciated that the beverage dispenser 1100 may include the pivoting handles described above. The rear of the beverage dispenser 1100 may have drain plug 1110. The lid portion 1112 may include a cut-out 1114 located at the front portion of the lid as depicted in FIG. 11C. This is an alternative to the side cut-outs for the lid portion as described above. Like the integrated handles 1106, this feature may be incorporated into the various embodiments as described herein. Further, the lid portion 1112 may be hinged in back portion such that it is attached to the beverage dispenser 1100, enabled it to be lifted open using the cut-out 1114 and rotated upward (not shown). One or more hinges 1116 may be used to allow for pivoting of the lid.

The beverage dispenser 1100 may be have the same structure as that of the apparatus 100, for example, with the difference being the integrated handle and wheels, as well as lack of side handles. For example, the insert and other internal structures, may be same as that of the embodiment of FIG. 1 et al. described above.

Figure 12A:
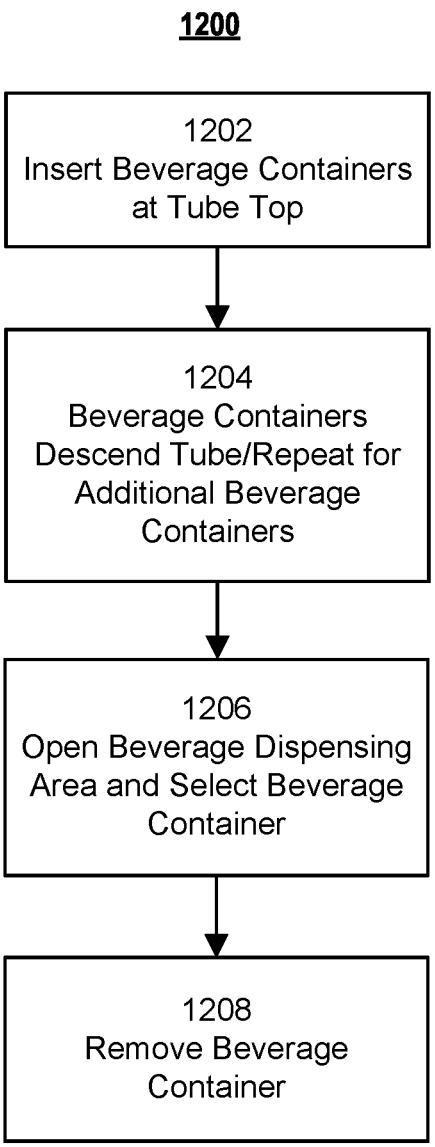
FIG. 12A is a method of operation of a beverage dispenser according to exemplary embodiments.
Figure 12B:
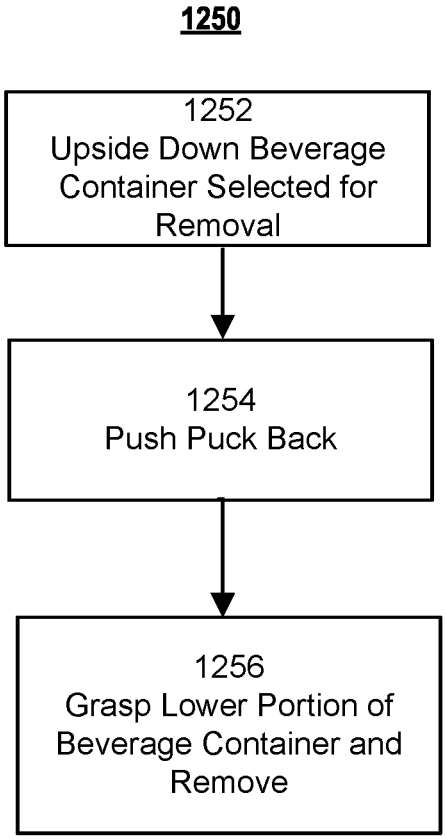
FIG. 12B is a method of operation of a beverage dispenser according to exemplary embodiments.

FIGS. 12A and 12B depict a method of operation of the beverage dispenser according to exemplary embodiments. These methods are exemplary and non-limiting.

Exemplary embodiments may be operated as follows as depicted in the method 1200 of FIG. 12A, with reference to FIGS. 8 and 9, in the scenario when beverage containers are inserted with the top upwards:

STEP ONE (1202)—One or more cylindrical beverage 12 oz. cans (e.g., typical US beer cans, soda cans, etc.) are inserted into one or more of the metal tubes (e.g., beverage container 804 as depicted in FIGS. 8A and 8B). The beverage container 804 (or 904), according to exemplary embodiments, is inserted with the top upwards (i.e., the part of the beverage container with the opening for dispensing the contents). In some embodiments, the beverage container may be inserted upside down. This situation is described below and is depicted in FIG. 10.

Figure 8K:
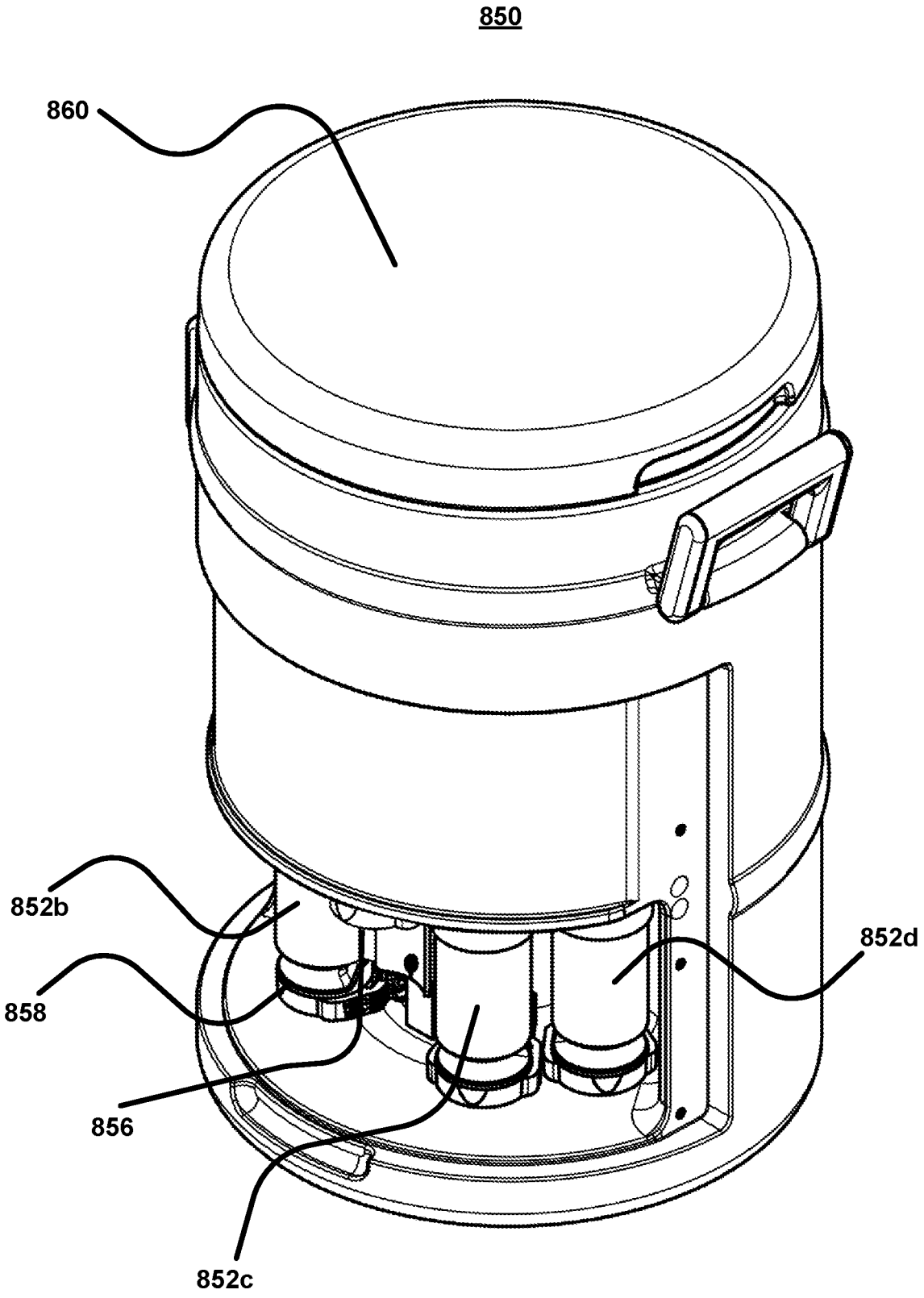
FIG. 8K is a front perspective view of the beverage dispenser with the beverage dispensing area in an open position and containing beverage containers according to exemplary embodiments.

STEP TWO (1204)—The beverage container descends through the tube from top to bottom and come to rest in a beverage dispensing area on a can catcher assembly (e.g., in the direction of the arrow 806 in FIG. 8B and coming to rest on can catcher assembly 812 at depicted in FIGS. 8C through 8E; see also FIGS. 9A and 9B and beverage container 904 which is inserted in the direction of arrow 902*a*). In exemplary embodiments, the can catcher assembly, when unloaded, may be in a raised position, such as depicted in FIGS. 8I, 8J, and 8K at 856. Once loaded, the can catcher assembly may descend to a lower position, such as depicted in FIGS. 8A and 8B. The insertion and loading process may be repeated for each beverage container and the beverage containers are stacked one after another within the tube (e.g., FIGS. 9C through 9E depict the can stacking process), with only the first beverage container in the tube being visible in the beverage dispensing area (e.g., as depicted in FIGS. 8F through 8H). While inside of the tubes, the beverage containers may be cooled and/or kept cool (if there is ice or other cooling media within the beverage dispenser surrounding the tubes).

STEP THREE (1206)—When the user is ready for beverage container, they can open a door (window) of the beverage dispensing area and choose a beverage container from the opening (e.g., the beverage container, such as 804, may be removed at beverage dispensing area 802 from the position shown in FIGS. 8C through 8E) and there may be a beverage container located in each of can catcher assemblies for each tube (in FIG. 8, for example, only on beverage container is depicted, but there could be up to five beverage containers in the beverage dispensing area 802).

STEP FOUR (1208)—The user may then grab the bottom of the beverage container (e.g., a lower half or portion of the beverage container just above or proximal to the can catcher assembly 812) and angle the bottom portion of the beverage container outward (i.e., away from the beverage dispensing area), allowing it to be removed from the beverage dispensing area and come out freely through the door (window). The angling is required because a portion of the beverage container (i.e., the upper portion of the beverage container) remains within the lower end of the tube (as depicted in FIG. 9A, for example). The angling of the lower portion of the beverage container allows the upper portion of the beverage container within the tube to descend. The ramped portion of the can catcher assembly (e.g., 712 in FIGS. 7 and 1010 in FIG. 10A) assists in allowing the can to slide outward also. Once the bottom beverage container is removed (e.g., beverage container 804 in FIGS. 8F through 8H), the next beverage container up (e.g., beverage container 820) may then descend to replace the removed beverage container.

The operation of exemplary embodiments therefore may be slightly different (than that described above with respect to the method 1200 of FIG. 12A described above) if a beverage can is inserted upside down (e.g., inserted into the tube opening with the top downward) as depicted in FIGS. 10A, 10B, and 10C. The insertion of the beverage container, as well as any additional beverage containers, may be the same as described above with respect to FIG. 12A at 1202 and 1204. Also, the selection of a beverage container may be the same as at 1206 above with the exception that an upside beverage container is selected for removal. The following method 1250 may replace 1208 above and may be used for operation of exemplary embodiments in this scenario as depicted in FIG. 12B, when one or more beverage containers are inserted upside down, with reference to FIG. 10:

STEP ONE (1252)—If a user placed a beverage container upside down inside the tube (e.g., tube 1006 and beverage container 1002 as depicted in FIG. 10A), the beverage container may be removed by locating the bottom surface of the can catcher (e.g., 1004), referred to herein as a puck or puck assembly or puck portion (e.g., 1012).

STEP TWO (1254)—The user may then push or slide the puck portion 1012 away from under the beverage container 1002 (towards the rear of the beverage dispensing area or towards the ramped portion 1010) (e.g., as depicted in FIG. 10B), thereby allowing the beverage container (which is upside down as depicted in FIG. 10B, for example) to come free of the tube assembly (e.g., as depicted in FIG. 10C) (since a portion of the beverage container may be within the tube opening above the beverage dispensing area due to the upside down insertion of the beverage container).

STEP THREE (1256)—The user then may grab the lower portion (as oriented in the dispenser) of the beverage container (e.g., just above or proximal 1008) and slide it out of the tube through the cooler door (window) (e.g., as depicted in FIG. 10C). The next beverage container above it may then descend as descripted above.

The foregoing examples show the various embodiments in exemplary configurations; however, it should be appreciated that the various components may be configured in a variety of ways. As will be appreciated by those skilled in the art, the components of the various embodiments may be arranged at any location or locations so long as they do not affect the operation of the respective system.

It will be readily understood by those persons skilled in the art that the various embodiments are susceptible to broad utility and application. Many embodiments and adaptations other than those herein described, as well as many variations, modifications and equivalent arrangements, will be apparent from or reasonably suggested by the various embodiments and foregoing description thereof, without departing from the substance or scope of the various embodiments. For example, although the embodiments have been described herein in the context of a particular implementation in a particular environment for a particular purpose, those skilled in the art will recognize that its usefulness is not limited thereto and that the embodiments can be beneficially implemented in other related environments for similar purposes. For example, the tube structure may be used in a vending machine or another type of beverage dispenser.

Accordingly, while the various embodiments have been described here in detail in relation to its exemplary embodiments, it is to be understood that this disclosure is only illustrative and exemplary of the various embodiments and is made to provide an enabling disclosure of the various embodiments. Accordingly, the foregoing disclosure is not intended to be construed or to limit the various embodiments or otherwise to exclude any other such embodiments, adaptations, variations, modifications or equivalent arrangements.

What we claim is:

1. A beverage dispenser, comprising:

a cylindrical outer shell;

an insert, mounted inside of the cylindrical outer shell, the insert comprising a plurality of cylindrical tubes, each of the plurality of cylindrical tubes being sized to fit a plurality of beverage cans and extending from an upper portion of the cylindrical outer shell to proximate a lower portion of the cylindrical outer shell, wherein access to the insert is through a lid mounted on an upper portion of the cylindrical outer shell, the insert further comprising a bracket for mounting the insert to an interior portion of the cylindrical outer shell and containing the plurality of cylindrical tubes, the bracket being configured to stabilize the plurality of cylindrical tubes and align the plurality of cylindrical tubes in an arc such that each of the plurality of tubes is positioned next to each other; and a beverage dispensing area, located at a lower portion of the cylindrical outer shell, and comprising a single location where each of the plurality of cylindrical tubes terminate, comprising:

a movable covering that provides access through the cylindrical outer shell to an inner volume; and the inner volume being located below a lower portion of the insert and comprising a termination point for each of the plurality of cylindrical tubes, the inner volume being further configured to allow for removal of each of the plurality of beverage cans from each of the plurality of cylindrical tubes.

2. The beverage dispenser of claim 1, wherein the cylindrical outer shell is constructed of plastic.

3. The beverage dispenser of claim 1, wherein each of the plurality of cylindrical tubes is constructed of aluminum.

4. The beverage dispenser of claim 1, wherein the plurality of cylindrical tubes comprise five tubes.

5. The beverage dispenser of claim 1, wherein each of the plurality of cylindrical tubes is capable of containing up to four 12 ounce beverage cans.

6. The beverage dispenser of claim 1, further comprising:

two handles, located on opposite sides of the cylindrical outer shell below the lid, the two handles each being pivotally coupled to the cylindrical outer shell.

7. The beverage dispenser of claim 1, further comprising:

a cart configured to be removably attached to the cylindrical outer shell on an opposite side of the beverage dispensing area, the cart comprising:

a latching mechanism for removably attaching the cart to the cylindrical outer shell through mating of the latching mechanism with a complementary structure on the cylindrical outer shell, the cart further comprising:

a handle; and two wheels.

8. The beverage dispenser of claim 1, the insert further comprising:

an open volume located behind the plurality of cylindrical tubes.

9. The beverage dispenser of claim 1, further comprising:

a mechanism located at the lower portion of each of the plurality of cylindrical tubes within the inner volume and below the termination point of each of the plurality of cylindrical tubes, the mechanism comprising a puck portion and a rail portion;

the rail portion being mounted to a tongue portion of each of the plurality of cylindrical tubes that extends into the beverage dispensing area below the termination of a cylindrical portion of each of the plurality of cylindrical tubes and the puck portion being mounted thereto and being configured to move vertically along the rail portion;

the puck portion having an unloaded position and a loaded position, wherein the unloaded position is above the loaded position, and the puck portion is configured to move downward from the unloaded position to the loaded position upon being impacted by one of the plurality of beverage cans descending out of the cylindrical portion; and the puck portion being further configured to slide horizontally to allow for removal of the one of the plurality of beverage cans from the beverage dispensing area.

10. A beverage dispensing structure, comprising:

a plurality of cylindrical tubes, each of the plurality of cylindrical tubes being sized to fit a plurality of beverage cans;

a mechanism located at a lower portion of each of the plurality of cylindrical tubes and below a termination of a cylindrical portion of each of the plurality of cylindrical tubes, the mechanism comprising a puck portion and a rail portion;

the rail portion being mounted to a tongue portion of each of the plurality of cylindrical tubes that extends below the termination of the cylindrical portion and the puck portion being mounted thereto and being configured to move vertically along the rail portion;

the puck portion having an unloaded position and a loaded position, wherein the unloaded position is above the loaded position and is configured such that the unloaded position of the puck portion creates a seal of the termination of each of the plurality of cylindrical tubes to create an air cushion within each of the cylindrical tubes to slow a descent of a beverage can inserted thereto; and the puck portion being further configured to slide horizontally.

11. The beverage dispensing structure of claim 10, wherein each of the plurality of cylindrical tubes is constructed of aluminum.

12. The beverage dispensing structure of claim 10, wherein the plurality of cylindrical tubes comprise five tubes.

13. The beverage dispensing structure of claim 10, wherein each of the plurality of cylindrical tubes is capable of containing up to four 12 ounce beverage cans.

14. The beverage dispensing structure of claim 10, wherein the puck portion is spring loaded to return to the unloaded position when in an unloaded state.

15. The beverage dispensing structure of claim 10, further comprising:

a bracket structure containing the plurality of cylindrical tubes and configured for mounting in a cooler structure.

16. A beverage dispenser, comprising:

a cylindrical outer shell;

an insert, mounted inside of the cylindrical outer shell, the insert comprising a plurality of cylindrical tubes, each of the plurality of cylindrical tubes being sized to fit a plurality of beverage cans and extending from an upper portion of the cylindrical outer shell to proximate a lower portion of the cylindrical outer shell, wherein access to the insert is through a lid mounted on an upper portion of the cylindrical outer shell;

an open volume located behind the plurality of cylindrical tubes; and a beverage dispensing area, located at a lower portion of the cylindrical outer shell where the plurality of cylindrical tubes terminate, comprising:

a movable covering that provides access through the cylindrical outer shell to an inner volume;

the inner volume being located below a lower portion of the insert and comprising a termination point for each of the plurality of cylindrical tubes, the inner volume being further configured to allow for removal of each of the plurality of beverage cans from each of the plurality of cylindrical tubes;

a mechanism located at the lower portion of each of the plurality of cylindrical tubes within the inner volume and below the termination point of each of the plurality of cylindrical tubes, the mechanism comprising a puck portion and a rail portion;

the rail portion being mounted to a tongue portion of each of the plurality of cylindrical tubes that extends into the beverage dispensing area below the termination of a cylindrical portion of each of the plurality of cylindrical tubes, the puck portion being mounted thereto and being configured to move vertically along the rail portion;

the puck portion having an unloaded position and a loaded position, wherein the unloaded position is above the loaded position, and the puck portion is configured to move downward from the unloaded position to the loaded position upon being impacted by one of the plurality of beverage cans descending out of the cylindrical portion; and the puck portion being further configured to slide horizontally to allow for removal of the one of the plurality of beverage cans from the beverage dispensing area.

17. The beverage dispenser of claim 16, wherein the cylindrical outer shell is constructed of plastic.

18. The beverage dispenser of claim 16, wherein each of the plurality of cylindrical tubes is constructed of aluminum.

19. The beverage dispenser of claim 16, wherein the plurality of cylindrical tubes comprise five tubes.

20. The beverage dispenser of claim 16, wherein each of the plurality of cylindrical tubes is capable of containing up to four 12 ounce beverage cans.

* * * * *